US009870684B2

(12) United States Patent
Wang et al.

(10) Patent No.: US 9,870,684 B2
(45) Date of Patent: Jan. 16, 2018

(54) INFORMATION PROCESSING APPARATUS, INFORMATION PROCESSING METHOD, PROGRAM, AND INFORMATION PROCESSING SYSTEM FOR ACHIEVING A SURVEILLANCE CAMERA SYSTEM

(71) Applicant: SONY CORPORATION, Tokyo (JP)

(72) Inventors: QiHong Wang, Tokyo (JP); Kenichi Okada, Tokyo (JP); Ken Miyashita, Tokyo (JP); Yasushi Okumura, Tokyo (JP)

(73) Assignee: Sony Corporation, Tokyo (JP)

( * ) Notice: Subject to any disclaimer, the term of this patent is extended or adjusted under 35 U.S.C. 154(b) by 121 days.

(21) Appl. No.: 14/763,581

(22) PCT Filed: Jan. 16, 2014

(86) PCT No.: PCT/JP2014/000180
§ 371 (c)(1),
(2) Date: Jul. 27, 2015

(87) PCT Pub. No.: WO2014/122884
PCT Pub. Date: Aug. 14, 2014

(65) Prior Publication Data

US 2015/0356840 A1 Dec. 10, 2015

(30) Foreign Application Priority Data

Feb. 6, 2013 (JP) ..... 2013-021371

(51) Int. Cl.
*G08B 13/196* (2006.01)

(52) U.S. Cl.
CPC . *G08B 13/19608* (2013.01); *G08B 13/19682* (2013.01); *G08B 13/19691* (2013.01)

(58) Field of Classification Search
CPC ..... G08B 13/19608; G08B 13/19682; G08B 13/19691
See application file for complete search history.

(56) References Cited

U.S. PATENT DOCUMENTS

2003/0085992 A1 5/2003 Arpa et al.
2005/0104727 A1* 5/2005 Han ..... G06K 9/00335 340/541
2006/0078047 A1 4/2006 Shu et al.
(Continued)

FOREIGN PATENT DOCUMENTS

EP 1777959 A1 4/2007
EP 2442284 A1 4/2012
(Continued)

*Primary Examiner* — Siamak Harandi
(74) *Attorney, Agent, or Firm* — Paratus Law Group, PLLC

(57) ABSTRACT

There is provided an information processing apparatus including an obtaining unit configured to obtain a plurality of segments compiled from at least one media source, wherein each segment of the plurality of segments contains at least one image frame within which a specific target object is found to be captured, and a providing unit configured to provide image frames of the obtained plurality of segments for display along a timeline and in conjunction with a tracking status indicator that indicates a presence of the specific target object within the plurality of segments in relation to time.

24 Claims, 84 Drawing Sheets

(56) References Cited

U.S. PATENT DOCUMENTS

| | | | |
|---|---|---|---|
| 2006/0221184 | A1 | 10/2006 | Vallone et al. |
| 2008/0252448 | A1 | 10/2008 | Agarwalla et al. |
| 2008/0304706 | A1 | 12/2008 | Akisada et al. |

FOREIGN PATENT DOCUMENTS

| | | | |
|---|---|---|---|
| JP | 2009-251940 | | 10/2009 |
| WO | WO2009/121053 | A2 | 10/2009 |

* cited by examiner

INFORMATION PROCESSING APPARATUS, INFORMATION PROCESSING METHOD, PROGRAM, AND INFORMATION PROCESSING SYSTEM FOR ACHIEVING A SURVEILLANCE CAMERA SYSTEM

CROSS REFERENCE TO RELATED APPLICATIONS

The application is a National Stage Patent Application of PCT International Patent Application No. PCT/JP2014/000180 filed on Jan. 16, 2014 under 35 U.S.C. § 371, which claims the benefit of Japanese Priority Patent Application JP 2013-021371 filed Feb. 6, 2013, the entire contents of which are incorporated herein by reference in their entirety.

TECHNICAL FIELD

The present disclosure relates to an information processing apparatus, an information processing method, a program, and an information processing system that can be used in a surveillance camera system, for example.

BACKGROUND ART

For example, Patent Literature 1 discloses a technique to easily and correctly specify a tracking target before or during object tracking, which is applicable to a surveillance camera system. In this technique, an object to be a tracking target is displayed in an enlarged manner and other objects are extracted as tracking target candidates. A user merely needs to perform an easy operation of selecting a target (tracking target) to be displayed in an enlarged manner from among the extracted tracking target candidates, to obtain a desired enlarged display image, i.e., a zoomed-in image (see, for example, paragraphs [0010], [0097], and the like of the specification of Patent Literature 1).

CITATION LIST

Patent Literature

[PTL 1]
Japanese Patent Application Laid-open No. 2009-251940

SUMMARY

Technical Problem

Techniques to achieve a useful surveillance camera system as disclosed in Patent Literature 1 are expected to be provided.

In view of the circumstances as described above, it is desirable to provide an information processing apparatus, an information processing method, a program, and an information processing system that are capable of achieving a useful surveillance camera system.

Solution to Problem

According to an embodiment of the present disclosure, there is provided an image processing apparatus including: an obtaining unit configured to obtain a plurality of segments compiled from at least one media source, wherein each segment of the plurality of segments contains at least one image frame within which a specific target object is found to be captured; and a providing unit configured to provide image frames of the obtained plurality of segments for display along a timeline and in conjunction with a tracking status indicator that indicates a presence of the specific target object within the plurality of segments in relation to time.

According to another embodiment of the present disclosure, there is provided an image processing method including: obtaining a plurality of segments compiled from at least one media source, wherein each segment of the plurality of segments contains at least one image frame within which a specific target object is found to be captured; and providing image frames of the obtained plurality of segments for display along a timeline and in conjunction with a tracking status indicator that indicates a presence of the specific target object within the plurality of segments in relation to time.

According to another embodiment of the present disclosure, there is provided a non-transitory computer-readable medium having embodied thereon a program, which when executed by a computer causes the computer to perform a method, the method including: obtaining a plurality of segments compiled from at least one media source, wherein each segment of the plurality of segments contains at least one image frame within which a specific target object is found to be captured; and providing image frames of the obtained plurality of segments for display along a timeline and in conjunction with a tracking status indicator that indicates a presence of the specific target object within the plurality of segments in relation to time.

Advantageous Effects of Invention

As described above, according to the present disclosure, it is possible to achieve a useful surveillance camera system.

DESCRIPTION OF EMBODIMENTS

Hereinafter, embodiments of the present disclosure will be described with reference to the drawings.

(Surveillance Camera System)

Figure 1:
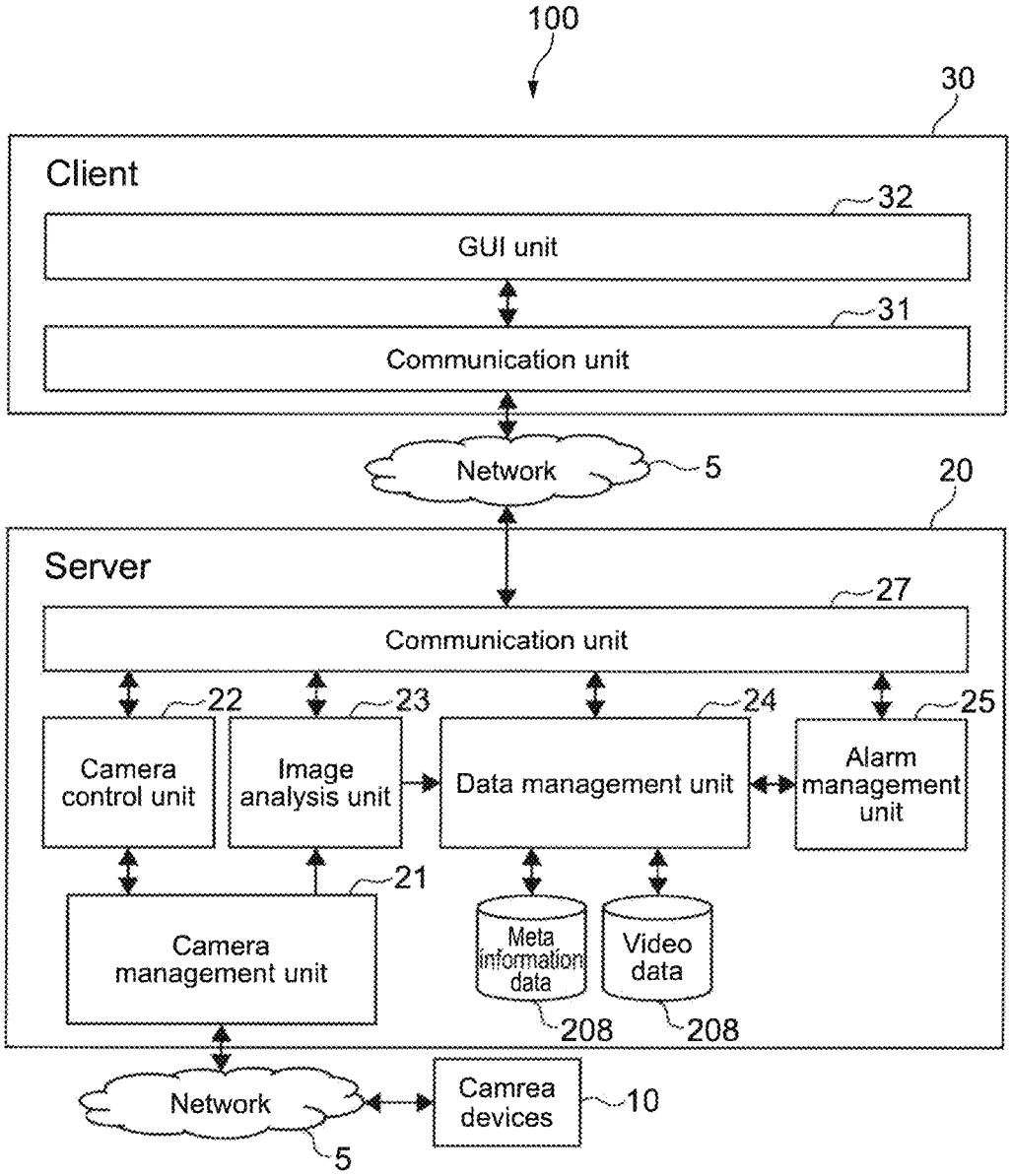
FIG. 1 is a block diagram showing a configuration example of a surveillance camera system including an information processing apparatus according to an embodiment of the present disclosure.

FIG. 1 is a block diagram showing a configuration example of a surveillance camera system including an information processing apparatus according to an embodiment of the present disclosure.

A surveillance camera system 100 includes one or more cameras 10, a server apparatus 20, and a client apparatus 30. The server apparatus 20 is an information processing apparatus according to an embodiment. The one or more cameras 10 and the server apparatus 20 are connected via a network 5. Further, the server apparatus 20 and the client apparatus 30 are also connected via the network 5.

The network 5 is, for example, a LAN (Local Area Network) or a WAN (Wide Area Network). The type of the network 5, the protocols used for the network 5, and the like are not limited. The two networks 5 shown in FIG. 1 do not need to be identical to each other.

The camera 10 is a camera capable of capturing a moving image, such as a digital video camera. The camera 10 generates and transmits moving image data to the server apparatus 20 via the network 5.

Figure 2:
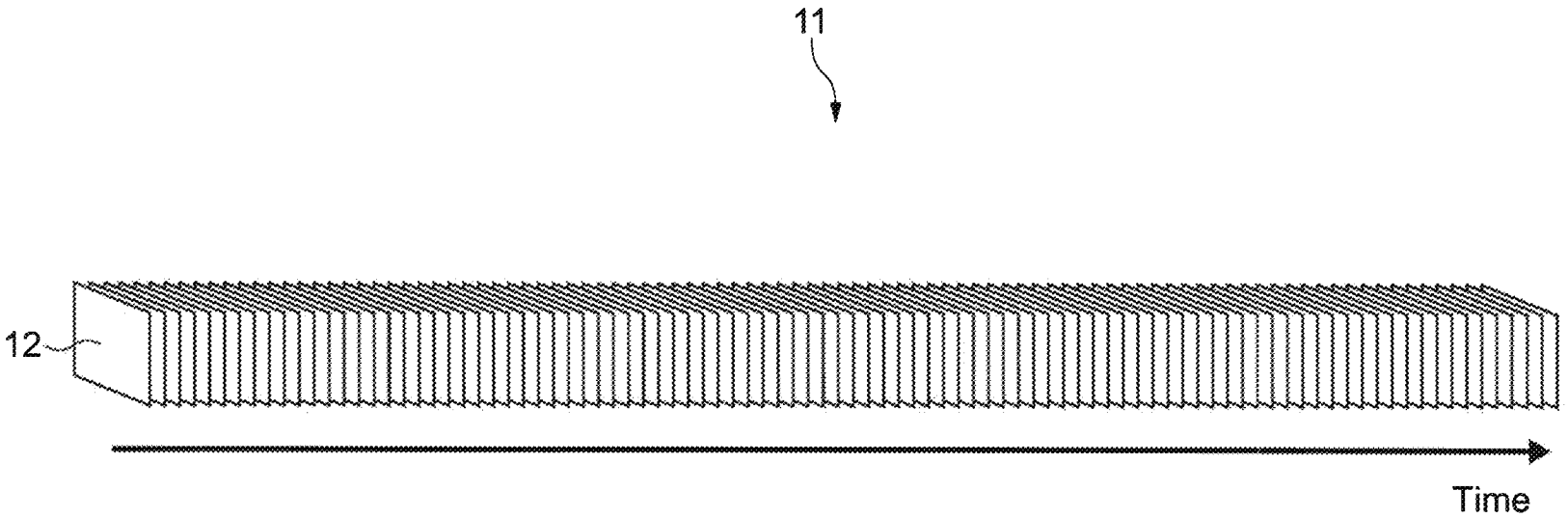
FIG. 2 is a schematic diagram showing an example of moving image data generated in an embodiment of the present disclosure.

FIG. 2 is a schematic diagram showing an example of moving image data generated in an embodiment. The moving image data 11 is constituted of a plurality of temporally successive frame images 12. The frame images 12 are generated at a frame rate of 30 fps (frame per second) or 60 fps, for example. Note that the moving image data 11 may be generated for each field by interlaced scanning. The camera 10 corresponds to an imaging apparatus according to an embodiment.

As shown in FIG. 2, the plurality of frame images 12 are generated along a time axis. The frame images 12 are generated from the left side to the right side when viewed in FIG. 2. The frame images 12 located on the left side correspond to the first half of the moving image data 11, and the frame images 12 located on the right side correspond to the second half of the moving image data 11.

In an embodiment, the plurality of cameras 10 are used. Consequently, the plurality of frame images 12 captured with the plurality of cameras 10 are transmitted to the server apparatus 20. The plurality of frame images 12 correspond to a plurality of captured images in an embodiment.

The client apparatus 30 includes a communication unit 31 and a GUI (graphical user interface) unit 32. The communication unit 31 is used for communication with the server apparatus 20 via the network 5. The GUI unit 32 displays the moving image data 11, GUIs for various operations, and other information. For example, the communication unit 31 receives the moving image data 11 and the like transmitted from the server apparatus 20 via the network 5. The moving image and the like are output to the GUI unit 32 and displayed on a display unit (not shown) by a predetermined GUI.

Further, an operation from a user is input in the GUI unit 32 via the GUI displayed on the display unit. The GUI unit 32 generates instruction information based on the input operation and outputs the instruction information to the communication unit 31. The communication unit 31 transmits the instruction information to the server apparatus 20 via the network 5. Note that a block to generate the instruction information based on the input operation and output the information may be provided separately from the GUI unit 32.

For example, the client apparatus 30 is a PC (Personal Computer) or a tablet-type portable terminal, but the client apparatus 30 is not limited to them.

The server apparatus 20 includes a camera management unit 21, a camera control unit 22, and an image analysis unit 23. The camera control unit 22 and the image analysis unit 23 are connected to the camera management unit 21. Additionally, the server apparatus 20 includes a data management unit 24, an alarm management unit 25, and a storage unit 208 that stores various types of data. Further, the server apparatus 20 includes a communication unit 27 used for communication with the client apparatus 30. The communication unit 27 is connected to the camera control unit 22, the image analysis unit 23, the data management unit 24, and the alarm management unit 25.

The communication unit 27 transmits various types of information and the moving image data 11, which are output from the blocks connected to the communication unit 27, to the client apparatus 30 via the network 5. Further, the communication unit 27 receives the instruction information transmitted from the client apparatus 30 and outputs the instruction information to the blocks of the server apparatus 20. For example, the instruction information may be output to the blocks via a control unit (not shown) to control the operation of the server apparatus 20. In an embodiment, the communication unit 27 functions as an instruction input unit to input an instruction from the user.

The camera management unit 21 transmits a control signal, which is supplied from the camera control unit 22, to the cameras 10 via the network 5. This allows various operations of the cameras 10 to be controlled. For example, the operations of pan and tilt, zoom, focus, and the like of the cameras are controlled.

Further, the camera management unit 21 receives the moving image data 11 transmitted from the cameras 10 via the network 5 and then outputs the moving image data 11 to the image analysis unit 23. Preprocessing such as noise processing may be executed as appropriate. The camera management unit 21 functions as an image input unit in an embodiment.

The image analysis unit 23 analyzes the moving image data 11 supplied from the respective cameras 10 for each frame image 12. The image analysis unit 23 analyzes the types and the number of objects appearing in the frame images 12, the movements of the objects, and the like. In an embodiment, the image analysis unit 23 detects a predetermined object from each of the plurality of temporally successive frame images 12. Herein, a person is detected as the predetermined object. For a plurality of persons appearing in the frame images 12, the detection is performed for each of the persons. The method of detecting a person from the frame images 12 is not limited, and a well-known technique may be used.

Further, the image analysis unit 23 generates an object image. The object image is a partial image of each frame image 12 in which a person is detected, and includes the detected person. Typically, the object image is a thumbnail image of the detected person. The method of generating the object image from the frame image 12 is not limited. The object image is generated for each of the frame images 12 so that one or more object images are generated.

Further, the image analysis unit 23 can calculate a difference between two images. In an embodiment, the image analysis unit 23 detects differences between the frame images 12. Furthermore, the image analysis unit 23 detects a difference between a predetermined reference image and each of the frame images 12. The technique used for calculating a difference between two images is not limited. Typically, a difference in luminance value between two images is calculated as the difference. Additionally, the difference may be calculated using the sum of absolute differences in luminance value, a normalized correlation coefficient related to a luminance value, frequency components, and the like. A technique used in pattern matching and the like may be used as appropriate.

Further, the image analysis unit 23 determines whether the detected object is a person to be monitored. For example, a person who fraudulently gets access to a secured door or the like, a person whose data is not stored in a database, and the like are determined as a person to be monitored. The determination on a person to be monitored may be executed by an operation input by a security guard who uses the surveillance camera system 100. In addition, the conditions, algorithms, and the like for determining the detected person as a suspicious person are not limited.

Further, the image analysis unit 23 can execute a tracking of the detected object. Specifically, the image analysis unit 23 detects a movement of the object and generates its tracking data. For example, position information of the object that is a tracking target is calculated for each successive frame image 12. The position information is used as tracking data of the object. The technique used for tracking of the object is not limited, and a well-known technique may be used.

The image analysis unit 23 according to an embodiment functions as part of a detection unit, a first generation unit, a determination unit, and a second generation unit. Those functions do not need to be achieved by one block, and a block for achieving each of the functions may be separately provided.

The data management unit 24 manages the moving image data 11, data of the analysis results by the image analysis unit 23, and instruction data transmitted from the client apparatus 30, and the like. Further, the data management unit 24 manages video data of past moving images and meta information data stored in the storage unit 208, data on an alarm indication provided from the alarm management unit 25, and the like.

In an embodiment, the storage unit 208 stores information that is associated with the generated thumbnail image, i.e., information on an image capture time of the frame image 12 that is a source to generate the thumbnail image, and identification information for identifying the object included in the thumbnail image. The frame image 12 that is a source to generate the thumbnail image corresponds to a captured image including the object image. As described above, the object included in the thumbnail image is a person in an embodiment.

The data management unit 24 arranges one or more images having the same identification information stored in the storage unit 208 from among one or more object images, based on the image capture time information stored in association with each image. The one or more images having the same identification information correspond to an identical object image. For example, one or more identical object images are arranged along the time axis in the order of the image capture time. This allows a sufficient observation of a time-series movement or a movement history of a predetermined object. In other words, a highly accurate tracking is enabled.

As will be described later in detail, the data management unit 24 selects a reference object image from one or more object images, to use it as a reference. Additionally, the data management unit 24 outputs data of the time axis displayed on the display unit of the client apparatus 30 and a pointer indicating a predetermined position on the time axis. Additionally, the data management unit 24 selects an identical object image that corresponds to a predetermined position on the time axis indicated by the pointer, and reads the object information that is information associated with the identical object image from the storage unit 208 and outputs the object information. Additionally, the data management unit 24 corrects one or more identical object images according to a predetermined instruction input by an input unit.

In an embodiment, the image analysis unit 23 outputs tracking data of a predetermined object to the data management unit 24. The data management unit 24 generates a movement image expressing a movement of the object based on the tracking data. Note that a block to generate the movement image may be provided separately and the data management unit 24 may output tracking data to the block.

Additionally, in an embodiment, the storage unit 208 stores information on a person appearing in the moving image data 11. For example, the storage unit 208 preliminarily stores data of a person on a company and a building in which the surveillance camera system 100 is used. When a predetermined person is detected and selected, for example, the data management unit 24 reads the data of the person from the storage unit 208 and outputs the data. For a person whose data is not stored, such as an outsider, data indicating that the data of the person is not stored may be output as information of the person.

Additionally, the storage unit 208 stores an association between the position on the movement image and each of the plurality of frame images 12. According to an instruction to select a predetermined position on the movement image based on the association, the data management unit 24 outputs a frame image 12, which is associated with the selected predetermined position and is selected from the plurality of frame images 12.

In an embodiment, the data management unit 24 functions as part of an arrangement unit, a selection unit, first and second output units, a correction unit, and a second generation unit.

The alarm management unit 25 manages an alarm indication for the object in the frame image 12. For example, based on an instruction from the user and the analysis results by the image analysis unit 23, a predetermined object is detected to be an object of interest, such as a suspicious person. The detected suspicious person and the like are displayed with an alarm indication. At that time, the type of alarm indication, a timing of executing the alarm indication, and the like are managed. Further, the history and the like of the alarm indication are managed.

Figure 3:
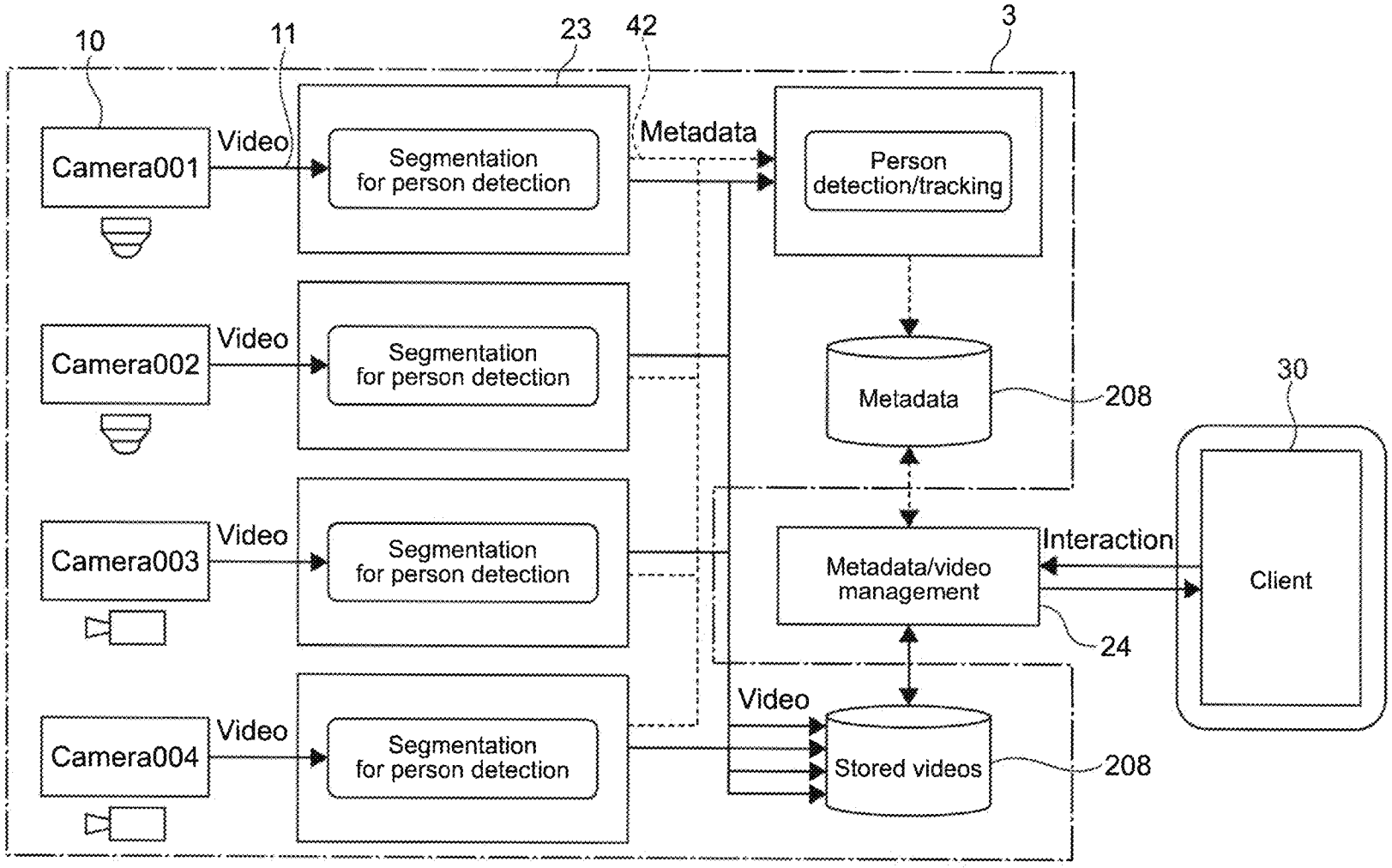
FIG. 3 is a functional block diagram showing the surveillance camera system according to an embodiment of the present disclosure.

FIG. 3 is a functional block diagram showing the surveillance camera system 100 according to an embodiment. The plurality of cameras 10 transmit the moving image data 11 via the network 5. Segmentation for person detection is executed (in the image analysis unit 23) for the moving image data 11 transmitted from the respective cameras 10. Specifically, image processing is executed for each of the plurality of frame images 12 that constitute the moving image data 11, to detect a person.

Figure 4:
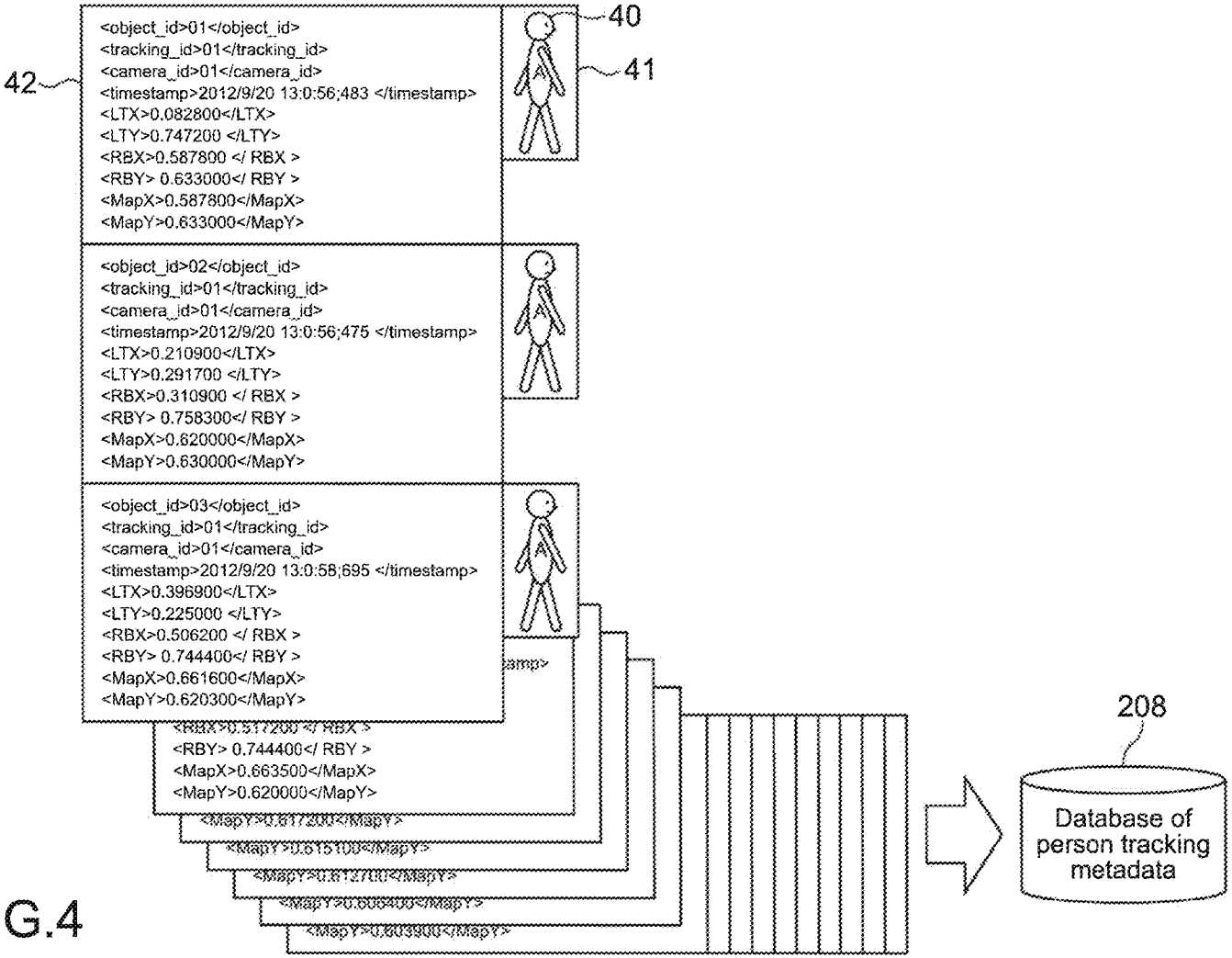
FIG. 4 is a diagram showing an example of person tracking metadata generated by person detection processing.

FIG. 4 is a diagram showing an example of person tracking metadata generated by person detection processing. As described above, a thumbnail image 41 is generated from the frame image 12 from which a person 40 is detected. Person tracking metadata 42 shown in FIG. 4, associated with the thumbnail image 41, is stored. The details of the person tracking metadata 42 are as follows.

The "object_id" represents an ID of the thumbnail image 41 of the detected person 40 and has a one-to-one relationship with the thumbnail image 41.

The "tracking_id" represents a tracking ID, which is determined as an ID of the same person 40, and corresponds to the identification information.

The "camera_id" represents an ID of the camera 10 with which the frame image 12 is captured.

The "timestamp" represents a time and date at which the frame image 12 in which the person 40 appears is captured, and corresponds to the image capture time information.

The "LTX", "LTY", "RBX", and "RBY" represent the positional coordinates of the thumbnail image 41 in the frame image 12 (normalization).

The "MapX" and "MapY" each represent position information of the person 40 in a map (normalization).

Figure 5A:
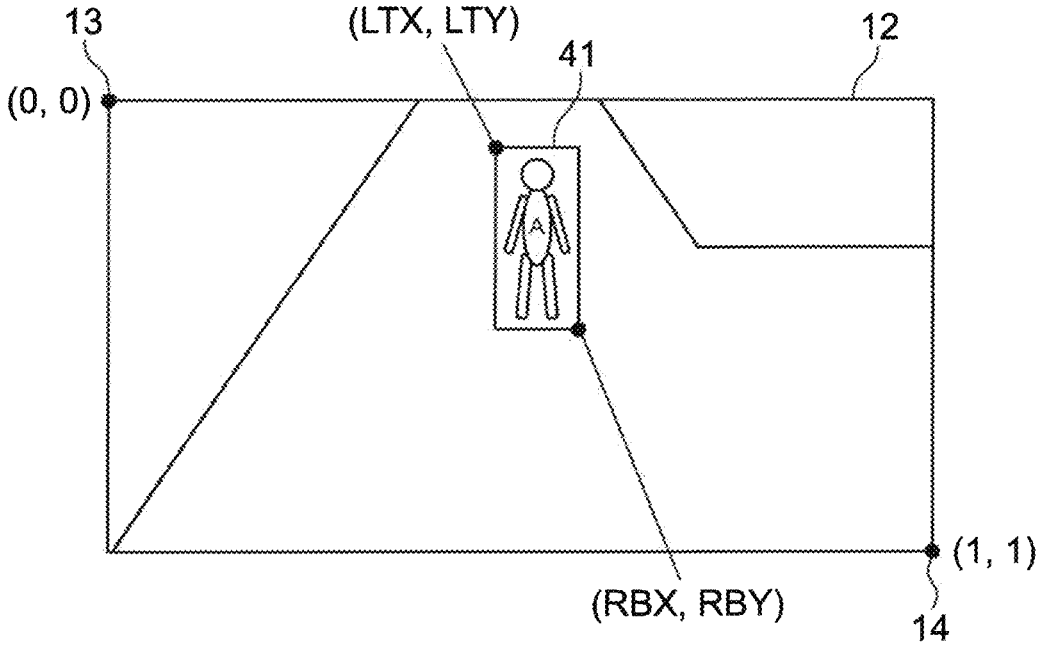
FIGS. 5A and 5B are each diagrams for describing the person tracking metadata.
Figure 5B:
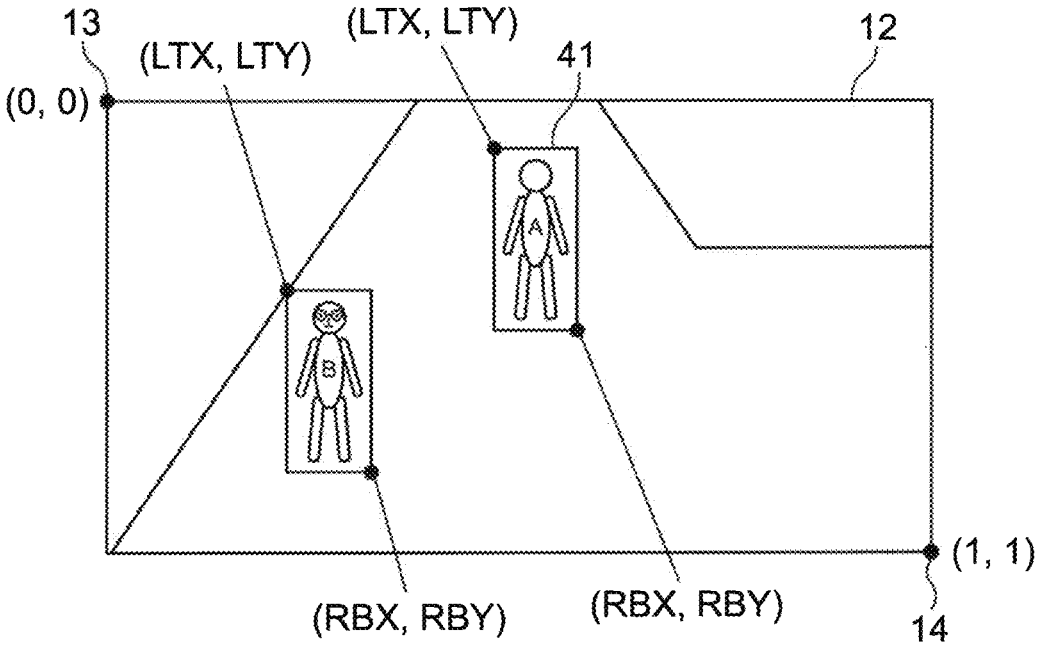

FIGS. 5A and 5B are each diagrams for describing the person tracking metadata 42, (LTX, LTY, RBX, RBY). As shown in FIG. 5A, the upper left end point 13 of the frame image 12 is set to be coordinates (0, 0). Further, the lower right end point 14 of the frame image 12 is set to be coordinates (1, 1). The coordinates (LTX, LTY) at the upper left end point of the thumbnail image 41 and the coordinates (RBX, RBY) at the lower right end point of the thumbnail image 41 in such a normalized state are stored as the person tracking metadata 42. As shown in FIG. 5B, for a plurality of persons 40 in the frame image 12, a thumbnail image 41 of each of the persons 40 is generated and data of positional coordinates (LTX, LTY, RBX, RBY) is stored in association with the thumbnail image 41.

As shown in FIG. 3, the person tracking metadata 42 is generated for each moving image data 11 and collected to be stored in the storage unit 208. Meanwhile, the thumbnail image 41 generated from the frame image 12 is also stored, as video data, in the storage unit 208.

Figure 6:
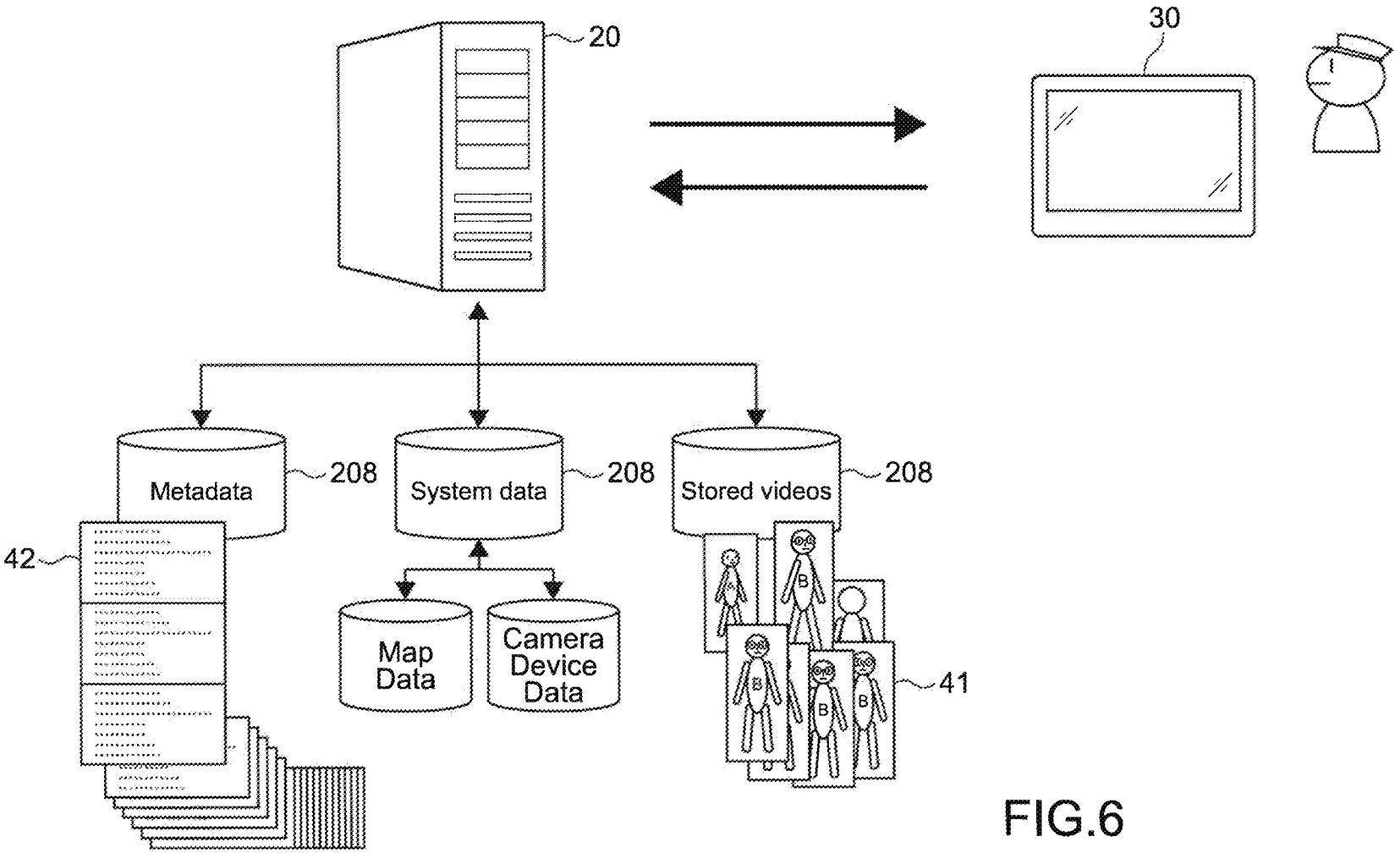
FIG. 6 is a schematic diagram showing the outline of the surveillance camera system according to an embodiment of the present disclosure.

FIG. 6 is a schematic diagram showing the outline of the surveillance camera system 100 according to an embodiment. As shown in FIG. 6, the person tracking metadata 42, the thumbnail image 41, system data for achieving an embodiment of the present disclosure, and the like, which are stored in the storage unit 208, are read out as appropriate. The system data includes map information to be described later and information on the cameras 10, for example. Those pieces of data are used to provide a service relating to an embodiment of the present disclosure by the server apparatus 20 according to a predetermined instruction from the client apparatus 30. In such a manner, interactive processing is allowed between the server apparatus 20 and the client apparatus 30.

Note that the person detection processing may be executed as preprocessing when the cameras 10 transmit the moving image data 11. Specifically, irrespective of use of the services or applications relating to an embodiment of the present disclosure by the client apparatus 30, the generation of the thumbnail image 41, the generation of the person tracking metadata 42, and the like may be preliminarily executed by the blocks surrounded by a broken line 3 of FIG. 3.

(Operation of Surveillance Camera System)

Figure 7:
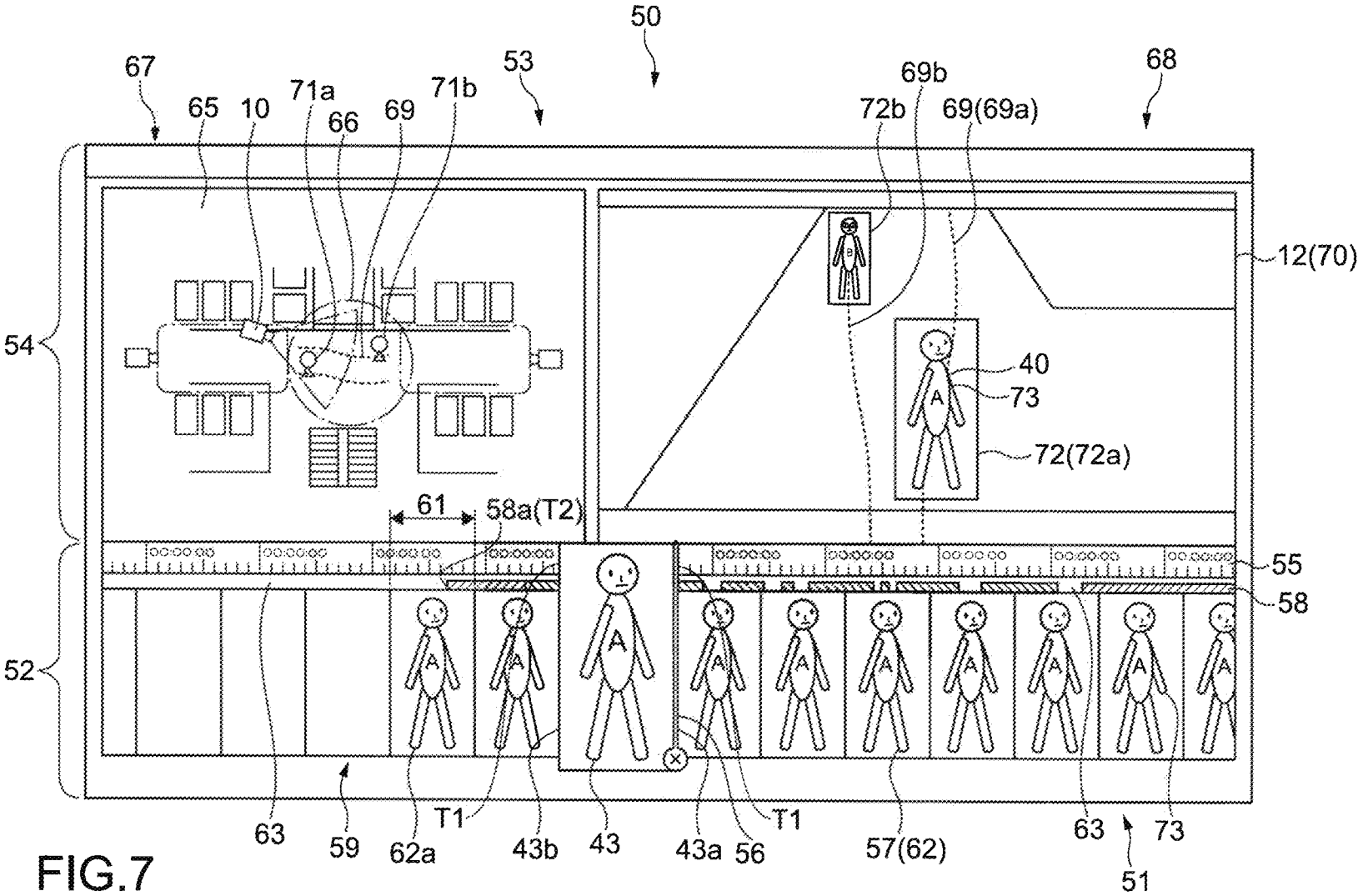
FIG. 7 is a schematic diagram showing an example of a UI (user interface) screen generated by a server apparatus according to an embodiment of the present disclosure.

FIG. 7 is a schematic diagram showing an example of a UI (user interface) screen generated by the server apparatus 20 according to an embodiment. The user can operate a UI screen 50 displayed on the display unit of the client apparatus 30 to check videos of the cameras (frame images 12), records of an alarm, and a moving path of the specified person 40 and to execute correction processing of the analysis results, for example.

The UI screen 50 in an embodiment is constituted of a first display area 52 and a second display area 54. A rolled film image 51 is displayed in the first display area 52, and object information 53 is displayed in the second display area 54. As shown in FIG. 7, the lower half of the UI screen 50 is the first display area 52, and the upper half of the UI screen 50 is the second display area 54. The first display area 52 is smaller in size (height) than the second display area 54 in the vertical direction of the UI screen 50. The position and the size of the first and second display areas 52 and 54 are not limited.

The rolled film image 51 is constituted of a time axis 55, a pointer 56 indicating a predetermined position on the time axis 55, identical thumbnail images 57 arranged along the time axis 55, and a tracking status bar 58 (hereinafter, referred to as status bar 58) to be described later. The pointer 56 is used as a time indicator. The identical thumbnail image 57 corresponds to the identical object image.

In an embodiment, a reference thumbnail image 43 serving as a reference object image is selected from one or more thumbnail images 41 detected from the frame images 12. In an embodiment, a thumbnail image 41 generated from the frame image 12 in which a person A is imaged at a predetermined image capture time is selected as a reference thumbnail image 43. For example, based on the reason why the person A enters an off-limits area at that time and is thus determined to be a suspicious person, the reference thumbnail image 43 is selected. The conditions and the like on which the reference thumbnail image 43 is selected is not limited.

When the reference thumbnail image 43 is selected, the tracking ID of the reference thumbnail image 43 is referred to, and one or more thumbnail images 41 having the same tracking ID are selected to be identical thumbnail images 57. The one or more identical thumbnail images 57 are arranged along the time axis 55 based on the image capture time of the reference thumbnail image 43 (hereinafter, referred to as a reference time). As shown in FIG. 7, the reference thumbnail image 43 is set to be larger in size than the other identical thumbnail images 57. The reference thumbnail image 43 and the one or more identical thumbnail images 57 constitute the rolled film portion 59. Note that the reference thumbnail image 43 is included in the identical thumbnail images 57.

In FIG. 7, the pointer 56 is arranged at a position corresponding to a reference time T1 on the time axis 55. This shows a basic initial status when the UI screen 50 is constituted with reference to the reference thumbnail image 43. On the right side of the reference time T1 indicated by the pointer 56, the identical thumbnail images 57 that have been captured later than the reference time T1 are arranged. On the left side of the reference time T1, the identical thumbnail images 57 that have been captured earlier than the reference time T1 are arranged.

In an embodiment, the identical thumbnail images 57 are arranged in respective predetermined ranges 61 on the time axis 55 with reference to the reference time T1. The range 61 represents a time length and corresponds to a standard, i.e., a scale, of the rolled film portion 59. The standard of the rolled film portion 59 is not limited and can be appropriately set to be 1 second, 5 seconds, 10 seconds, 30 minutes, 1 hour, and the like. For example, assuming that the standard of the rolled film portion 59 is 10 seconds, the predetermined ranges 61 are set at intervals of 10 seconds on the right side of the reference time T1 shown in FIG. 7. From the identical thumbnail images 57 of the person A, which are imaged during the 10 seconds, a display thumbnail image 62 to be displayed as a rolled film image 51 is selected and arranged.

The reference thumbnail image 43 is an image captured at the reference time T1. The same reference time T1 is set at the right end 43*a* and a left end 43*b* of the reference thumbnail image 43. For a time later than the reference time T1, the identical thumbnail images 57 are arranged with reference to the right end 43*a* of the reference thumbnail image 43. On the other hand, for a time earlier than the reference time T1, the identical thumbnail images 57 are arranged with reference to the left end 43*b* of the reference thumbnail image 43. Consequently, the state where the pointer 56 is positioned at the left end 43*b* of the reference thumbnail image 43 may be displayed as the UI screen 50 showing the basic initial status.

The method of selecting the display thumbnail image 62 from the identical thumbnail images 57, which have been captured within the time indicated by the predetermined range 61, is not limited. For example, an image captured at the earliest time, i.e., a past image, among the identical thumbnail images 57 within the predetermined range 61 may be selected as the display thumbnail image 62. Conversely, an image captured at the latest time, i.e., a future image, may be selected as the display thumbnail image 62. Alternatively, an image captured at a middle point of time within the predetermined range 61 or an image captured at the closest time to the middle point of time may be selected as the display thumbnail image 62.

The tracking status bar 58 shown in FIG. 7 is displayed along the time axis 55 between the time axis 55 and the identical thumbnail images 57. The tracking status bar 58 indicates the time in which the tracking of the person A is executed. Specifically, the tracking status bar 58 indicates the time in which the identical thumbnail images 57 exist. For example, when the person A is located behind a pole or the like or overlaps with another person in the frame image 12, the person A is not detected as an object. In such a case, the thumbnail image 41 of the person A is not generated. Such a time is a time during which the tracking is not executed and corresponds to a portion 63 in which the tracking status bar 58 interrupts or to a portion 63 in which the tracking status bar 58 is not provided as shown in FIG. 7.

Further, the tracking status bar 58 is displayed in different color for each of the cameras 10 that capture the image of the person A. Consequently, in order to grasp with which camera 10 the frame image 12 of the source to generate the identical thumbnail image 57 is captured, the display with color is performed as appropriate. The camera 10, which captures the image of the person A, i.e., the camera 10, which tracks the person A, is determined based on the person tracking metadata 42 shown in FIG. 4. Based on the determined results, the tracking status bar 58 is displayed in a color set for each of the cameras 10.

In map information 65 of the UI screen 50 shown in FIG. 7, the three cameras 10 and imaging ranges 66 of the respective cameras 10 are shown. For example, predetermined colors are given to the cameras 10 and the imaging ranges 66. To correspond to those above-mentioned colors, a color is given to the tracking status bar 58. This allows the person A to be easily and intuitively observed.

As described above, for example, it is assumed that an image captured at the earliest time within the predetermined range 61 is selected as the display thumbnail image 62. In this case, a display thumbnail image 62*a* located at the leftmost position in FIG. 7 is an identical thumbnail image 57, which is captured at a time T2 at a left end 58*a* of the tracking status bar 58 shown above the display thumbnail image 62*a*. In FIG. 7, no identical thumbnail images 57 are arranged on the left side of this display thumbnail image 62. This means that no identical thumbnail images 57 are generated before the time T2 at which the display thumbnail image 62*a* is captured. In other words, the tracking of the person A is not executed in that time. In the range where the identical thumbnail images 57 are not displayed, images, texts, and the like indicating that the tracking is not executed may be displayed. For example, an image having the shape of a person with a gray color may be displayed as an image where no person is displayed.

The second display area 54 shown in FIG. 7 is divided into a left display area 67 and a right display area 68. In the left display area 67, the map information 65 that is output as the object information 53 is displayed. In the right display area 68, the frame image 12 output as the object information 53 and a movement image 69 are displayed. Those images are output to be information associated with the identical thumbnail image 57 that is selected in accordance with the predetermined position indicated by the pointer 56 on the time axis 55. Consequently, the map information 65, which indicates the position of the person A included in the identical thumbnail image 57 captured at the time indicated by the pointer 56, is displayed. Further, the frame image 12 including the identical thumbnail image 57 captured at the time indicated by the pointer 56, and the movement image 69 of the person A are displayed. In an embodiment, traffic lines serving as the movement image 69 are displayed, but images to be displayed as the movement image 69 are not limited.

The identical thumbnail image 57 corresponding to the predetermined position on the time axis 55 indicated by the pointer 56 is not limited to the identical thumbnail image 57 captured at that time. For example, information on the identical thumbnail image 57 that is selected as the display thumbnail image 62 may be displayed in the range 61 (standard of the rolled film portion 59) including the time indicated by the pointer 56. Alternatively, a different identical thumbnail image 57 may be selected.

The map information 65 is preliminarily stored as the system data shown in FIG. 6. In the map information 65, an icon 71*a* indicating the person A that is detected as an object is displayed based on the person tracking metadata 42. In the UI screen 50 shown in FIG. 7, a position of the person A at the time T1 at which the reference thumbnail image 43 is captured is displayed. Further, in the frame image 12 including the reference thumbnail image 43, a person B is detected as another object. Consequently, an icon 71*b* indicating the person B is also displayed in the map information 65. Further, the movement images 69 of the person A and the person B are also displayed in the map information 65.

In the frame image 12 that is output as the object information 53 (hereinafter, referred to as play view image 70), an emphasis image 72, which is an image of the detected object shown with emphasis, is displayed. In an embodiment, the frames surrounding the detected person A and person B are displayed to serve as an emphasis image 72*a* and an emphasis image 72*b*, respectively. Each of the frames corresponds to an outer edge of the generated thumbnail image 41. Note that for example, an arrow may be displayed on the person 40 to serve as the emphasis image 72. Any other image may be used as the emphasis image 72.

Further, in an embodiment, an image to distinguish an object shown in the rolled film image 51 from a plurality of objects in the play view image 70 is also displayed. Hereinafter, an object displayed in the rolled film image 51 is referred to as a target object 73. In the example shown in FIG. 7 and the like, the person A is the target object 73.

In an embodiment, an image of the target object 73, which is included in the plurality of objects in the play view image 70, is displayed. With this, it is possible to grasp where the target object 73 displayed in the one or more identical thumbnail images 57 is in the play view image 70. As a result, an intuitive observation is allowed. In an embodiment, a predetermined color is given to the emphasis image 72 described above. For example, a striking color such as red is given to the emphasis image 72*a* that surrounds the person A displayed as the rolled film image 51. On the other hand, another color such as green is given to the emphasis image 72*b* that surrounds the person B serving as another object. In such a manner, the objects are distinguished from each other. The target object 73 may be distinguished by using another methods and images.

The movement images 69 may also be displayed with different colors in accordance with the colors of the emphasis images 72. Specifically, the movement image 69*a* expressing the movement of the person A may be displayed in red, and the movement image 69*b* expressing the movement of the person B may be displayed in green. This allows the movement of the person A serving as the target object 73 to be sufficiently observed.

Figure 8:
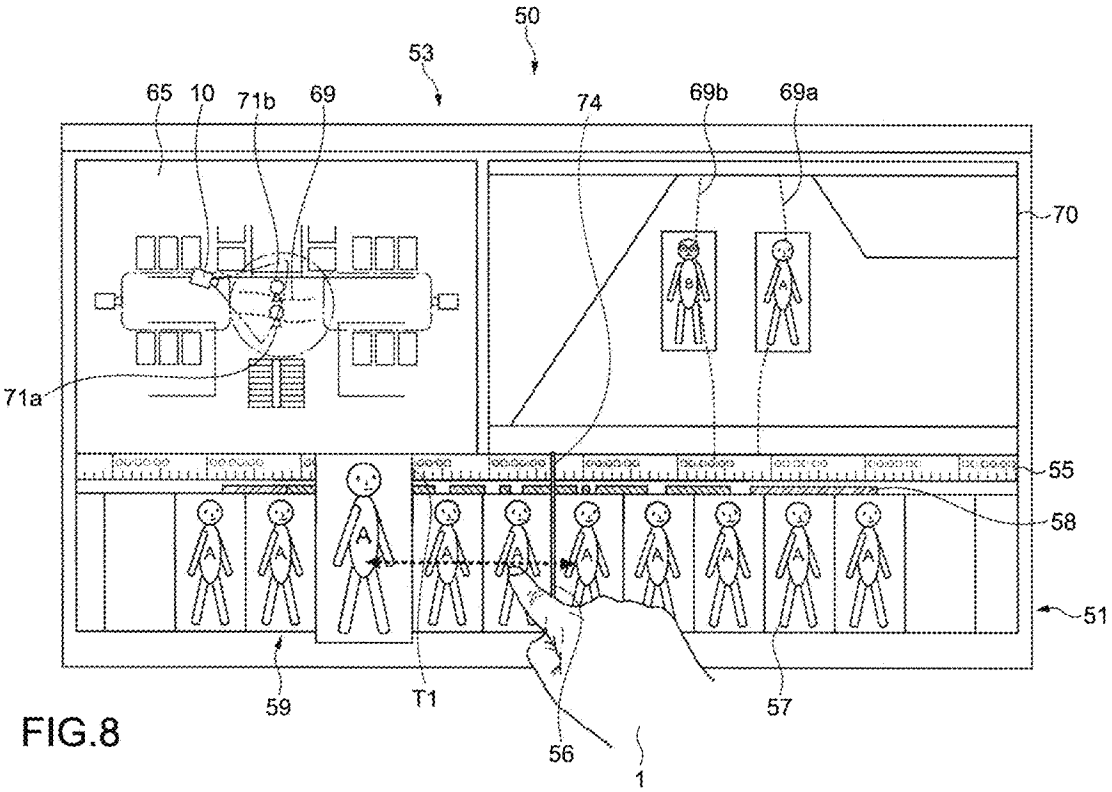
FIG. 8 is a diagram showing an example of a user operation on the UI screen and processing corresponding to the operation.
Figure 9:
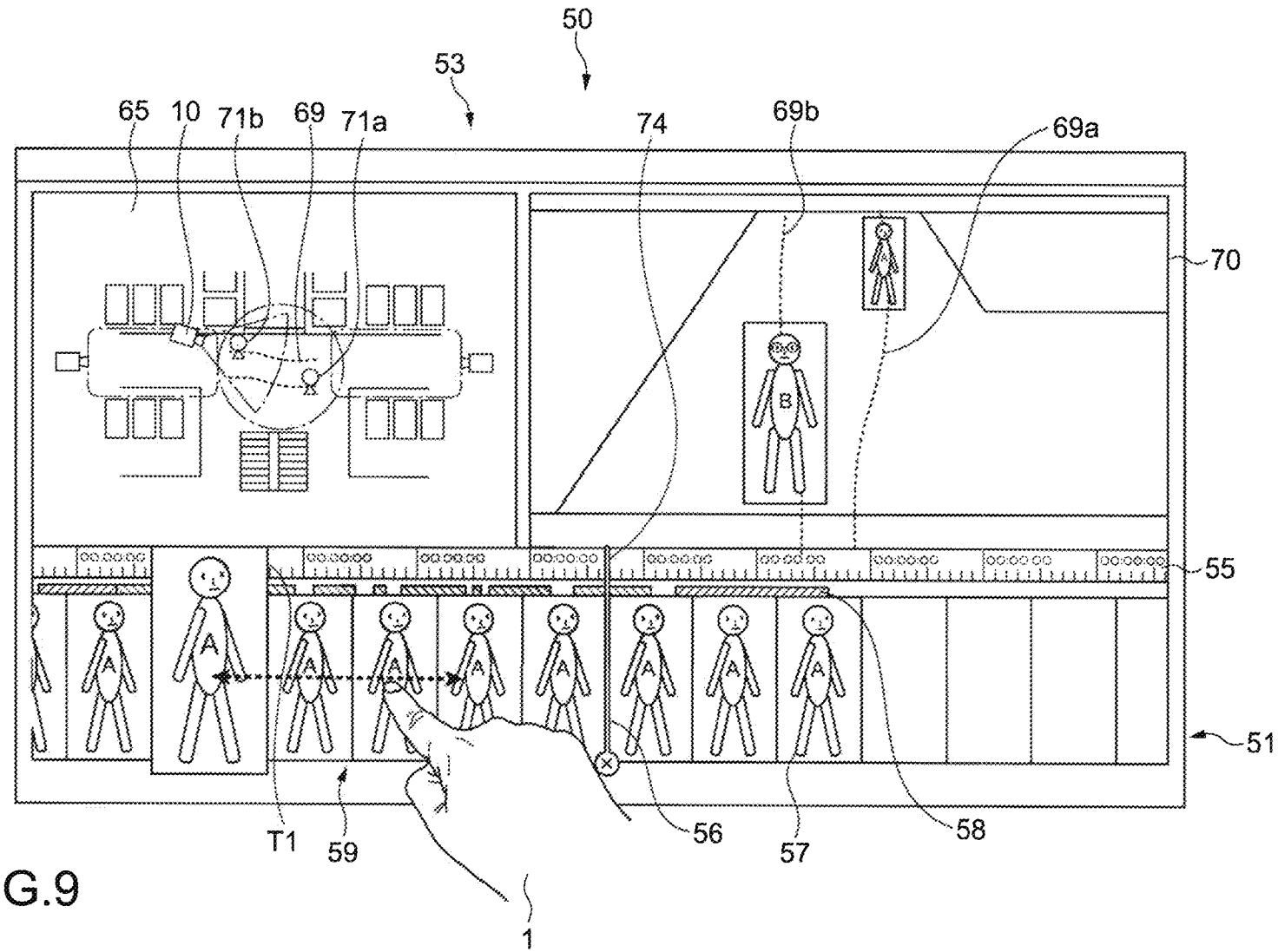
FIG. 9 is a diagram showing an example of a user operation on the UI screen and processing corresponding to the operation.

FIGS. 8 and 9 are diagrams each showing an example of an operation of a user 1 on the UI screen 50 and processing corresponding to the operation. As shown in FIGS. 8 and 9, the user 1 inputs an operation on the screen that also functions as a touch panel. The operation is input, as an instruction from the user 1, into the server apparatus 20 via the client apparatus 30.

In an embodiment, an instruction to the one or more identical thumbnail images 57 is input, and according to the instruction, a predetermined position on the time axis 55 indicated by the pointer 56 is changed. Specifically, a drag operation is input in a horizontal direction (y-axis direction) to the rolled film portion 59 of the rolled film image 51. This moves the identical thumbnail image 57 in the horizontal direction and along with the movement, a time indicating image, i.e., graduations, within the time axis 55 is also moved. The position of the pointer 56 is fixed, and thus a position 74 that the pointer 56 points on the time axis 55 (hereinafter, referred to as point position 74) is relatively changed. Note that the point position 74 may be changed when a drag operation is input to the pointer 56. In addition, for example, operations for changing the point position 74 are not limited.

In conjunction with the change of the point position 74, the selection of the identical thumbnail image 57 and the output of the object information 53 that correspond to the point position 74 are changed. For example, as shown in FIGS. 8 and 9, it is assumed that the identical thumbnail images 57 are moved in the left direction. With this, the pointer 56 is relatively moved in the right direction, and the point position 74 is changed to a time later than the reference time T1. In conjunction with this, map information 65 and a play view image 70 that relate to an identical thumbnail image 57 captured later than the reference time T1 are displayed. In other words, in the map information 65, the icon 71*a* of the person A is moved in the right direction and the icon 71*b* of the person B is moved in the left direction along the movement images 69. In the play view image 70, the person A is moved to the deep side along with the movement image 69*a*, and the person B is moved to the near side along with the movement image 69*b*. Such images are sequentially displayed. This allows the movement of the object along the time axis 55 to be grasped and observed in detail. Further, this allows an operation of selecting an image, with which the object information 53 such as the play view image 70 is displayed, from the one or more identical thumbnail images 57.

Note that in the examples shown in FIGS. 8 and 9, the identical thumbnail images 57 that are generated from the frame images 12 captured with one camera 10 are arranged. Consequently, the tracking status bar 58 should be given with only one color corresponding to that camera 10. In FIGS. 7 to 9, however, in order to explain that the tracking status bar 58 is displayed in different color for each of the cameras 10, different types of tracking status bars 58 are illustrated. Additionally, as a result of the movement of the rolled film portion 59 in the left direction, new identical thumbnail images 57 are not displayed on the right side. In the case where the identical thumbnail images 57 captured at that time exist, however, those images are arranged as appropriate.

Figure 10:
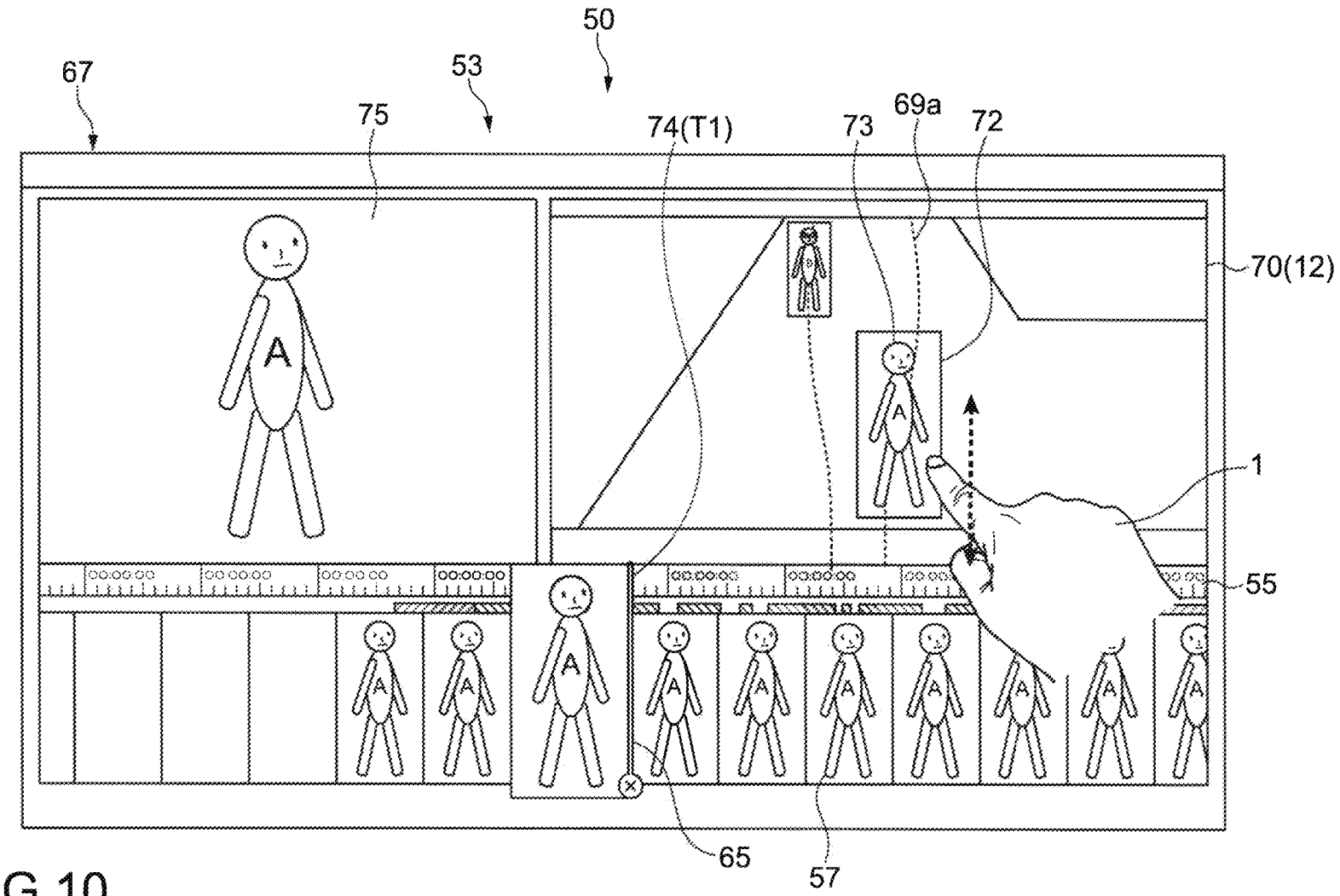
FIG. 10 is a diagram showing another example of an operation to change a point position.
Figure 11:
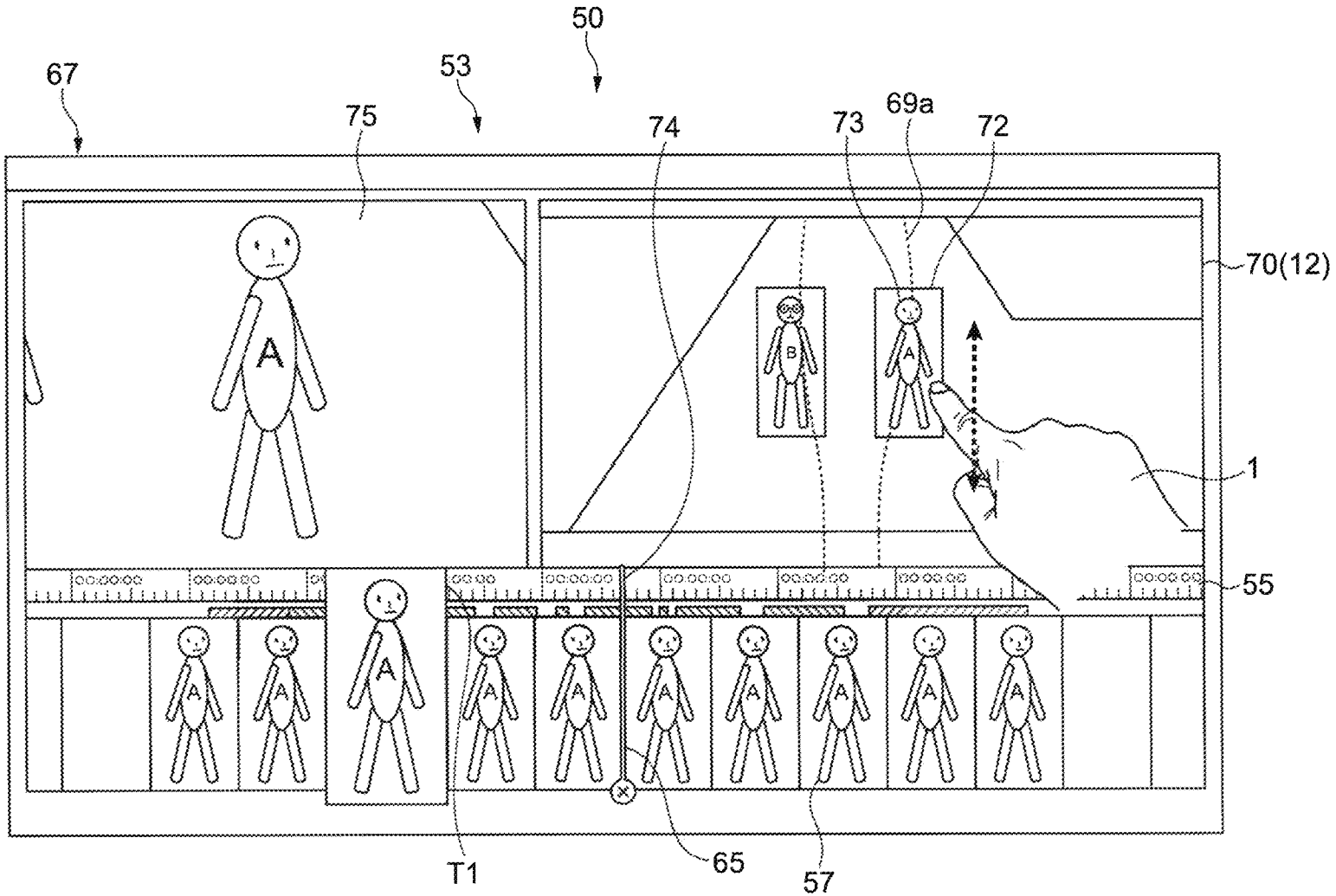
FIG. 11 is a diagram showing the example of the operation to change the point position.
Figure 12:
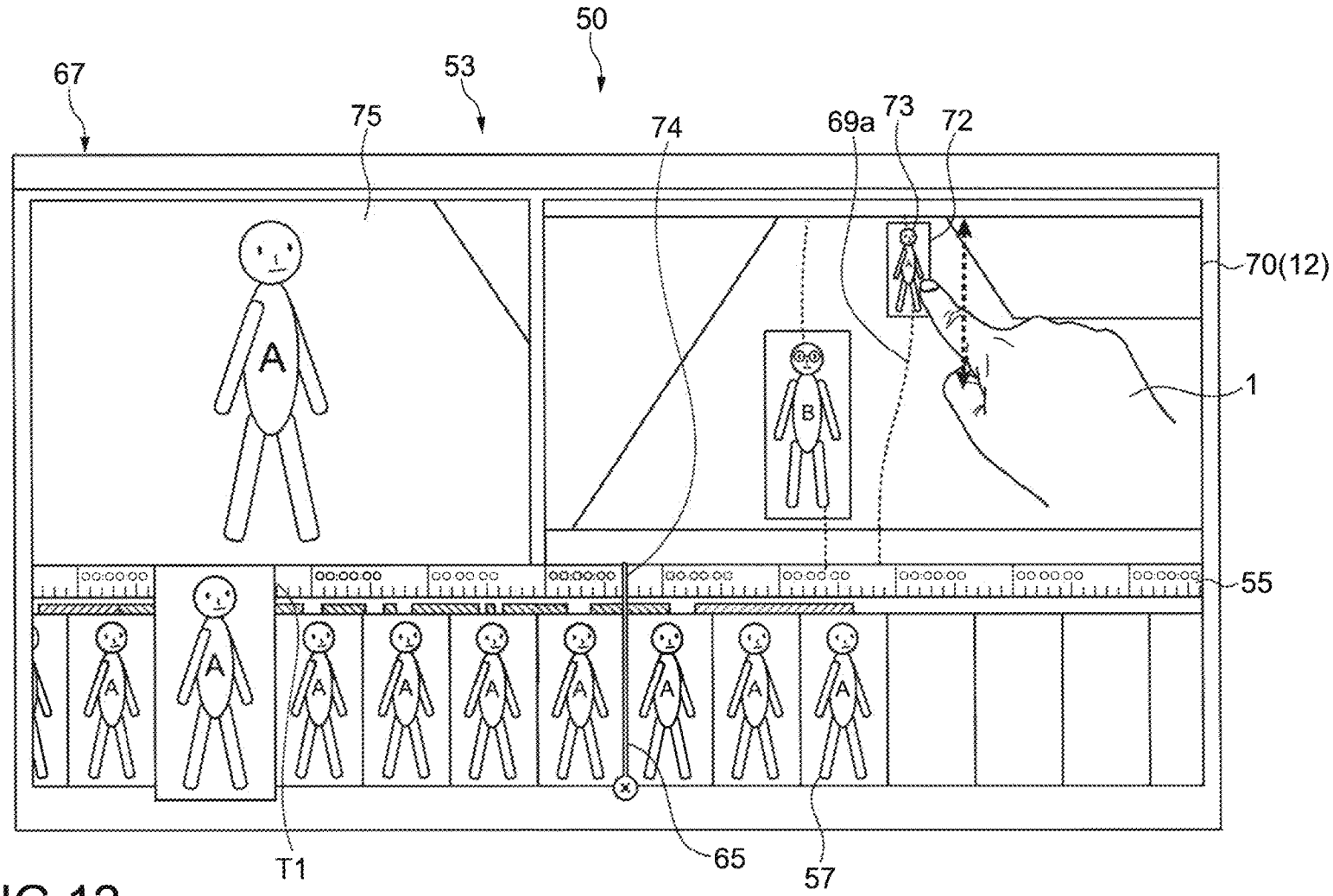
FIG. 12 is a diagram showing the example of the operation to change the point position.

FIGS. 10 to 12 are diagrams each showing another example of the operation to change the point position 74. As shown in FIGS. 10 to 12, the position 74 indicated by the pointer 56 may be changed according to an instruction input to the output object information 53.

In an embodiment, the person A that is the target object 73 is selected as an object on the play view image 70 of the UI screen 50. For example, a finger may be placed on the person A or on the emphasis image 72. Typically, a touch or the like on a position within the emphasis image 72 allows an instruction to select the person A to be input. When the person A is selected, the information displayed in the left display area 67 is changed from the map information 65 to enlarged display information 75. The enlarged display information 75 may be generated from the frame image 12 displayed as the play view image 70. The enlarged display information 75 is also included in the object information 53 associated with the identical thumbnail image 57. The display of the enlarged display information 75 allows the object selected by the user 1 to be observed in detail.

As shown in FIGS. 10 to 12, in the state where the person A is selected, a drag operation is input along the movement image 69*a*. A frame image 12 corresponding to a position on the movement image 69*a* is displayed as the play view image 70. The frame image 12 corresponding to a position on the movement image 69*a* refers to a frame image 12 in which the person A is displayed at the above-mentioned position or in which the person A is displayed at a position closest to the above-mentioned position. For example, as shown in FIGS. 10 to 12, the person A is moved to the deep side along the movement image 69*a*. In conjunction with this movement, the point position 74 is moved to the right direction that is a time later than the reference time T1. Specifically, the identical thumbnail images 57 are moved in the left direction. In conjunction with the movement, the enlarged display information 75 is also changed.

When the play view image 70 is changed, in conjunction with the change, the pointer 56 is moved to the position corresponding to the image capture time of the frame image 12 displayed as the play view image 70. This allows the point position 74 to be changed. This corresponds to the fact that the time at the point position 74 and the image capture time of the play view image 70 are associated with each other and when one of them is changed, the other one is also changed in conjunction with the former change.

Figure 13:
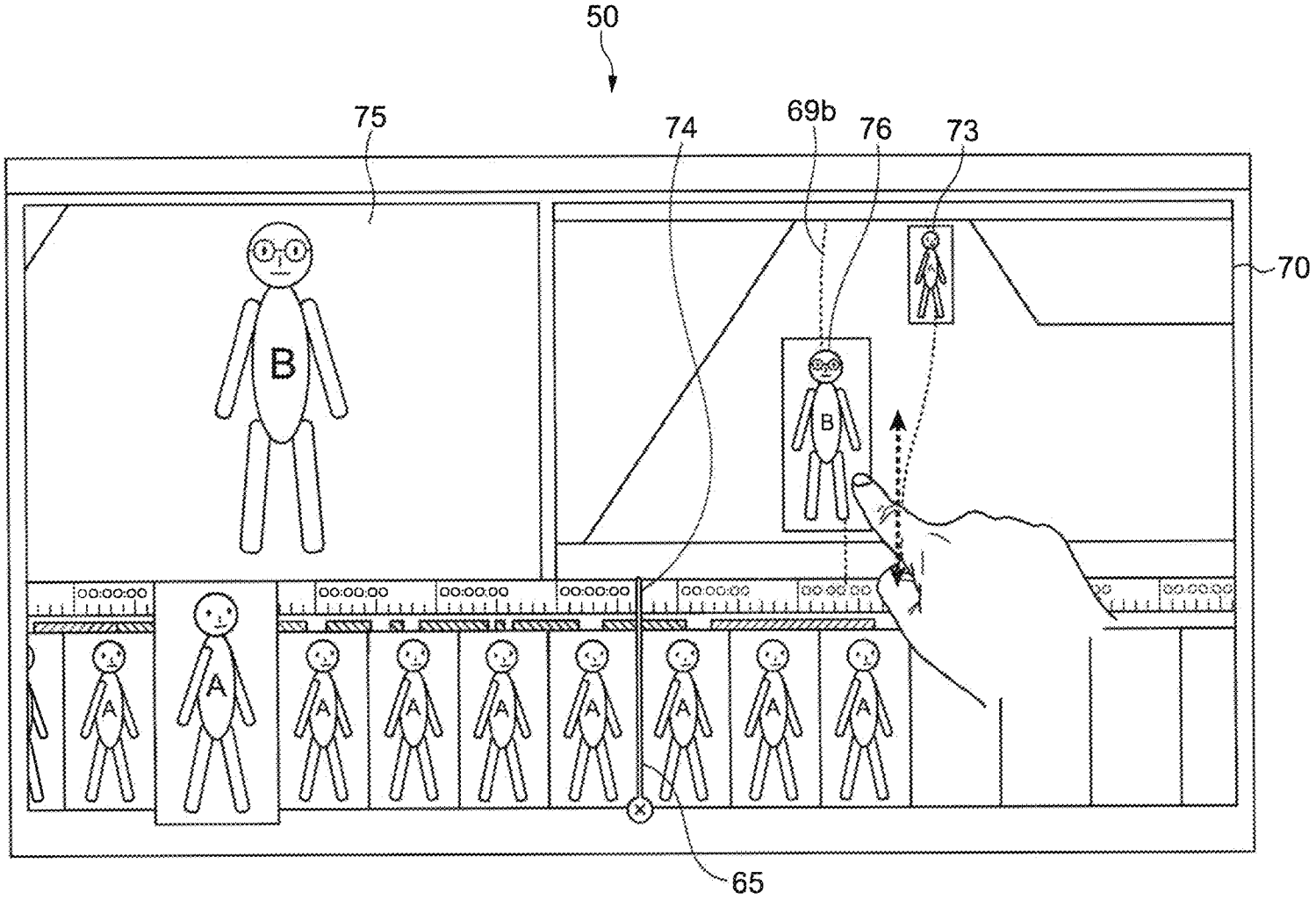
FIG. 13 is a diagram showing another example of the operation to change the point position.
Figure 14:
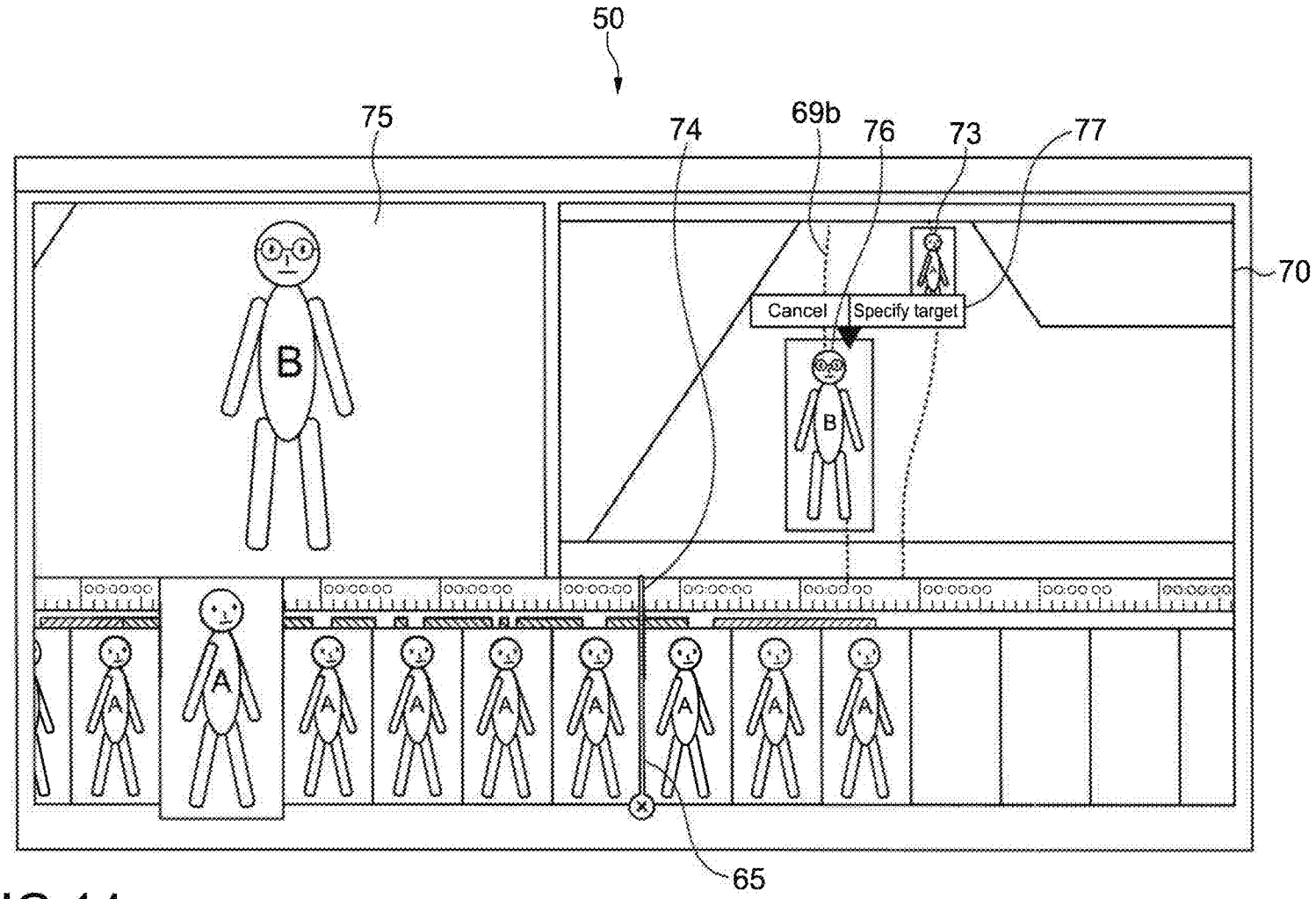
FIG. 14 is a diagram showing the example of the operation to change the point position.
Figure 15:
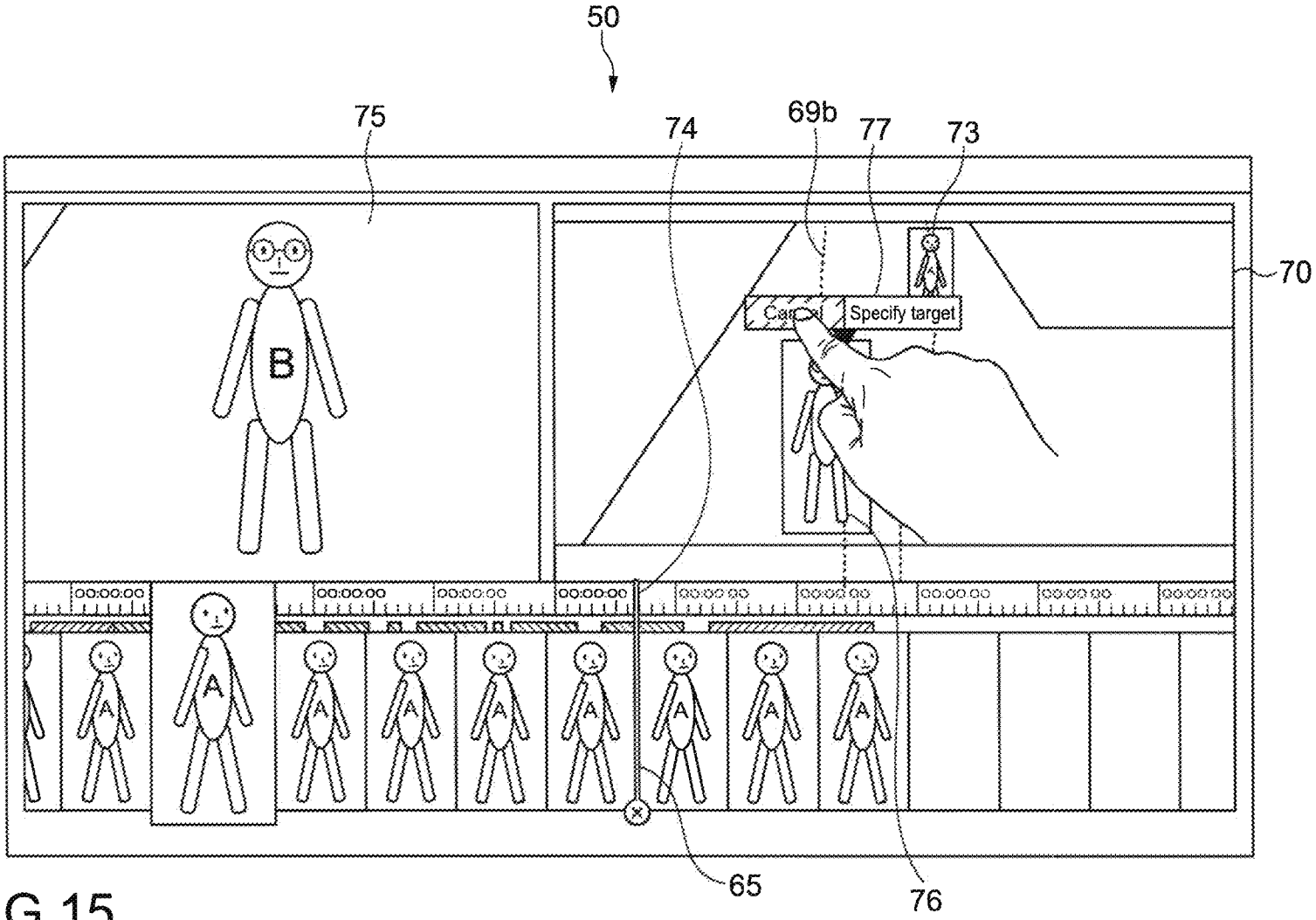
FIG. 15 is a diagram showing the example of the operation to change the point position.

FIGS. 13 to 15 are diagrams each showing another example of the operation to change the point position 74. As shown in FIG. 13, another object 76 that is different from the target object 73 displayed in the play view image 70 is operated so that the point position 74 can be changed. As shown in FIG. 13, the person B that is the other object 76 is selected and enlarged display information 75 of the person B is displayed. When a drag operation is input along the movement image 69*b*, the point position 74 of the pointer 56 is changed in accordance with the drag operation. In such a manner, an operation for the other object 76 may be performed. Consequently, the movement of the other object 76 can be observed.

As shown in FIG. 14, when the finger is separated from the person B that is the other object 76, a pop-up 77 for specifying the target object 73 is displayed. The pop-up 77 is used to correct or change the target object 73, for example. As shown in FIG. 15, in this case, "Cancel" is selected so that the target object 73 is not changed. Subsequently, the pop-up 77 is deleted. The pop-up 77 will be described later together with the correction of the target object 73.

Figure 16:
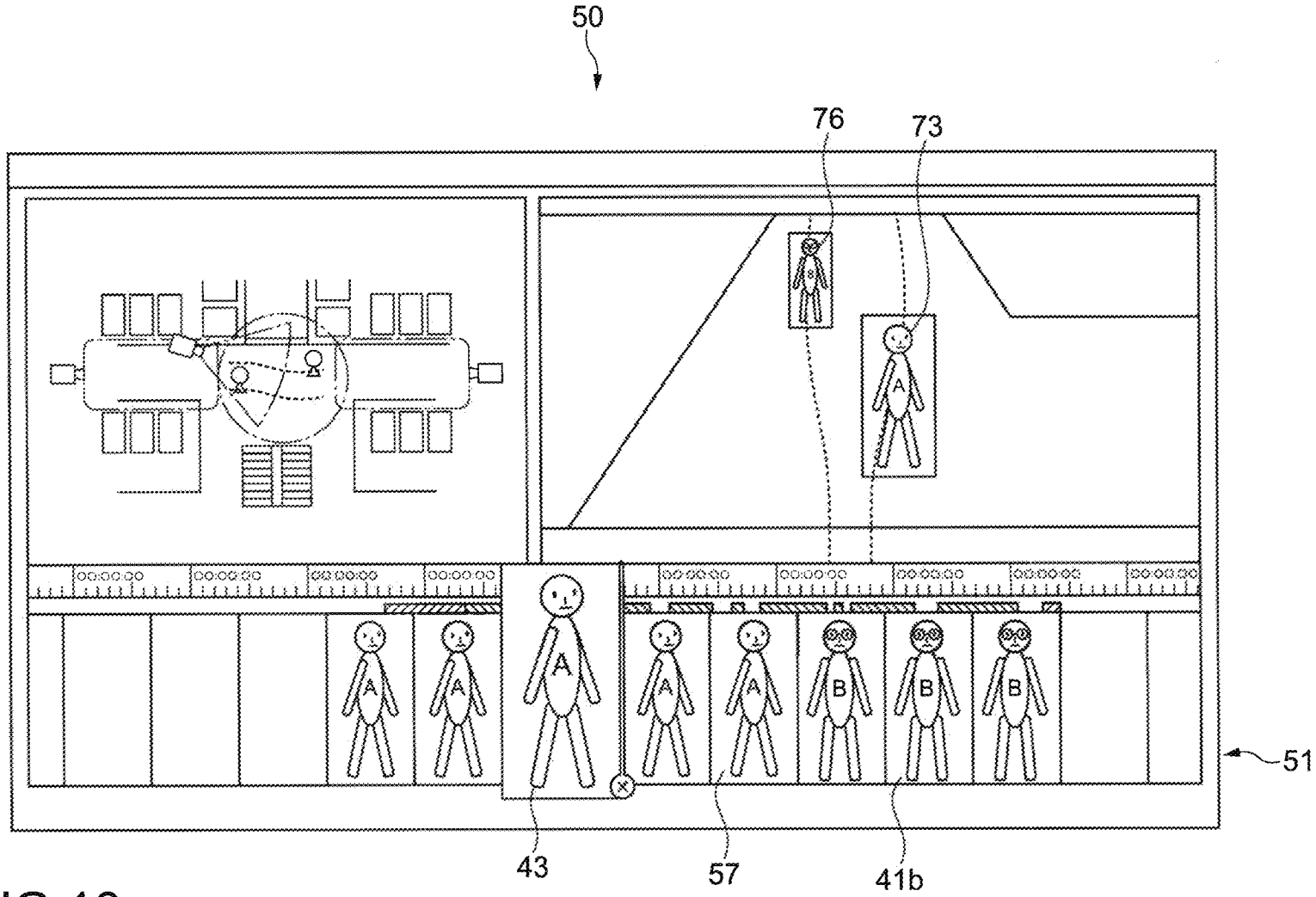
FIG. 16 is a diagram for describing a correction of one or more identical thumbnail images.

FIGS. 16 to 19 are diagrams for describing a correction of the one or more identical thumbnail images 57 arranged as the rolled film image 51. As shown in FIG. 16, when the reference thumbnail image 43 in which the person A is imaged is selected, a thumbnail image 41*b* in which the person B different from the person A is imaged may be arranged as the identical thumbnail image 57 in some cases. For example, when an object is detected from the frame image 12, a false detection may occur, and the person B that is the other object 76 may be set to have a tracking ID indicating the person A. For example, such a false detection may occur due to various situations in which those persons resemble in size and shape or in hairstyle, or in which rapidly moving two persons pass away. In such cases, a thumbnail image 41 of an object that is incorrect to serve as a target object 73 is displayed in the rolled film image 51.

In the surveillance camera system 100 according to an embodiment, as will be described later, the correction of the target object 73 can be executed by a simple operation. Specifically, the one or more identical thumbnail images 57 can be corrected according to a predetermined instruction input by an input unit.

Figure 17:
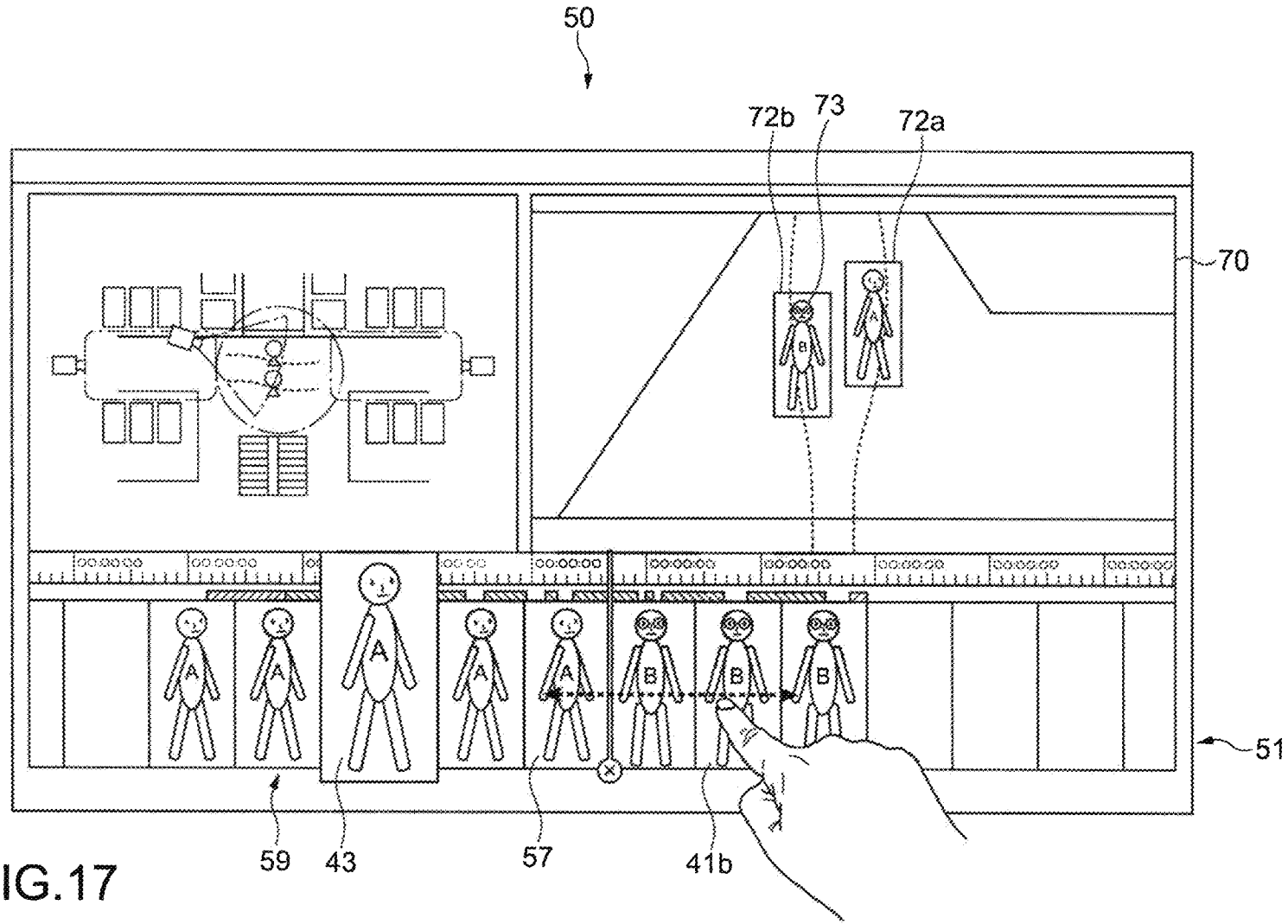
FIG. 17 is a diagram for describing the correction of one or more identical thumbnail images.

As shown in FIG. 17, an image in the state where the target object 73 is incorrectly recognized is searched for in the play view image 70. Specifically, a play view image 70 in which the emphasis image 72*b* of the person B is displayed in red and the emphasis image 72*a* of the person A is displayed in green is searched for. In FIG. 17, the rolled film portion 59 is operated so that a play view image 70 falsely detected is searched for. Alternatively, the search may be executed by an operation on the person A or the person B of the play view image 70.

Figure 18:
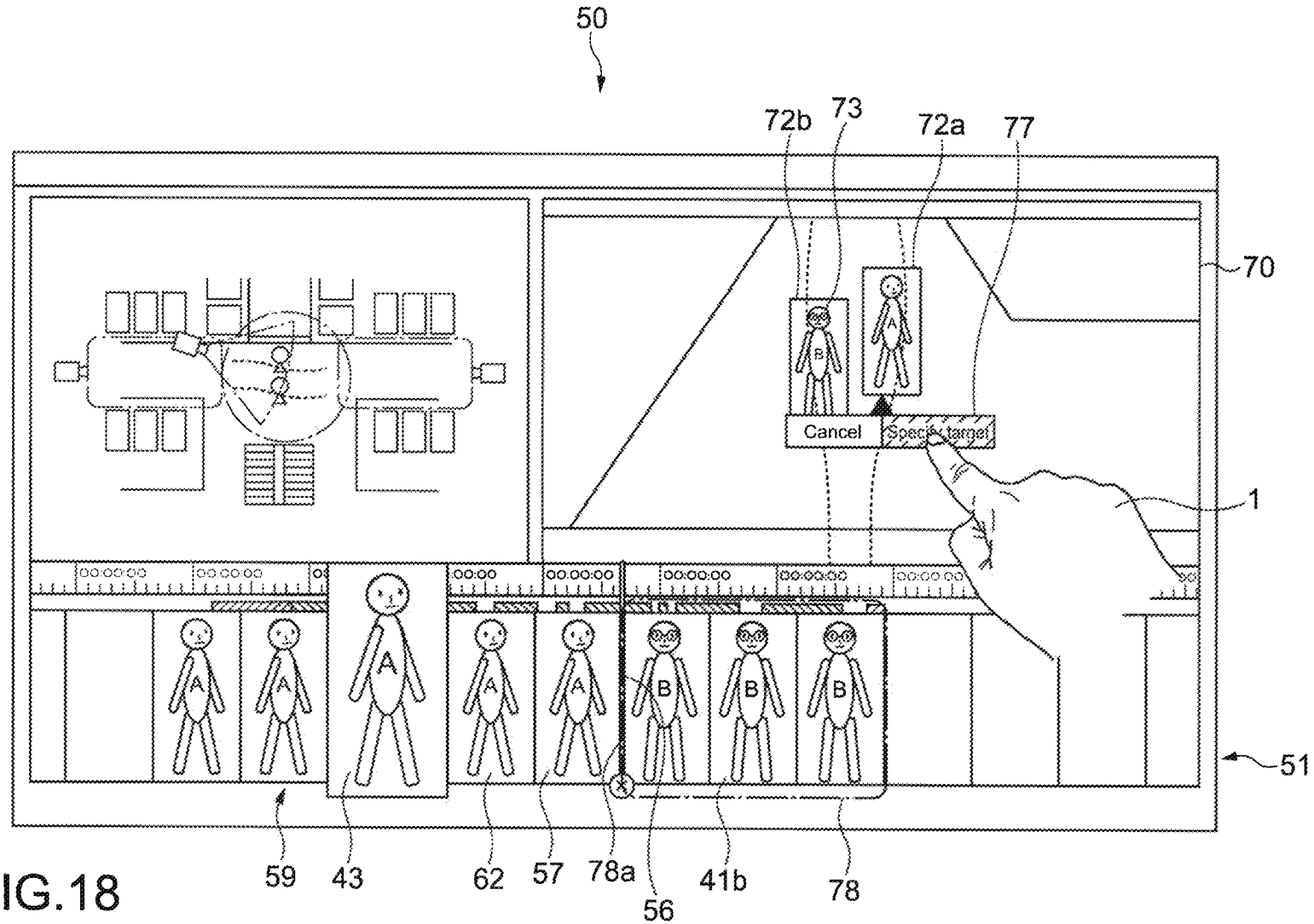
FIG. 18 is a diagram for describing the correction of one or more identical thumbnail images.

As shown in FIG. 18, when the pointer 56 is moved to a left end 78*a* of a range 78 in which the thumbnail images 41*b* of the person B are displayed, a play view image 70 in which the target object 73 is falsely detected is displayed. The user 1 selects the person A whose emphasis image 72*a* is displayed in green, the person A being to be originally detected as the target object 73. Subsequently, the pop-up 77 for specifying the target object 73 is displayed and a target specifying button is pressed.

Figure 19:
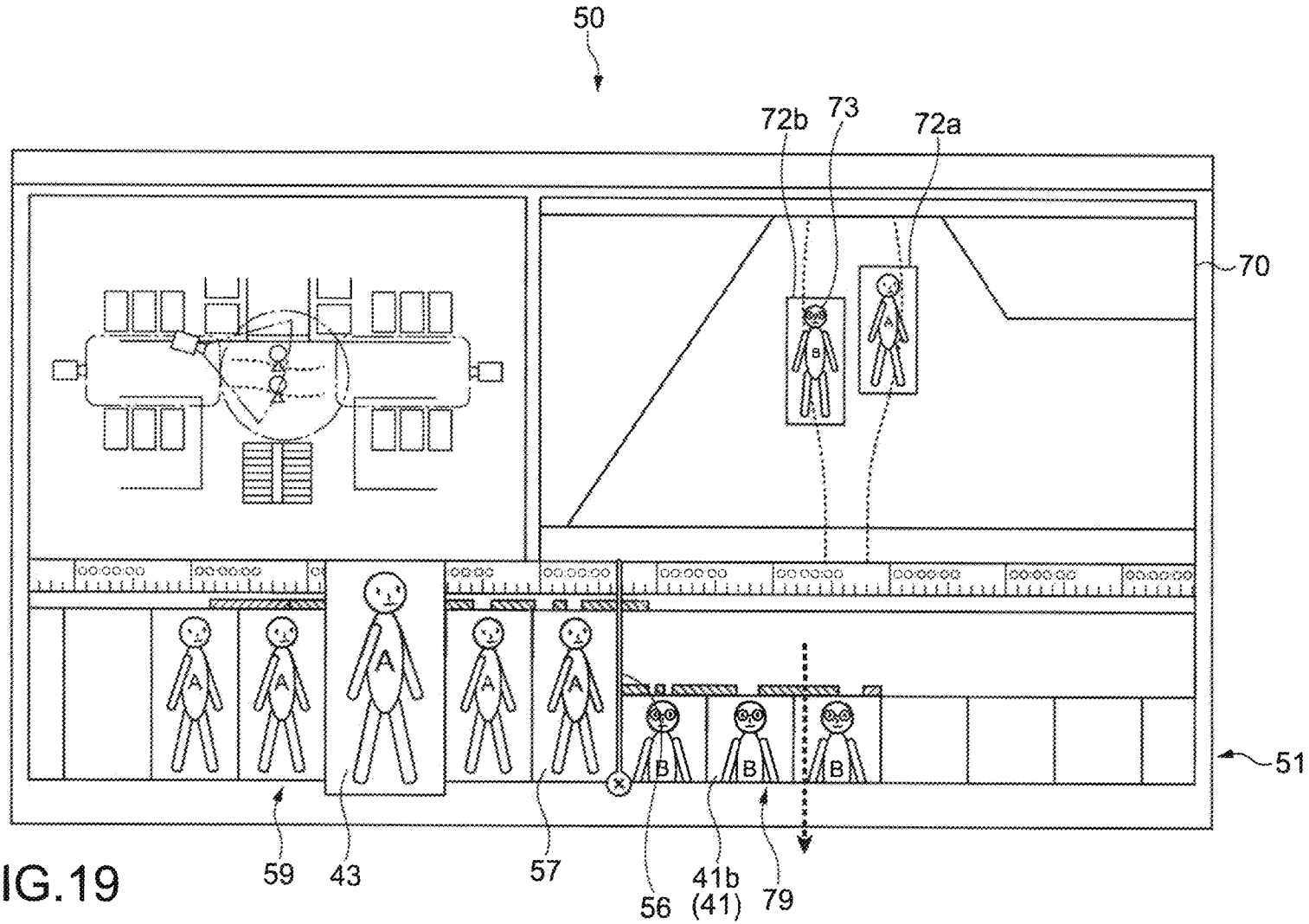
FIG. 19 is a diagram for describing the correction of one or more identical thumbnail images.

As shown in FIG. 19, the thumbnail images 41*b* of the person B, which are arranged on the right side of the pointer 56, are deleted. In this case, all the thumbnail images 41 captured later than the time indicated by the pointer 56, that is, the thumbnail images 41 and the images where no person is displayed, are deleted. In an embodiment, an animation 79 by which the thumbnail images 41 captured later than the time indicated by the pointer 56 gradually disappear to the lower side of the UI screen 50 is displayed, and the thumbnail images 41 are deleted. The UI when the thumbnail images 41 are deleted is not limited, and an animation that is intuitively easy to understand or an animation with high designability may be displayed.

After the thumbnail images 41 on the right side of the pointer 56 are deleted, the thumbnail images 41 of the person A who is specified as the corrected target object 73 is arranged as the identical thumbnail images 57. In the play view image 70, the emphasis image 72*a* of the person A is displayed in red and the emphasis image 72*b* of the person B is displayed in green.

Note that as shown in FIG. 18 and the like, the play view image 70 falsely detected is found when the pointer 56 is at the left end 78*a* of the range 78 in which the thumbnail images 41*b* of the person B are displayed. However, the play view image 70 falsely detected may also be found in the range in which the thumbnail images 41 of the person A are displayed as the display thumbnail images 62. In such a case, the thumbnail images 41*b* of the person B that are captured later than the time at which a relevant display thumbnail image 62 is captured may be deleted, or the thumbnail images 41 on the right side of the pointer 56 may be deleted such that the range of the thumbnail images 41 of the person A is divided. Additionally, the play view image 70 falsely detected may also be found at the halfway of the range in which the thumbnail images 41*b* of the person B are displayed as the display thumbnail images 62. In this case, the deletion of the thumbnail images including the thumbnail images 41*b* of the person B only needs to be executed.

In such a manner, according to the instruction to select the other object 76 included in the play view image 70 that is output as the object information 53, the one or more identical thumbnail images 57 are corrected. This allows a correction to be executed by an intuitive operation.

Figure 20:
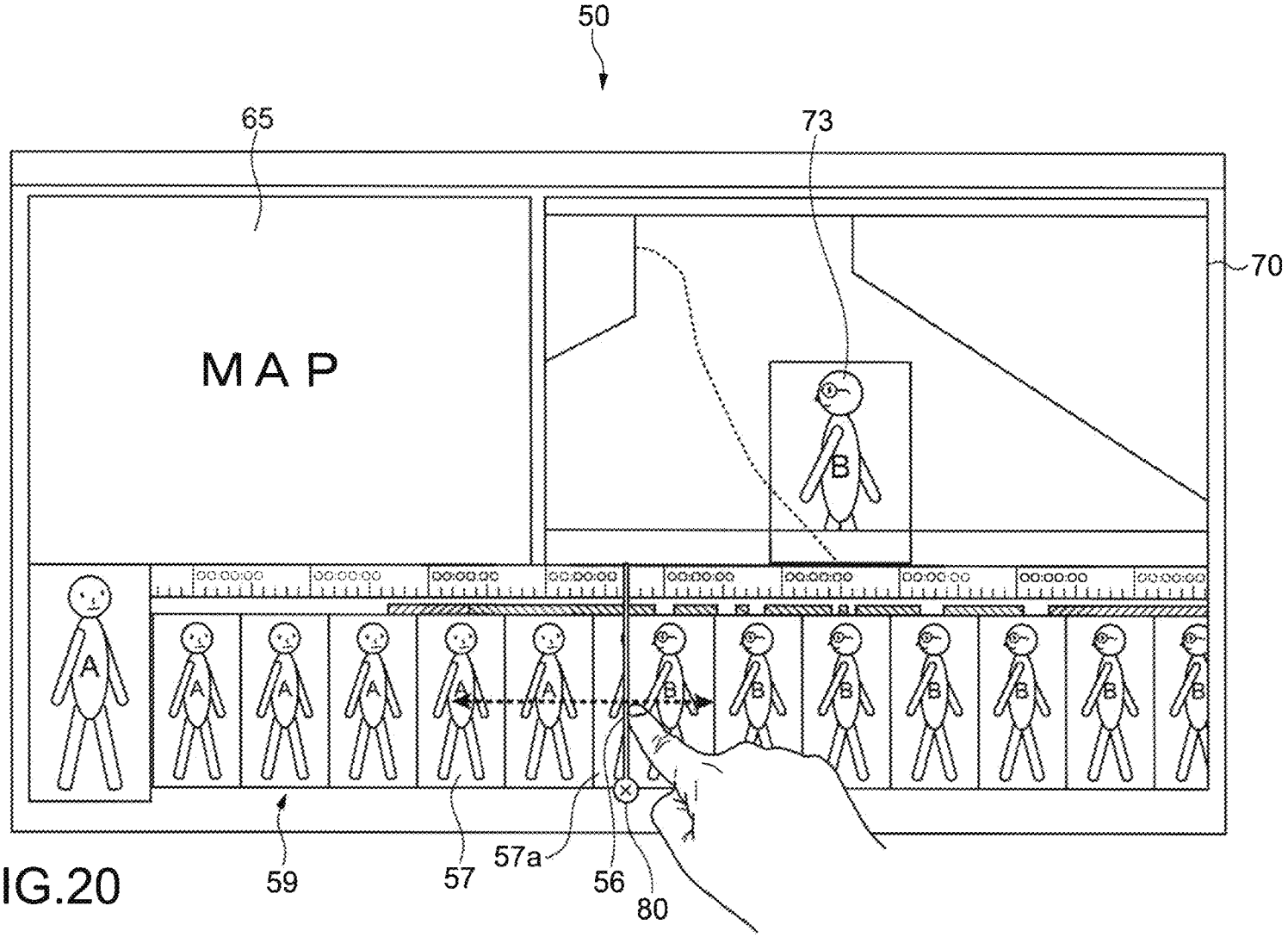
FIG. 20 is a diagram for describing another example of the correction of one or more identical thumbnail images.

FIGS. 20 to 25 are diagrams for describing another example of the correction of the one or more identical thumbnail images 57. In those figures, the map information 65 is not illustrated. Similar to the above description, firstly, the play view image 70 at the time when the person B is falsely detected as the target object 73 is searched for. As a result, as shown in FIG. 20, it is assumed that the person A to be detected as a correct target object 73 does not appear in the play view image 70. For example, the following cases are conceivable: the person B falsely detected is moved away from the person A; and the person B originally situated in another place is detected as the target object 73.

Note that in FIG. 20, the identical thumbnail image 57*a*, which is adjacent to the pointer 56 on its left side, has a smaller size in the horizontal direction than the other thumbnail images 57. For example, in the case where the target object 73 is changed at the halfway of the range 61 (standard of the rolled film portion 59) in which the thumbnail image 57*a* is arranged, the standard of the rolled film portion 59 may be partially changed. In other cases, for example, the standard of the rolled film portion 59 may be partially changed when the target object 73 is correctly detected but the camera 10 with which the target object 73 is captured is changed.

Figure 21:
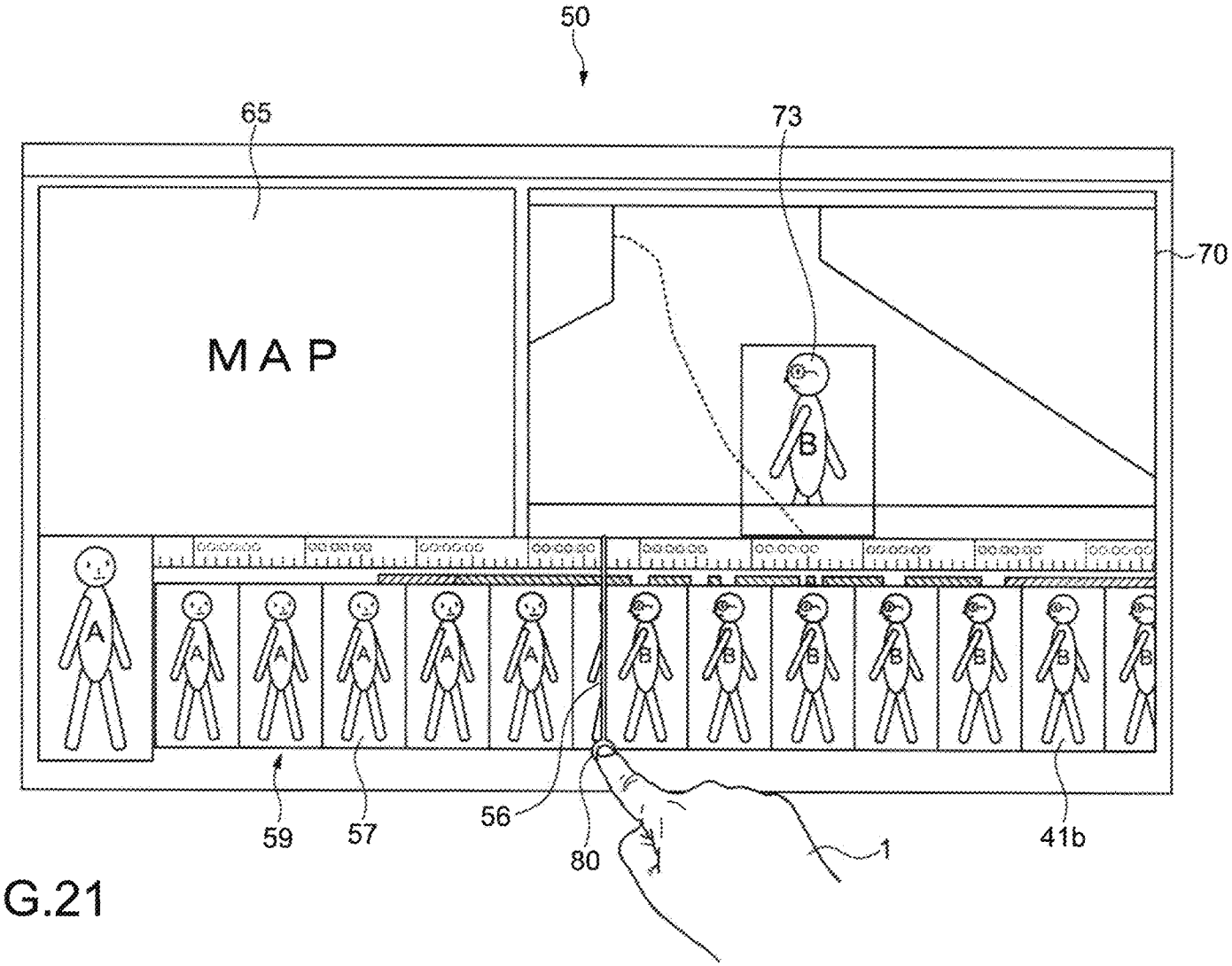
FIG. 21 is a diagram for describing the example of the correction of the one or more identical thumbnail images.
Figure 22:
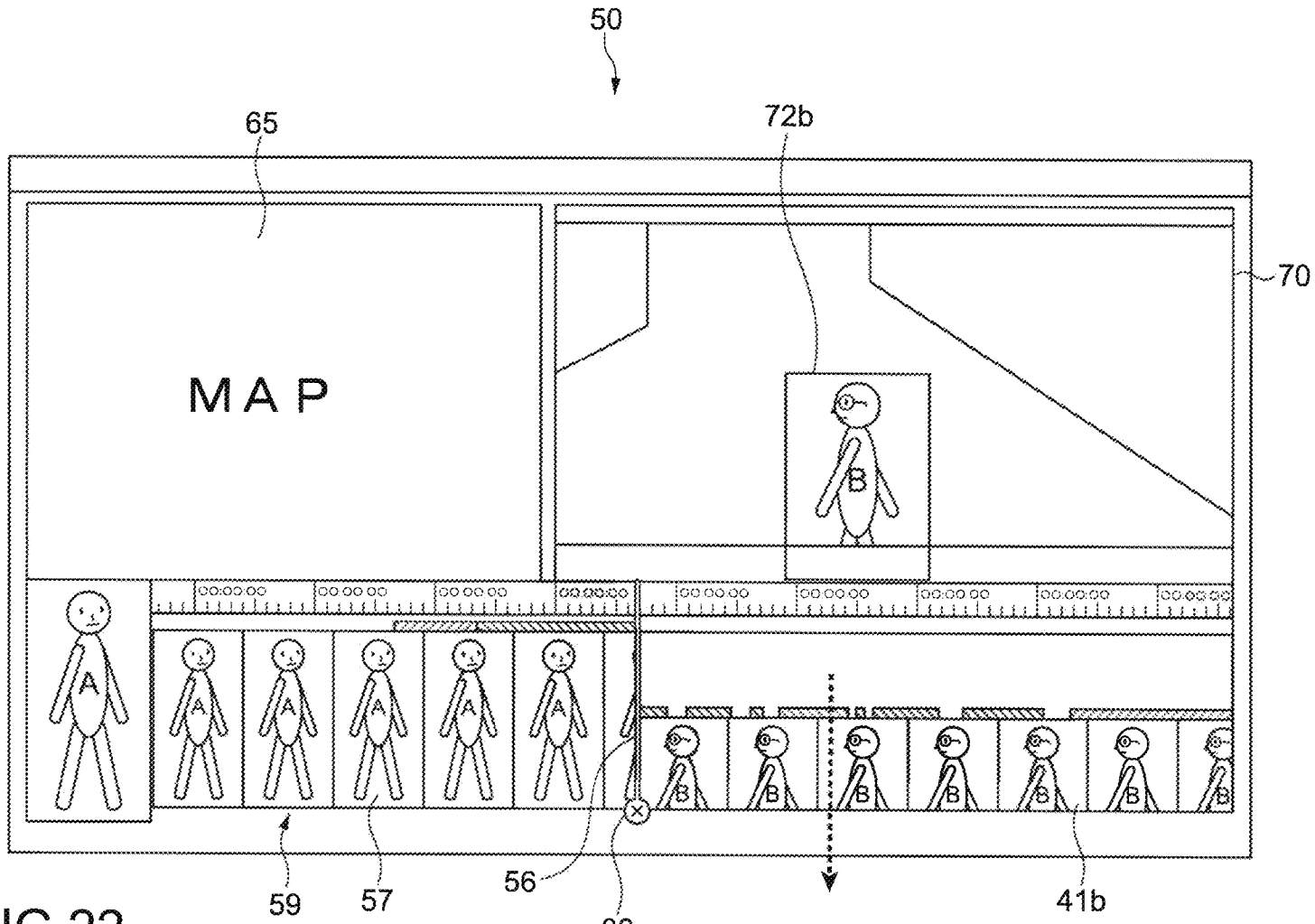
FIG. 22 is a diagram for describing the example of the correction of the one or more identical thumbnail images.

As shown in FIG. 21, when the person A that is intended to be specified as the target object 73 is not displayed in the play view image 70, a cut button 80 provided to the UI screen 50 is used. In an embodiment, the cut button 80 is provided to the lower portion of the pointer 56. As shown in FIG. 22, when the user 1 clicks the cut button 80, the thumbnail images 41*b* arranged on the right side of the pointer 56 are deleted. Consequently, the thumbnail images 41*b* of the person B, which are arranged as the identical thumbnail images 57 due to the false detection, are deleted. Subsequently, the color of the emphasis image 72*b* of the person B in the play view image 70 is changed from red to green. Note that the position or shape of the cut button 80 is not limited, for example. In an embodiment, the cut button 80 is arranged so as to be connected to the pointer 56, which allows cutting processing with reference to the pointer 56 to be executed by an intuitive operation.

The search for a time point at which a false detection of the target object 73 occurs corresponds to the selection of at least one identical thumbnail image 57 captured later than that time point, from among the one or more identical thumbnail images 57. The selected identical thumbnail image 57 is cut so that the one or more identical thumbnail images 57 are corrected.

Figure 23:
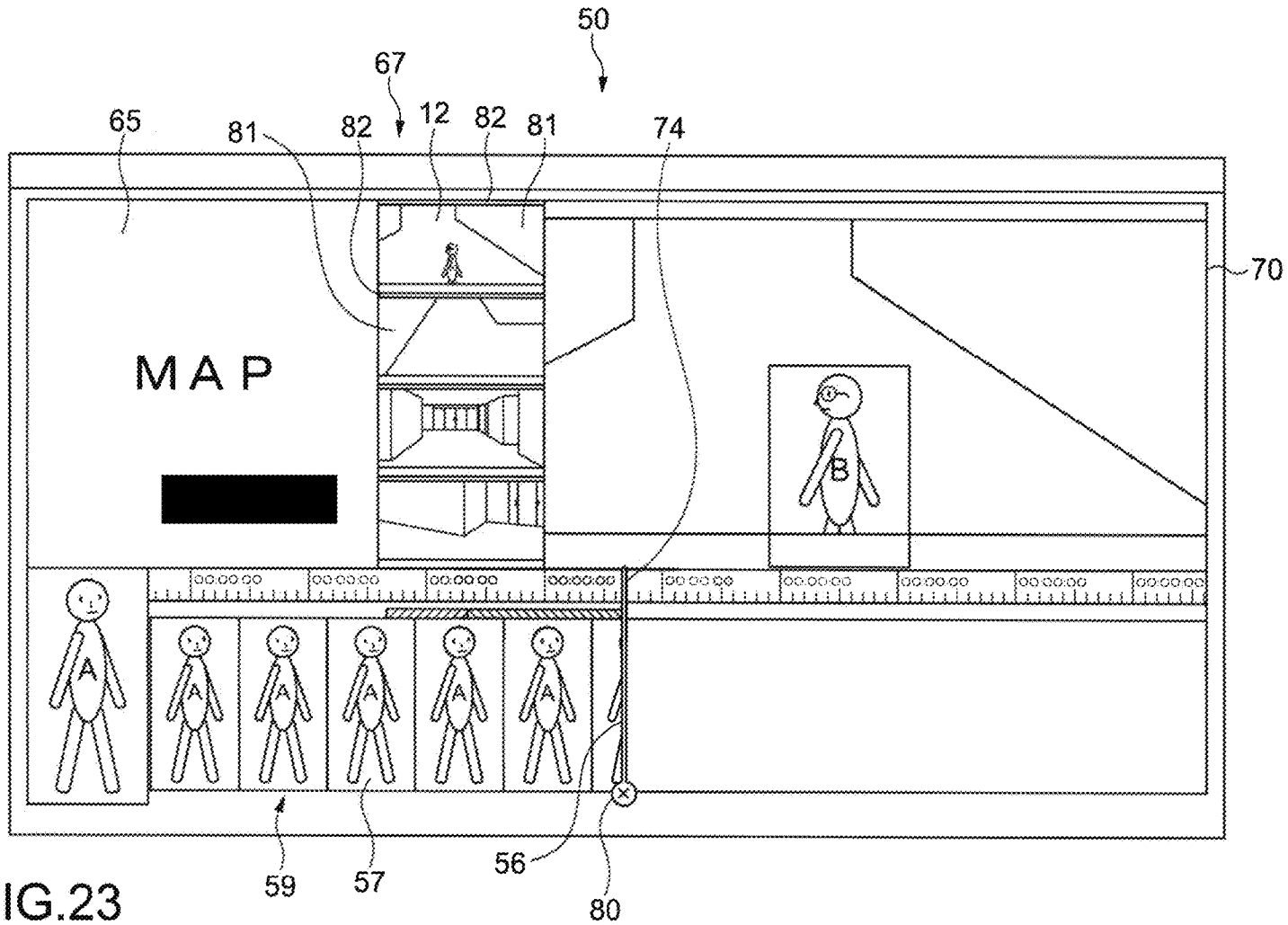
FIG. 23 is a diagram for describing the example of the correction of the one or more identical thumbnail images.

As shown in FIG. 23, when the thumbnail images 41*b* arranged on the right side of the pointer 56 are deleted, video images, i.e., the plurality of frame images 12, which are captured with the respective cameras 10, are displayed in the left display area 67 displaying the map information 65. The video images of the cameras 10 are displayed in monitor display areas 81 each having a small size and can be viewed as a video list. In the monitor display areas 81, the frame images 12 corresponding to the time at the point position 74 of the pointer 56 are displayed. Further, in order to distinguish between the cameras 10, a color set for each camera 10 is displayed in the upper portion 82 of each monitor display area 81.

The plurality of monitor display areas 81 are set so as to search for the person A to be detected as the target object 73. The method of selecting a camera 10, a captured image of which is displayed in the monitor display area 81, from the plurality of cameras 10 in the surveillance camera system 100, is not limited. Typically, the camera 10 is sequentially selected in the descending order of areas with higher possibility that the person A to be the target object 73 is imaged, and the video image of the camera 10 is sequentially displayed as a list from the top of the left display area 67. An area near the camera 10 that captures the frame image 12 in which a false detection occurs is selected to be an area with high possibility that the person A is imaged. Alternatively, for example, an office in which the person A works is selected based on the information of the person A. Other methods may also be used.

Figure 24:
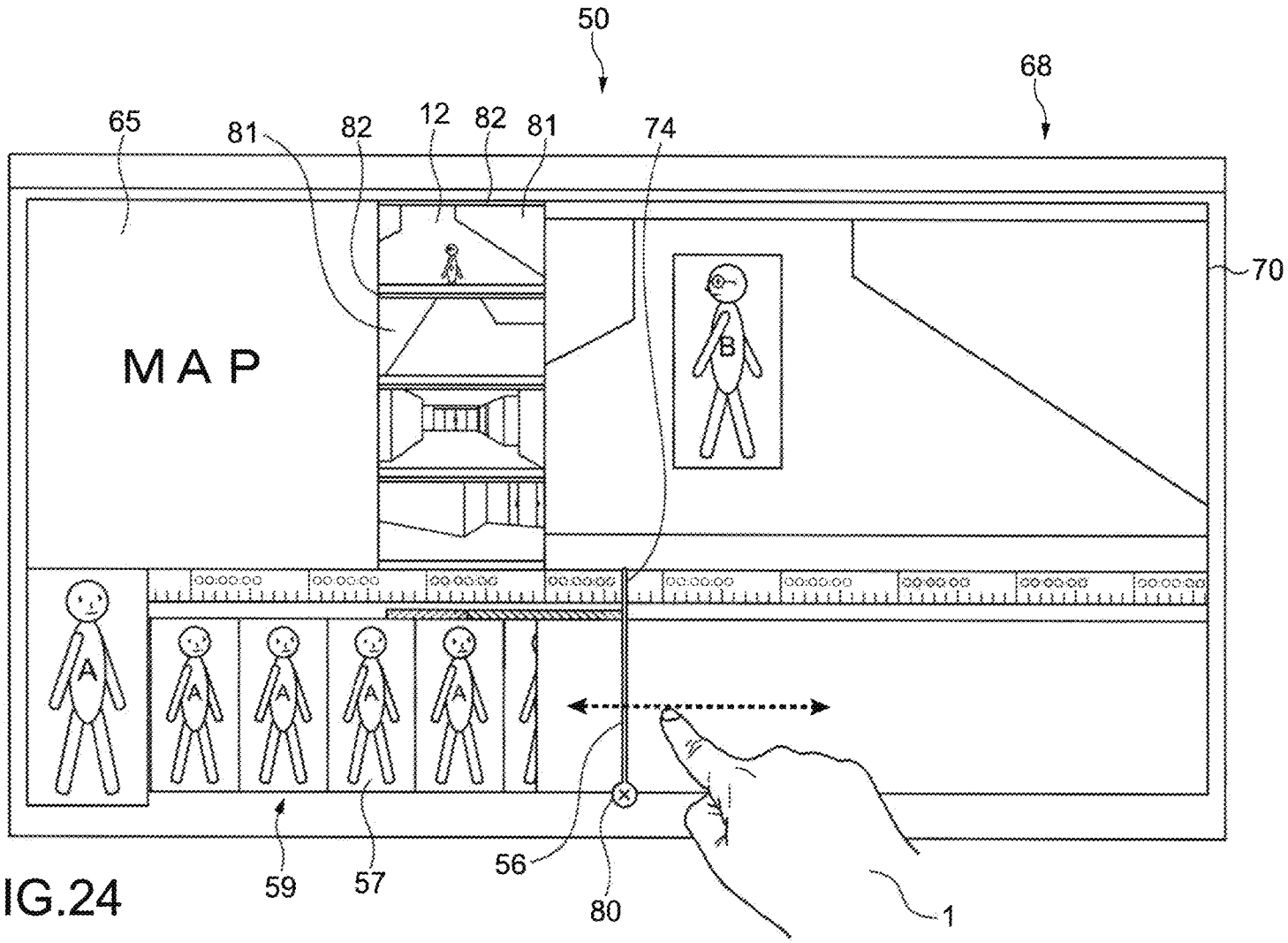
FIG. 24 is a diagram for describing the example of the correction of the one or more identical thumbnail images.

As shown in FIG. 24, the rolled film portion 59 is operated so that the position 74 indicated by the pointer 56 is changed. In conjunction with this, the play view image 70 and the monitor images of the monitor display areas 81 are changed. Further, when the user 1 selects a monitor display area 81, a monitor image displayed in the selected monitor display area 81 is displayed as the play view image 70 in the right display area 68. Consequently, the user 1 can change the point position 74 or select the monitor display area 81 as appropriate, to easily search for the person A to be detected as the target object 73.

Note that the person A may be detected as the target object 73 at a time too late to be displayed on the UI screen 50, i.e., at a position on the right side of the point position 74. Specifically, the false detection of the target object 73 may be solved and the person A may be appropriately detected as the target object 73. In such a case, for example, a button for inputting an instruction to jump to an identical thumbnail image 57 in which the person A at that time appears may be displayed. This is effective when time is advanced to monitor the person A at a time close to the current time, for example.

Figure 25:
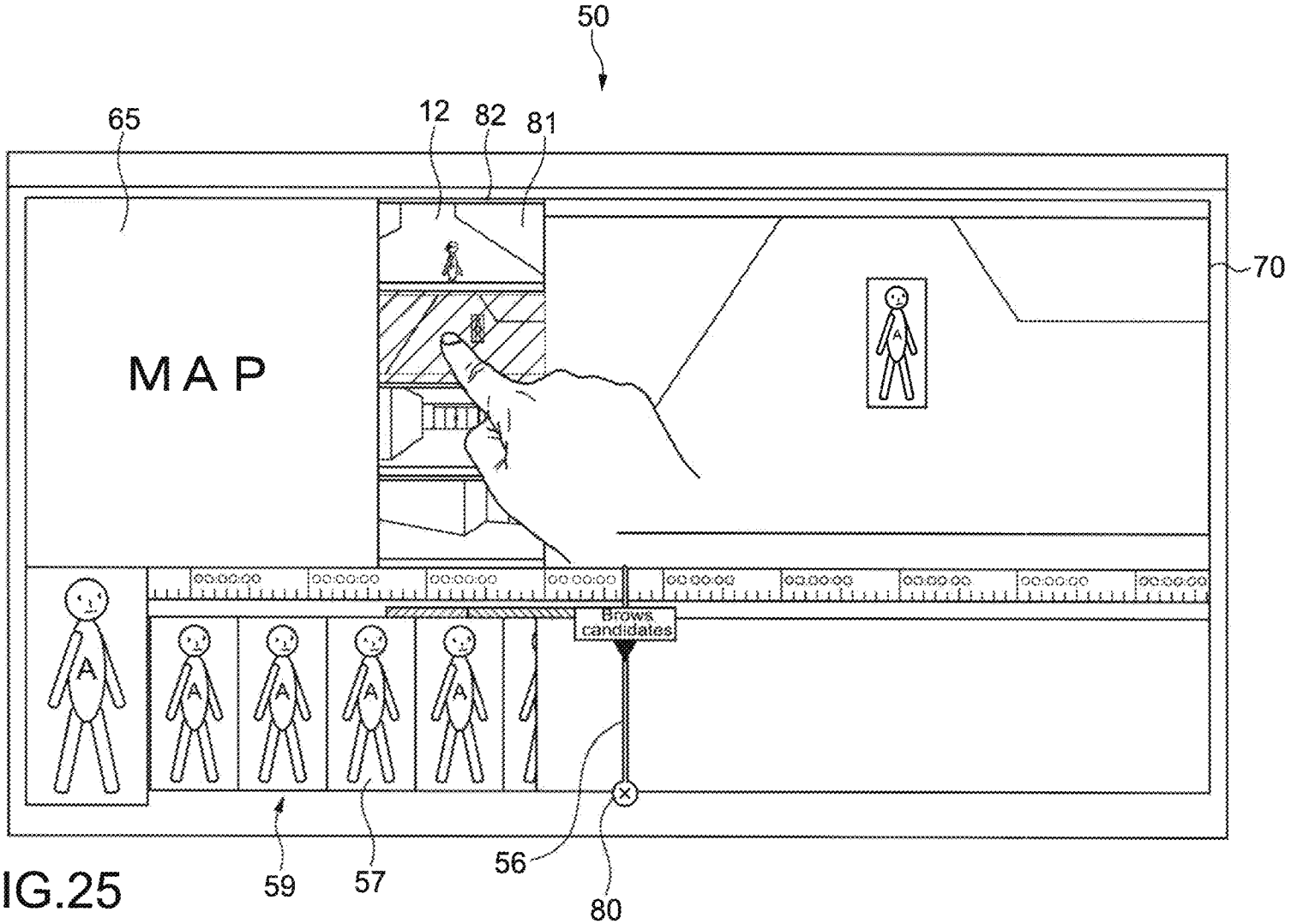
FIG. 25 is a diagram for describing the example of the correction of the one or more identical thumbnail images.

As shown in FIG. 25, a monitor image 12 in which the person A appears is selected from the plurality of monitor display areas 81, and the selected monitor image 12 is displayed as the play view image 70. Subsequently, as shown in FIG. 18, the person A displayed in the play view image 70 is selected, and the pop-up 77 for specifying the target object 73 is displayed. The button for specifying the target object 73 is pressed so that the target object 73 is corrected. In FIG. 25, a candidate browsing button 83 for displaying candidates is displayed at the upper portion of the pointer 56. The candidate browsing button 83 will be described later in detail.

FIGS. 26 to 30 are diagrams for describing another example of the correction of the one or more identical thumbnail images 57. In the one or more identical thumbnail images 57 of the rolled film portion 59, at a halfway time, a false detection of the target object 73 may occur. For example, the other person B who passes the target object 73 (person A) is falsely detected as the target object 73. At the moment at which the camera 10 to capture the image of the person B is switched, the person A may be appropriately detected as the target object 73 again.

Figure 26:
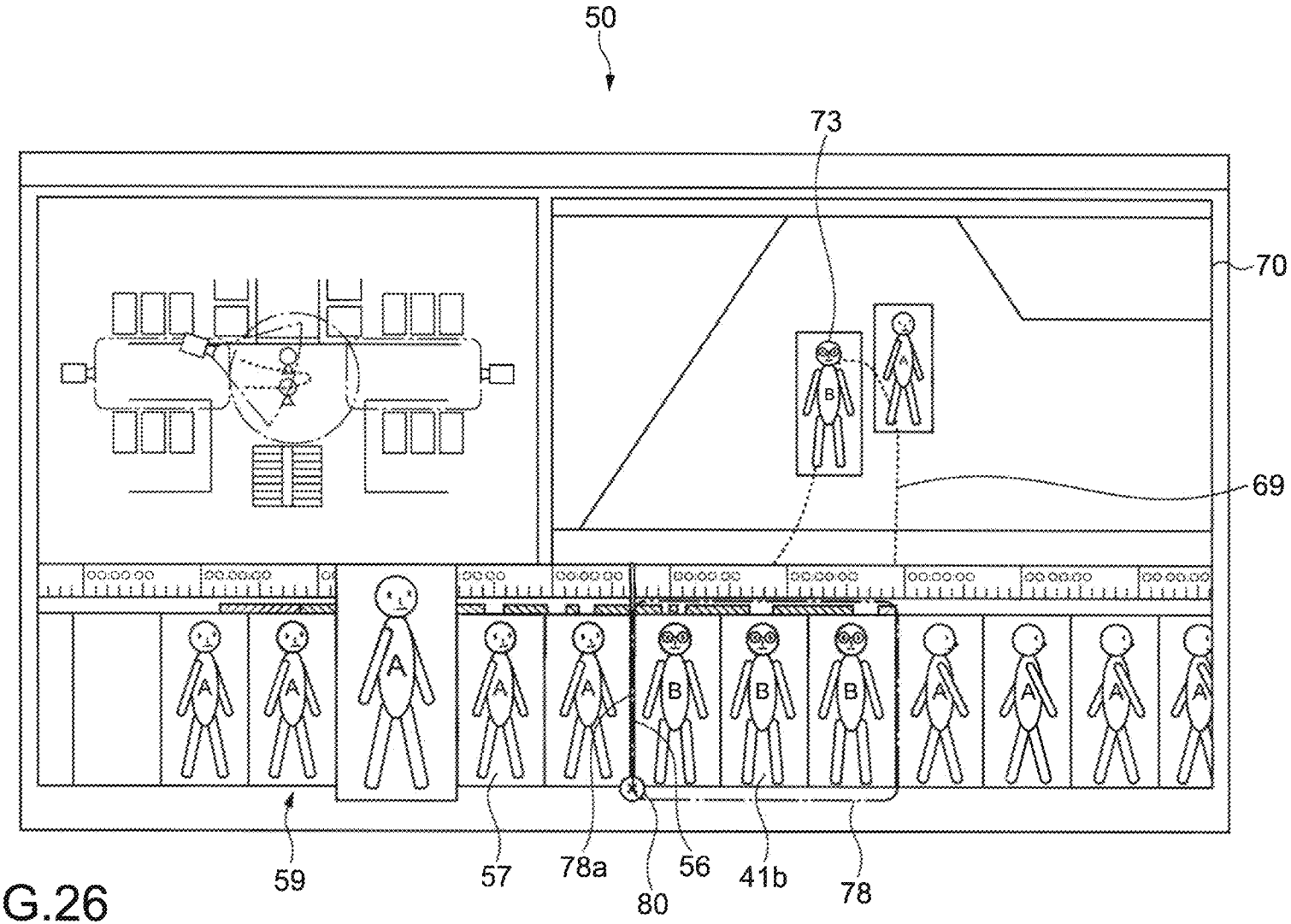
FIG. 26 is a diagram for describing another example of the correction of the one or more identical thumbnail images.

FIG. 26 is a diagram showing an example of such a case. As shown in FIG. 26, the arranged identical thumbnail images 57 include the thumbnail images 41*b* of the person B. When the play view image 70 is viewed, a movement image 69 is displayed. The movement image 69 expresses the movement of the person B who travels toward the deep side, but turns back at the halfway and returns to the near side. In such a case, the thumbnail images 41*b* of the person B displayed in the rolled film portion 59 can be corrected by the following operation.

Figure 27:
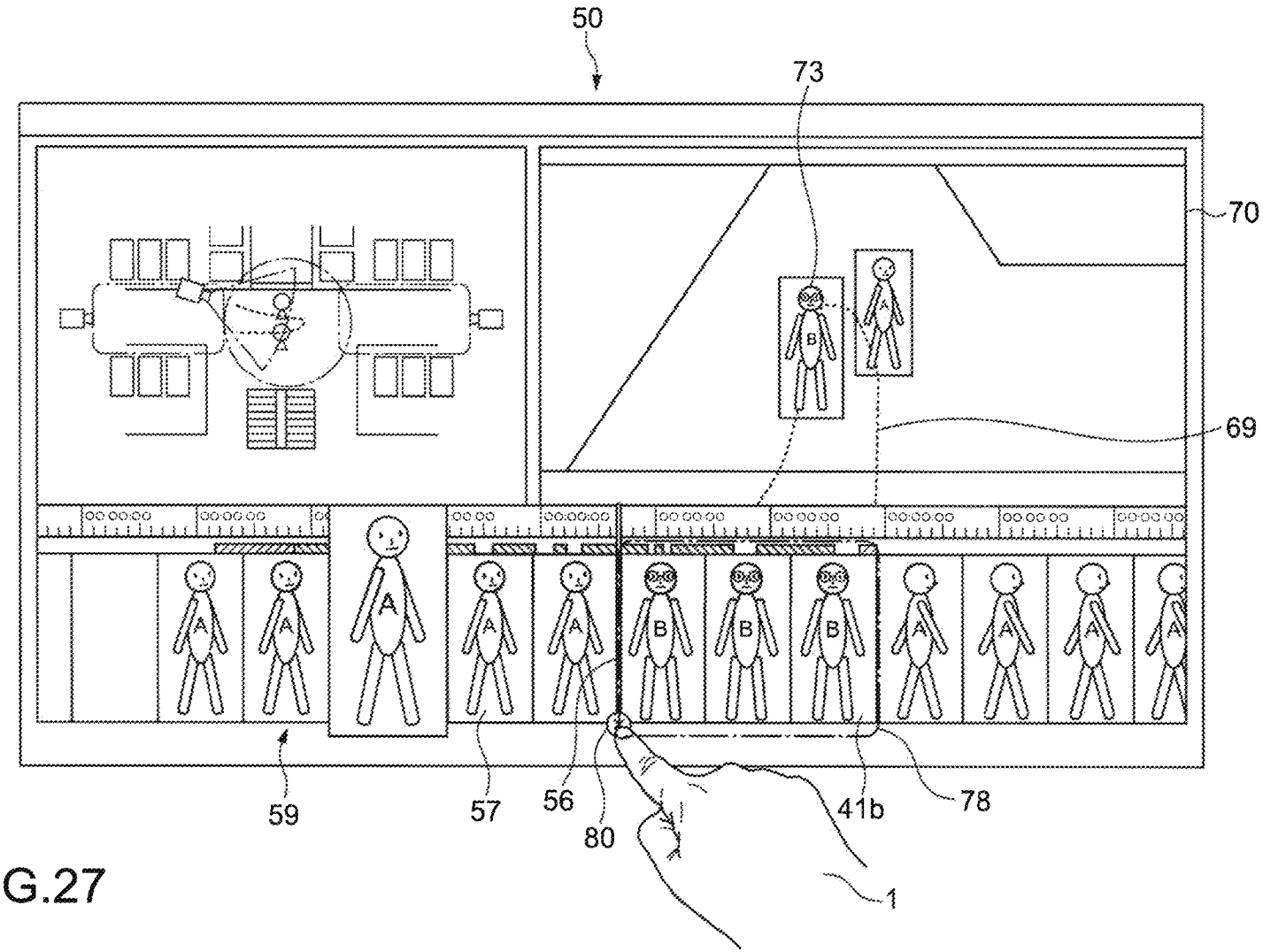
FIG. 27 is a diagram for describing the example of the correction of the one or more identical thumbnail images.
Figure 28:
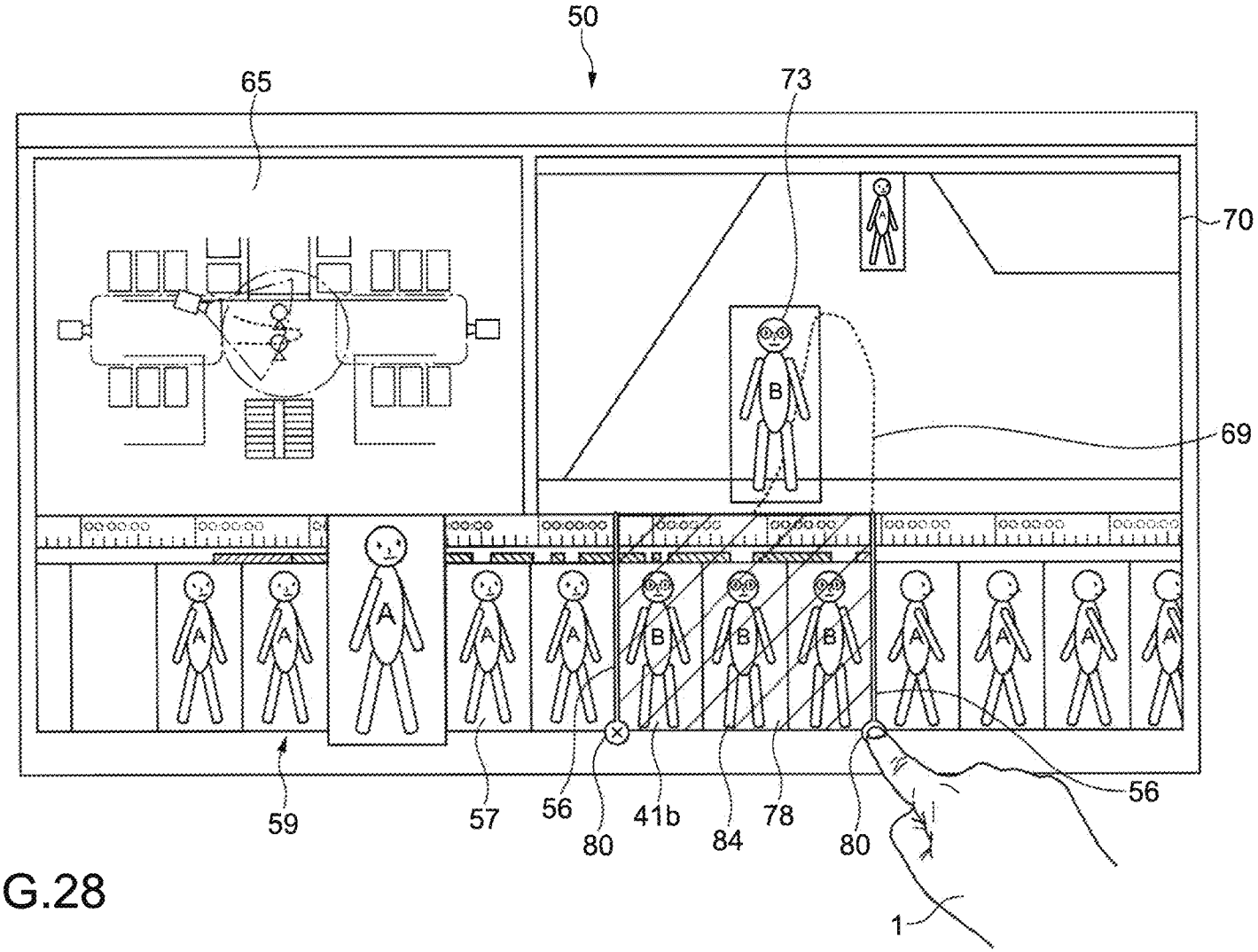
FIG. 28 is a diagram for describing the example of the correction of the one or more identical thumbnail images.

Firstly, the pointer 56 is adjusted to the time at which the person B is falsely detected as the target object 73. Typically, the pointer 56 is adjusted to the left end 78*a* of the thumbnail image 41*b* that is located at the leftmost position of the thumbnail images 41*b* of the person B. As shown in FIG. 27, the user 1 presses the cut button 80. When a click operation is input in this state, the identical thumbnail images 57 on the right side of the pointer 56 are cut. Consequently, here, the finger is moved to the end of the range 78 with the cut button 80 being pressed. In the range 78, the thumbnail images 41*b* of the person B are displayed. Specifically, with the cut button 80 being pressed, a drag operation is input so as to cover the area intended to be cut. Subsequently, as shown in FIG. 28, a UI 84 indicating the range 78 to be cut is displayed. Note that in conjunction with the selection of the range 78 to be cut, the map information 65 and the play view image 70 corresponding to the time of a drag destination are displayed. Alternatively, the map information 65 and the play view image 70 may not be changed.

Figure 29:
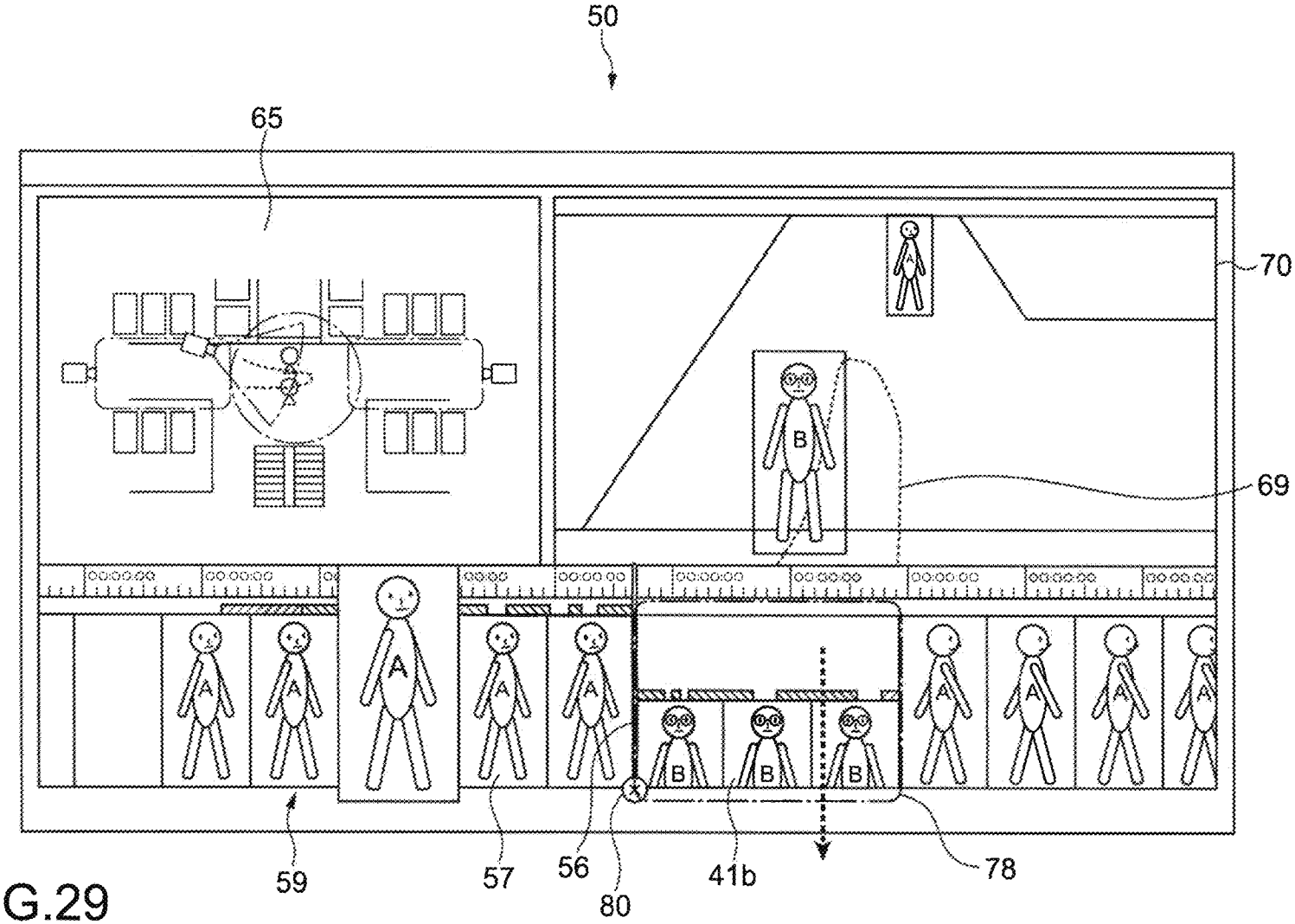
FIG. 29 is a diagram for describing the example of the correction of the one or more identical thumbnail images.
Figure 30:
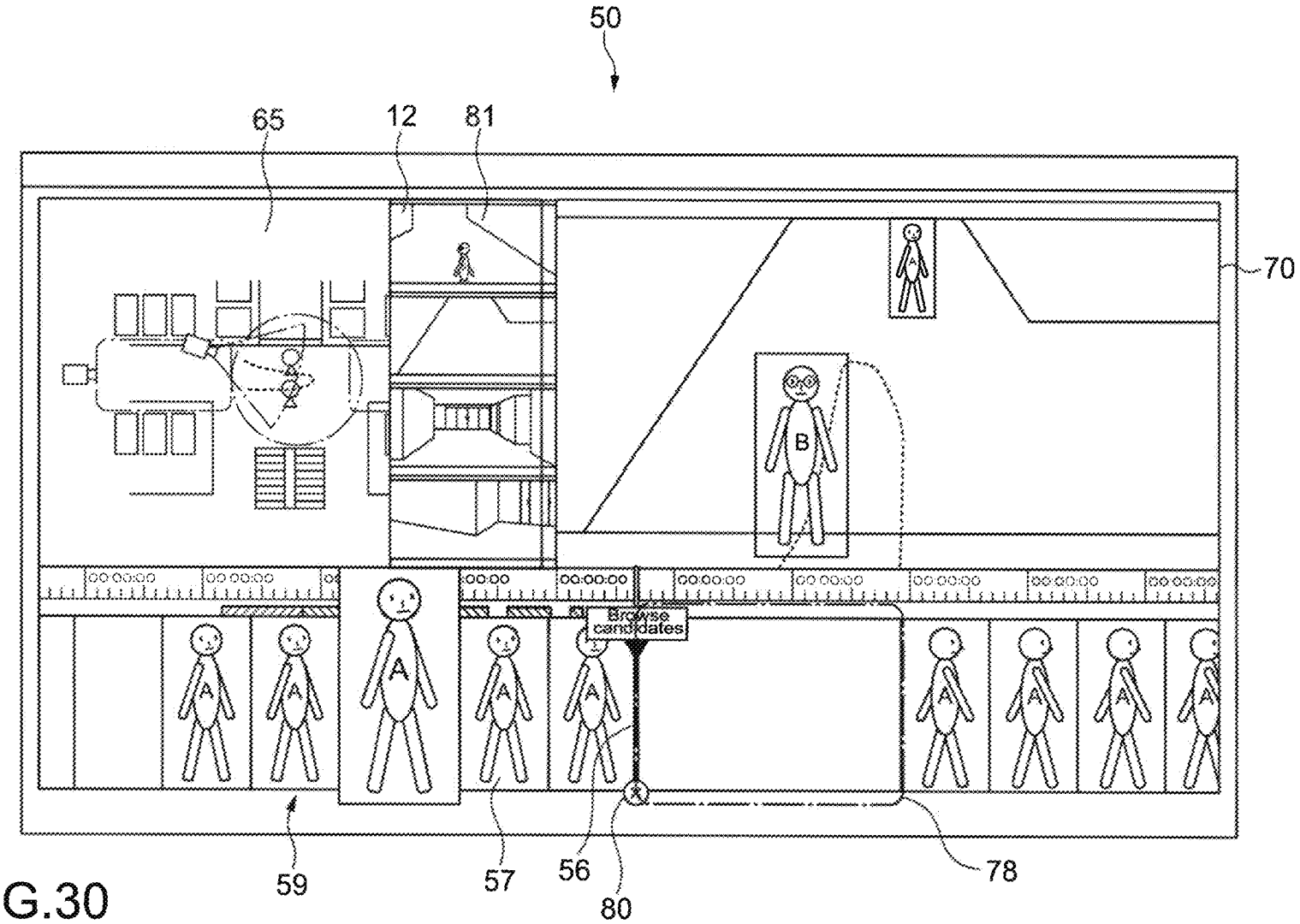
FIG. 30 is a diagram for describing the example of the correction of the one or more identical thumbnail images.

As shown in FIG. 29, when the finger is separated from the cut button 80 after the drag operation, the selected range 78 to be cut is deleted. As shown in FIG. 30, when the thumbnail images 41*b* of the range 78 to be cut are deleted, the plurality of monitor display areas 81 are displayed and the monitor images 12 captured with the respective cameras 10 are displayed. With this, the person A is searched for at the time of the cut range 78. Further, the candidate browsing button 83 is displayed at the upper portion of the pointer 56.

The selection of the range 78 to be cut corresponds to the selection of at least one of the one or more identical thumbnail images 57. The selected identical thumbnail image 57 is cut, so that the one or more identical thumbnail images 57 are corrected. This allows a correction to be executed by an intuitive operation.

Figure 31:
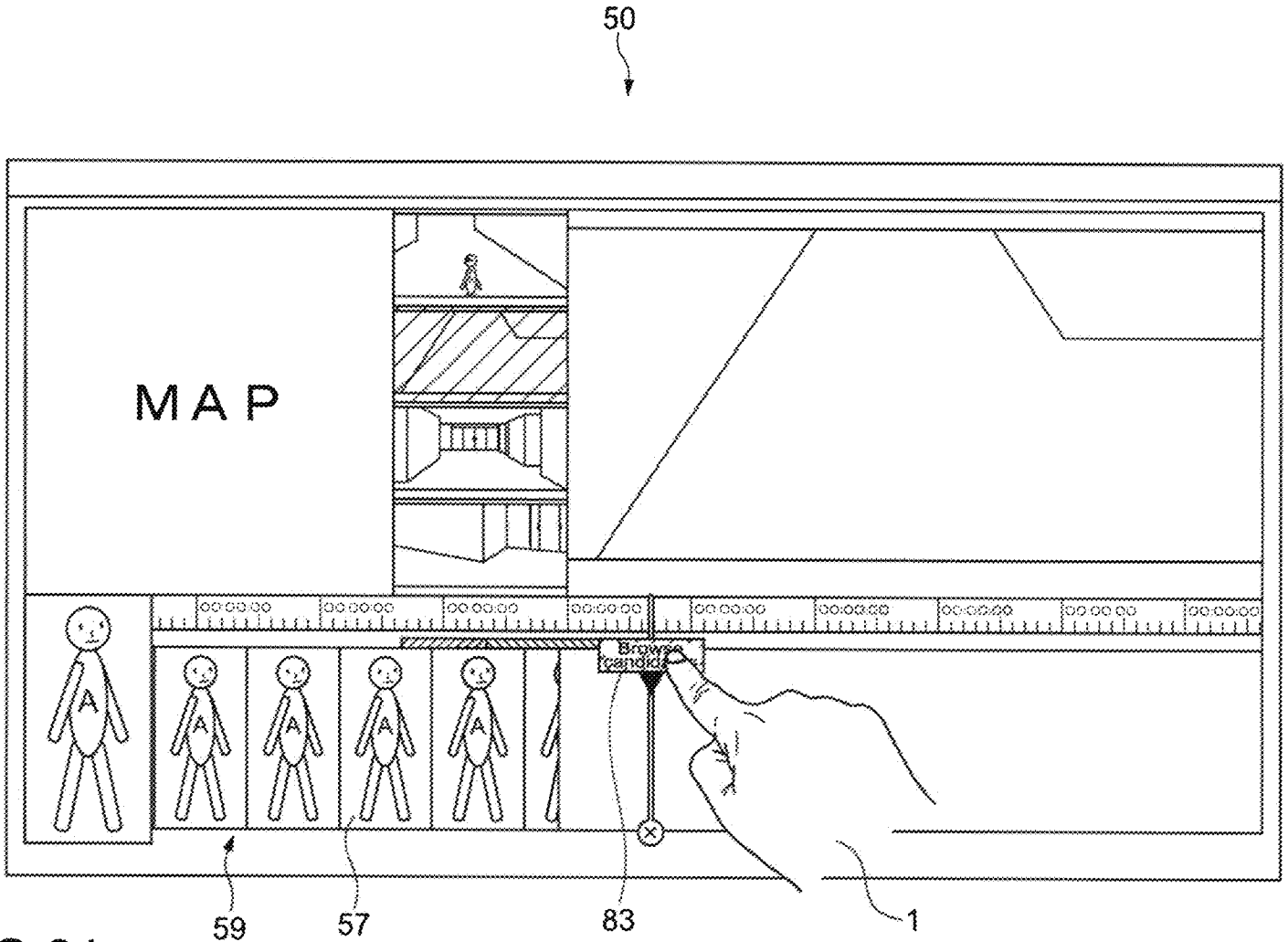
FIG. 31 is a diagram for describing how candidates are displayed by using a candidate browsing button.
Figure 32:
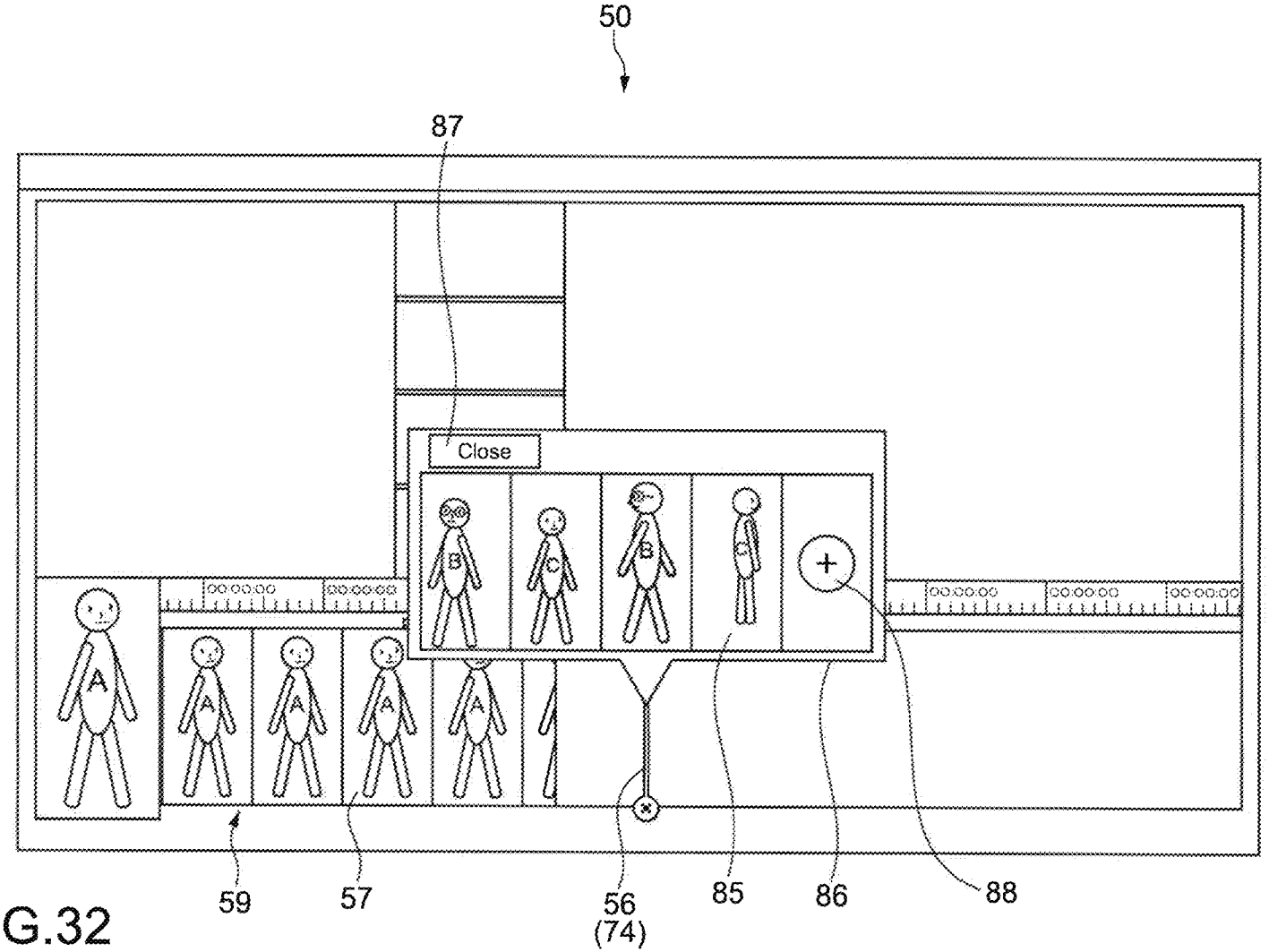
FIG. 32 is a diagram for describing how candidates are displayed by using the candidate browsing button.

FIGS. 31 to 35 are diagrams for describing how candidates are displayed by using the candidate browsing button 83. The UI screen 50 shown in FIG. 31 is a screen at the stage at which the identical thumbnail images 57 are corrected and the person A to be the target object 73 is searched for. In such a state, the user 1 clicks the candidate browsing button 83. Subsequently, as shown in FIG. 32, a candidate selection UI 86 for displaying a plurality of candidate thumbnail images 85 to be selectable is displayed.

The candidate selection UI 86 is displayed subsequently to an animation to enlarge the candidate browsing button 83 and is displayed so as to be connected to the position of the pointer 56. Among the thumbnail images 41 corresponding to the point position of the pointer 56, a thumbnail image 41 that stores the tracking ID of the person A is deleted by the correction processing. Consequently, it is assumed that the tracking ID of the person A as a thumbnail image 41 corresponding to the point position does not exist in the storage unit 208. The server apparatus 20 selects thumbnail images 41 having a high possibility that the person A appears from the plurality of thumbnail images 41 corresponding to the point position 74, and displays the selected thumbnail images 41 as the candidate thumbnail images 85. Note that the candidate thumbnail images 85 corresponding to the point position 74 are selected from, for example, the thumbnail images 41 captured at that time of the point position 74 or thumbnail images 41 captured at a time included in a predetermined range around that time of the point position 74.

Figure 33:
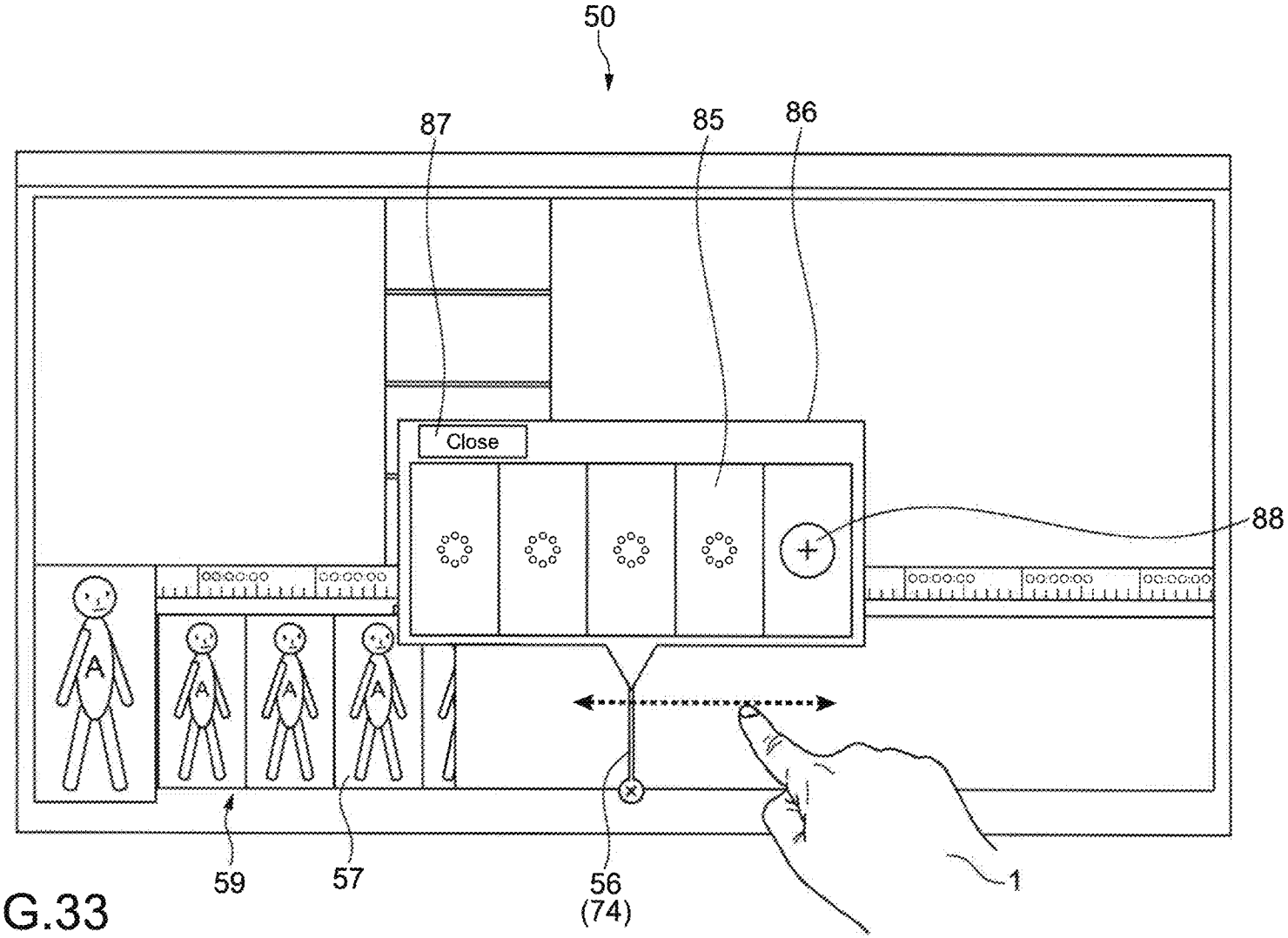
FIG. 33 is a diagram for describing how candidates are displayed by using the candidate browsing button.

The method of selecting the candidate thumbnail images 85 is not limited. Typically, the degree of similarity of objects appearing in the thumbnail images 41 is calculated. For the calculation, any technique including pattern matching processing and edge detection processing may be used. Alternatively, based on information on a target object to be searched for, the candidate thumbnail images 85 may be preferentially selected from an area where the object frequently appears. Other methods may also be used. Note that as shown in FIG. 33, when the point position 74 is changed, the candidate thumbnail images 85 are also changed in conjunction with the change of the point position 74.

Additionally, the candidate selection UI 86 includes a close button 87 and a refresh button 88. The close button 87 is a button for closing the candidate selection UI 86. The refresh button 88 is a button for instructing the update of the candidate thumbnail images 85. When the refresh button 88 is clicked, other candidate thumbnail images 85 are retrieved again and displayed.

Figure 34:
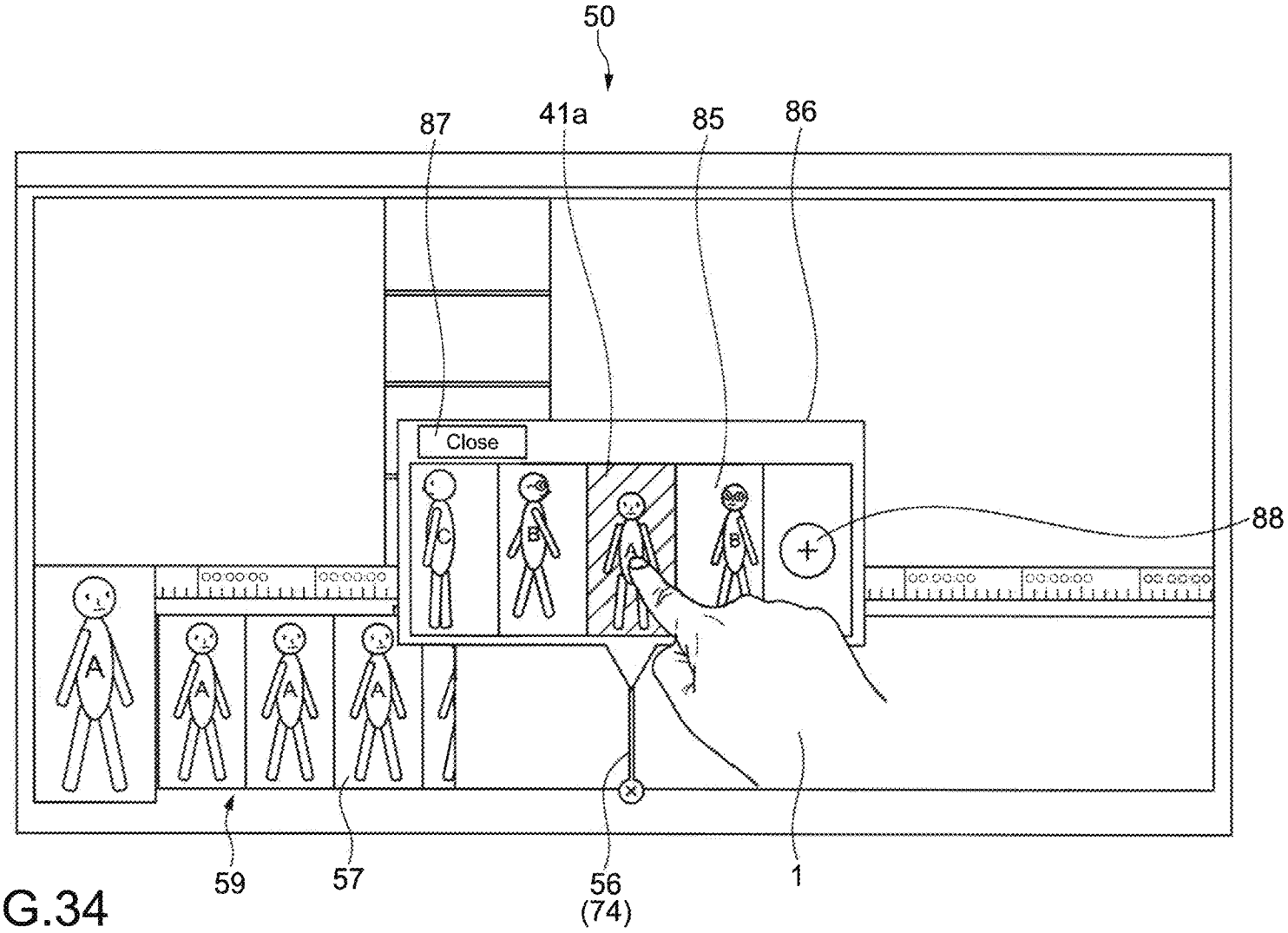
FIG. 34 is a diagram for describing how candidates are displayed by using the candidate browsing button.
Figure 35:
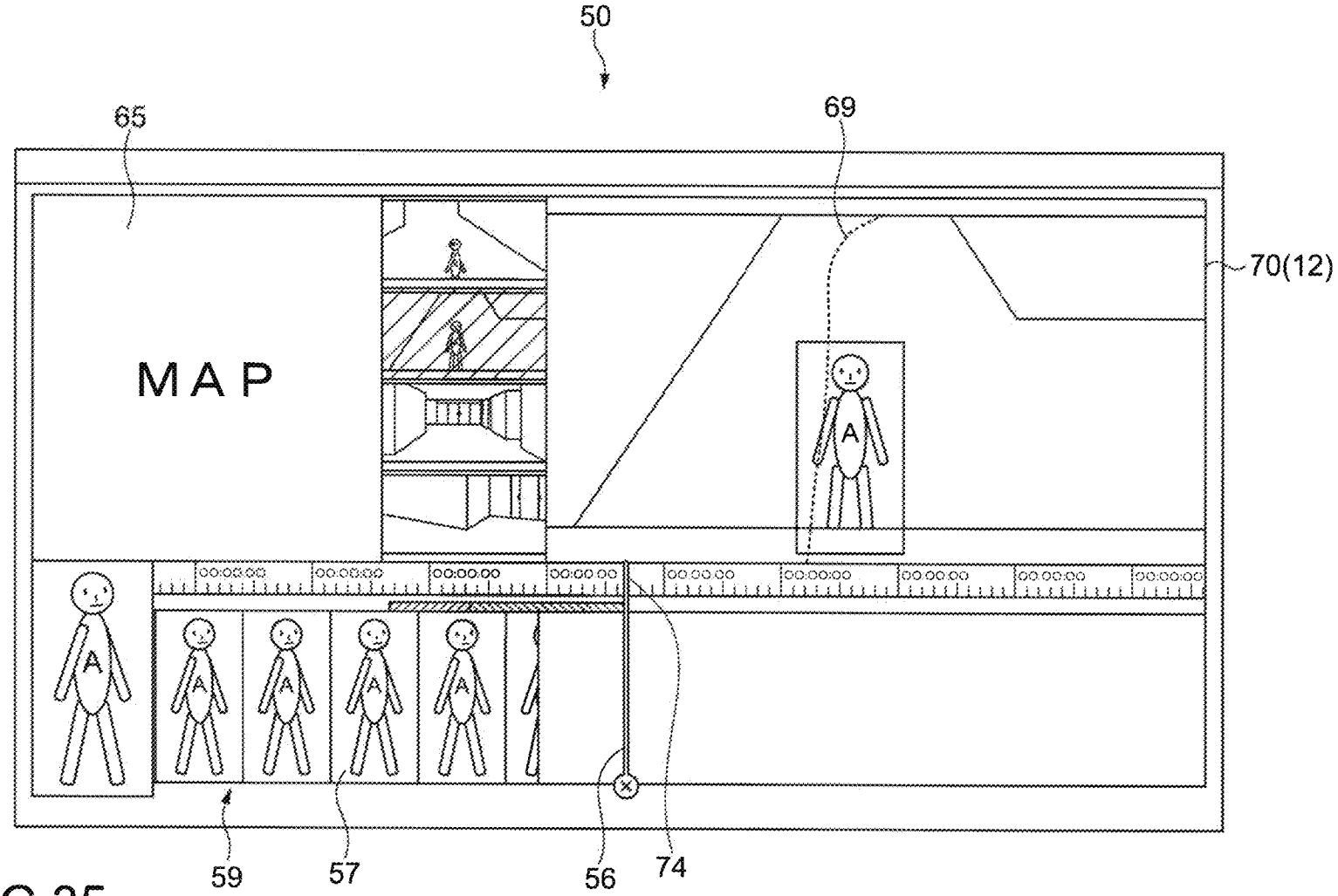
FIG. 35 is a diagram for describing how candidates are displayed by using the candidate browsing button.

As shown in FIG. 34, when a thumbnail image 41*a* of the person A is displayed as the candidate thumbnail image 85 in the candidate selection UI 86, the thumbnail image 41*a* is selected by the user 1. Subsequently, as shown in FIG. 35, the candidate selection UI 86 is closed, and the frame image 12 including the thumbnail image 41*a* is displayed as the play view image 70. Further, the map information 65 associated with the play view image 70 is displayed. The user 1 can observe the play view image 70 (movement image 69) and the map information 65 to determine that the object is the person A.

When the object that appears in the play view image 70 is determined to be the person A, as shown in FIG. 18, the person A is selected and the pop-up 77 for specifying the target object 73 is displayed. The button for specifying the target object 73 is pressed so that the person A is set to be the target object 73. Consequently, the thumbnail image 41*a* of the person A is displayed as the identical thumbnail image 57. Note that in FIG. 34, when the candidate thumbnail image 85 is selected, the setting of the target object 73 may be executed. This allows the time spent on the processing to be shortened.

As described above, from the one or more thumbnail images 41, in which identification information different from the identification information of the selected reference thumbnail image 43 is stored, the candidate thumbnail image 85 to be a candidate of the identical thumbnail image 57 is selected. This allows the one or more identical thumbnail images 57 to be easily corrected.

Figure 36:
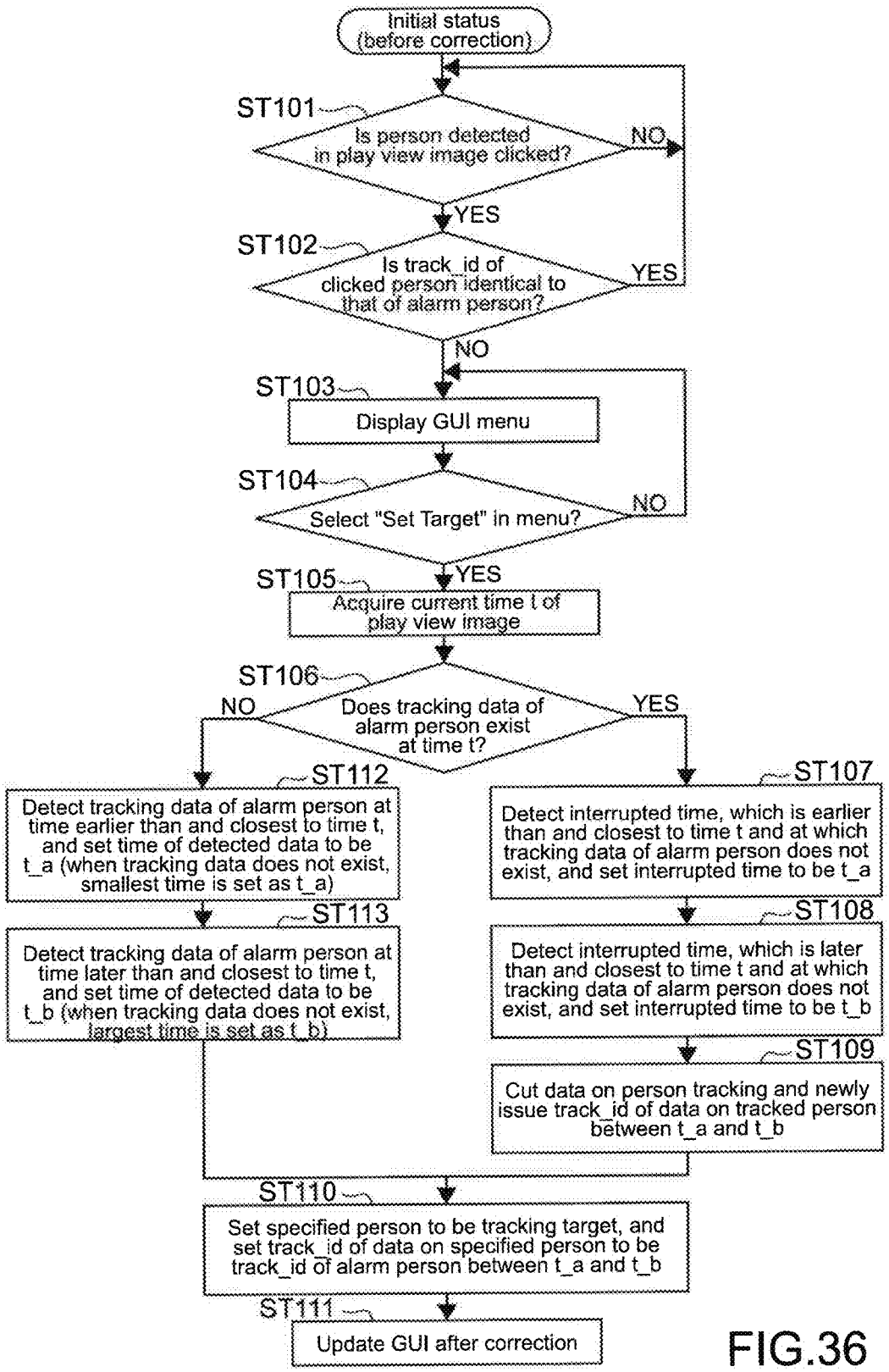
FIG. 36 is a flowchart showing in detail an example of processing to correct the one or more identical thumbnail images.

FIG. 36 is a flowchart showing in detail an example of processing to correct the one or more identical thumbnail images 57 described above. FIG. 36 shows the processing when a person in the play view image 70 is clicked.

Whether the detected person in the play view image 70 is clicked or not is determined (Step 101). When it is determined that the person is not clicked (No in Step 101), the processing returns to the initial status (before the correction). When it is determined that the person is clicked (Yes in Step 101), whether the clicked person is identical to an alarm person or not is determined (Step 102).

The alarm person refers to a person to watch out for or a person to be monitored and corresponds to the target object 73 described above. Comparing the tracking ID (track_id) of the clicked person with the tracking ID of the alarm person, the determination processing in Step 102 is executed.

When the clicked person is determined to be identical to the alarm person (Yes in Step 102), the processing returns to the initial status (before the correction). In other words, it is determined that the click operation is not an instruction of correction. When the clicked person is determined not to be identical to the alarm person (No in Step 102), the pop-up 77 for specifying the target object 73 is displayed as a GUI menu (Step 103). Subsequently, whether "Set Target" in the menu is selected or not, that is, whether the button for specifying the target is clicked or not is determined (Step 104).

When it is determined that "Set Target" is not selected (No in Step 104), the GUI menu is deleted. When it is determined that "Set Target" is selected (Yes in Step 104), a current time t of the play view image 70 is acquired (Step 105). The current time t corresponds to the image capture time of the frame image 12, which is displayed as the play view image 70. It is determined whether the tracking data of the alarm person exists at the time t (Step 106). Specifically, it is determined whether an object detected as the target object 73 exists or not and its thumbnail image 41 exists or not at the time t.

Figure 37:
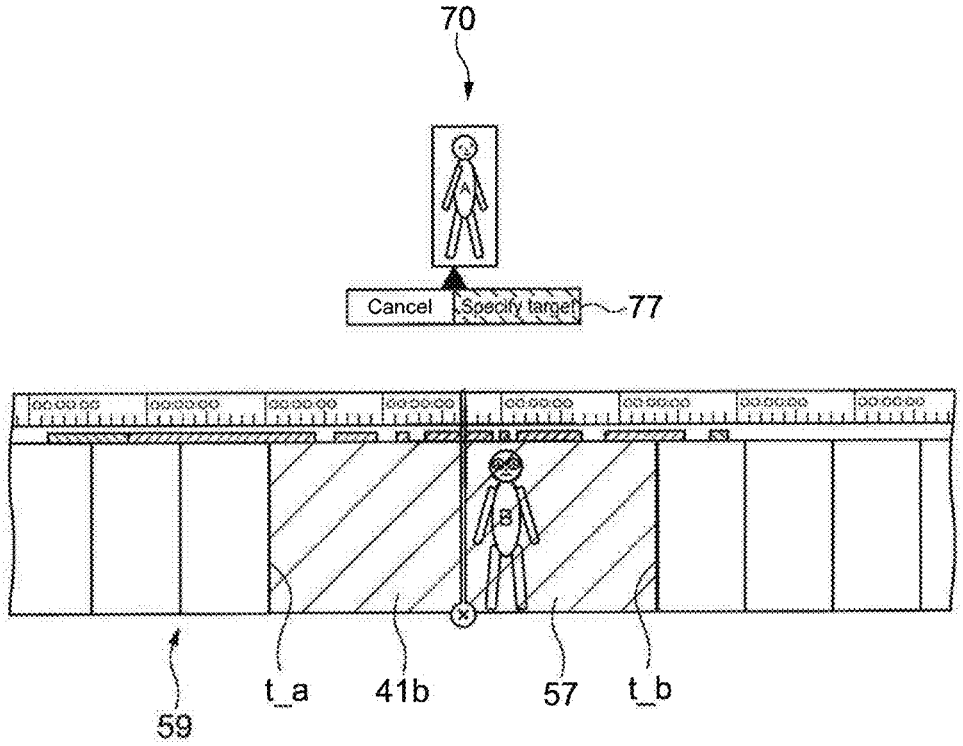
FIG. 37 is a diagram showing an example of a UI screen when "Yes" is detected in Step 106 of FIG. 36.

FIG. 37 is a diagram showing an example of a UI screen when it is determined that an object detected as the target object 73 exists at the time t (Yes in Step 106). If the identical thumbnail image 57 exists at the time t, the person in the identical thumbnail image 57 (in this case, the person B) appears in the play view image 70. In this case, an interrupted time of the tracking data is detected (Step 107). The interrupted time is a time earlier than and closest to the time t and at which the tracking data of the alarm person does not exist. As shown in FIG. 37, the interrupted time is represented by t_a.

Further, another interrupted time of the tracking data is detected (Step 108). This interrupted time is a time later than and closest to the time t and at which the tracking data of the alarm person does not exist. As shown also in FIG. 37, this interrupted time is represented by t_b. The data on the person tracking from the detected time t_a to time t_b is cut. Consequently, the thumbnail image 41*b* of the person B included in the rolled film portion 59 shown in FIG. 37 is deleted. Subsequently, the track_id of data on the tracked person is newly issued between the time t_a and the time t_b (Step 109).

In the example of the processing described here, when the identical thumbnail image 57 is arranged in the rolled film portion 59, the track_id of data on the tracked person is issued. The issued track_id of data on the tracked person is set to be the track_id of the alarm person. For example, when the reference thumbnail image 43 is selected, its track_id is issued as the track_id of data on the tracked person. The track_id of data on the tracked person is set to be the track_id of the alarm person. The thumbnail image 41 for which the set track_id is stored is selected to be the identical thumbnail image 57 and arranged. When the identical thumbnail image 57 in the predetermined range (range from the time t_a to the time t_b) is deleted as described above, the track_id of data on the tracked person is newly issued in the range.

The specified person is set to be a target object (Step 110). Specifically, the track_id of data on the specified person is newly issued in the range from the time t_a to the time t_b, and the track_id is set to be the track_id of the alarm person. As a result, in the example shown in FIG. 37, the thumbnail image of the person A specified via the pop-up 77 is arranged in the range from which the thumbnail image of the person B is deleted. In such a manner, the identical thumbnail image 57 is corrected and the GUI after the correction is updated (Step 111).

Figure 38:
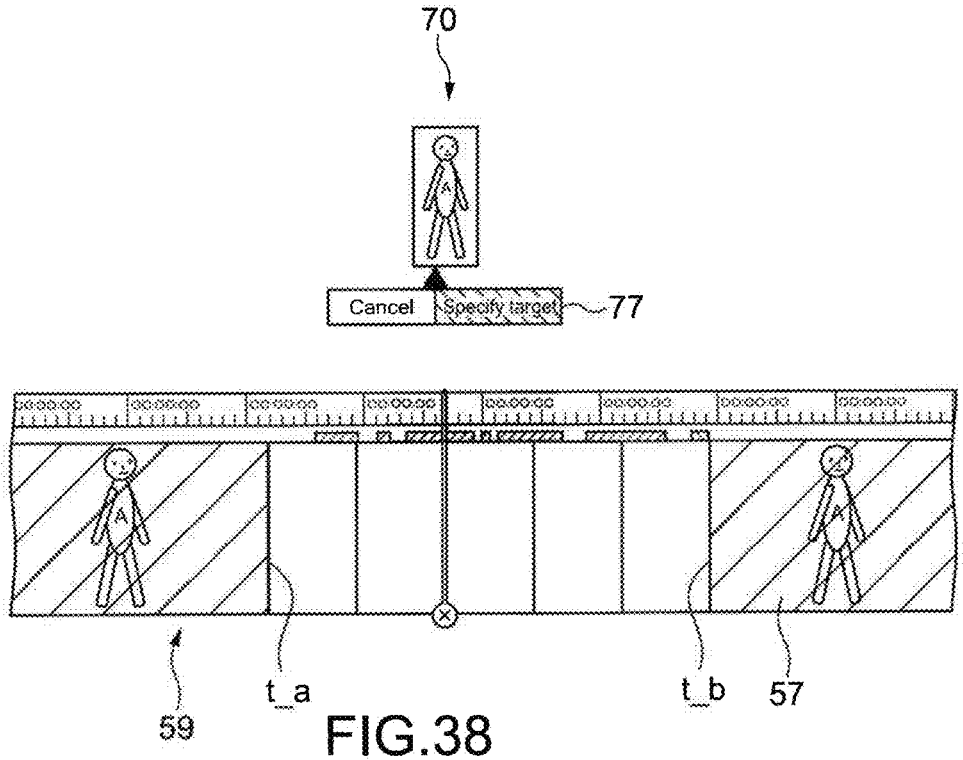
FIG. 38 is a diagram showing an example of the UI screen when "No" is detected in Step 106 of FIG. 36.

FIG. 38 is a diagram showing an example of the UI screen when it is determined that an object detected as the target object 73 does not exist at the time t (No in Step 106). In the example shown in FIG. 38, tracking is not executed in a certain time range in the case where the person A is set as the target object 73.

If no identical thumbnail image 57 exists at the time t, the person (person B) does not appear in the play view image 70 (or may appear but be not detected). In this case, the tracking data of the alarm person at a time earlier than and closest to the time t is detected (Step 112). Subsequently, the time of the tracking data (represented by time t_a) is calculated. In the example shown in FIG. 38, the data of the person A detected as the target object 73 is detected and the time t_a is calculated. Note that if tracking data does not exist before the time t, a smallest time is set as the time t_a. The smallest time means the smallest time and the leftmost time point on the set time axis.

Additionally, the tracking data of the alarm person at a time later than and closest to the time t is detected (Step 113). Subsequently, the time of the tracking data (represented by time t_b) is calculated. In the example shown in FIG. 38, the data of the person A detected as the target object 73 is detected and the time t_b is calculated. Note that if tracking data does not exist after the time t, a largest time is set as the time t_b. The largest time means the largest time and the rightmost time point on the set time axis.

The specified person is set to be the target object 73 (Step 110). Specifically, the track_id of data on the specified person is newly issued in the range from the time t_a to the time t_b, and the track_id is set to be the track_id of the alarm person. As a result, in the example shown in FIG. 38, the thumbnail image of the person A specified via the pop-up 77 is arranged in the range in which the certain time range does not exist. In such a manner, the identical thumbnail image 57 is corrected and the GUI after the correction is updated (Step 111). As a result, the thumbnail image of the person A is arranged as the identical thumbnail image 57 in the rolled film portion 59.

Figure 39:
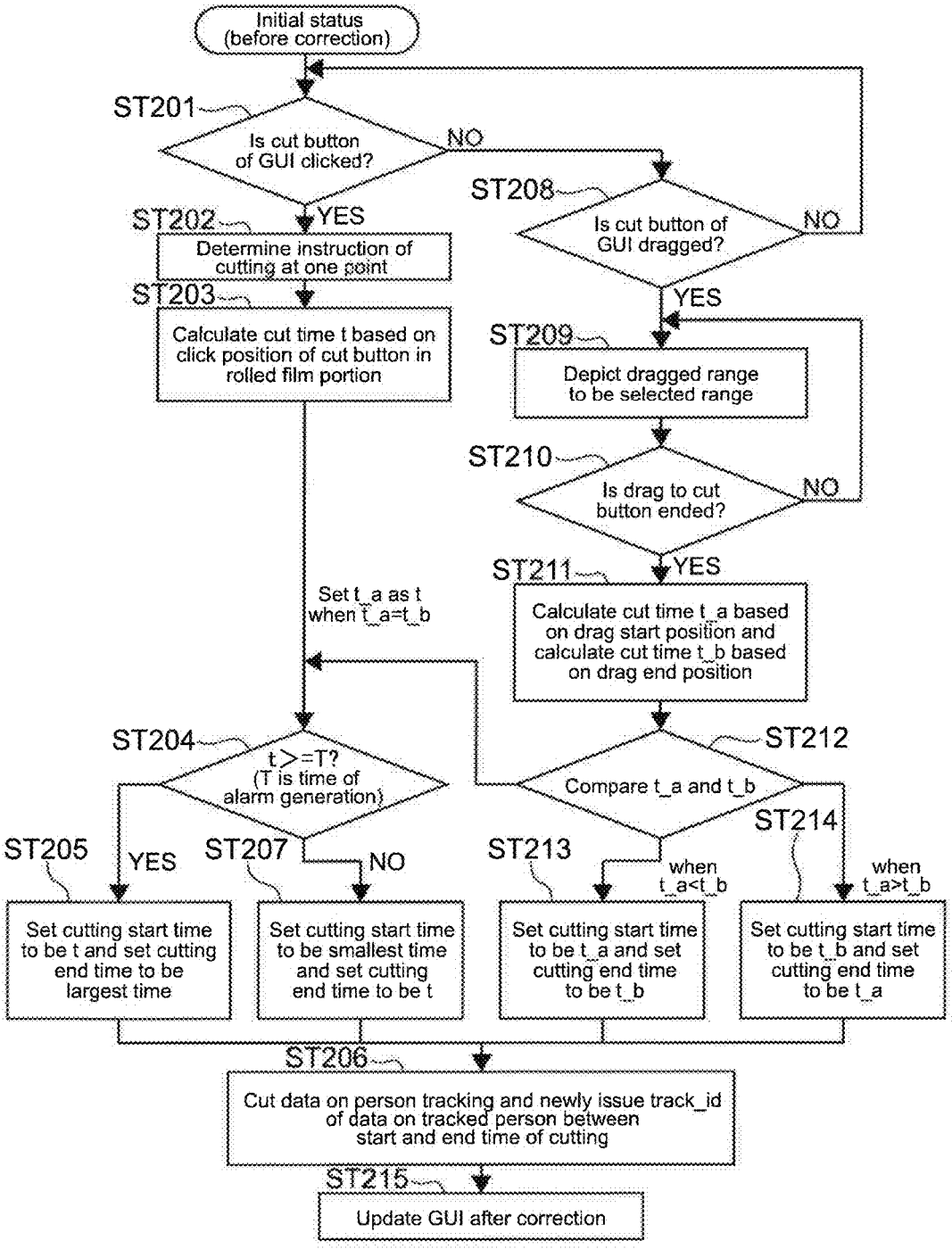
FIG. 39 is a flowchart showing another example of the processing to correct the one or more identical thumbnail images.

FIG. 39 is a flowchart showing another example of the processing to correct the one or more identical thumbnail images 57 described above. FIGS. 40 and 41 are diagrams for describing the processing. FIGS. 39 to 41 show processing when the cut button 80 is clicked.

It is determined whether the cut button 80 as a GUI on the UI screen 50 is clicked or not (Step 201). When it is determined that the cut button 80 is clicked (Yes in Step 201), it is determined that an instruction of cutting at one point is issued (Step 202). A cut time t, at which cutting on the time axis 55 is executed, is calculated based on the position where the cut button 80 is clicked in the rolled film portion 59 (Step 203). For example, when the cut button 80 is provided to be connected to the pointer 56 as shown in FIGS. 40A and 40B and the like, a time corresponding to the point position 74 when the cut button 80 is clicked is calculated as the cut time t.

It is determined whether the cut time t is equal to or larger than a time T at which an alarm is generated (Step 204). The time T at which an alarm is generated corresponds to the reference time T1 in FIG. 7 and the like. Although will be described later, when a person to be monitored is determined, the determination time is set to be the time at an alarm generation, and the thumbnail image 41 of the person at the time point is selected as the reference thumbnail image 43. Subsequently, with the time T at an alarm generation being set to be the reference time T1, a basic UI screen 50 in the initial status as shown in FIG. 8 is generated. The determination in Step 204 is a determination on whether the cut time t is earlier or later than the reference time T1. In the example of FIGS. 40A and 40B, the determination in Step 204 corresponds to a determination on whether the pointer 56 is located on the left or right side of the reference thumbnail image 43 with a large size.

Figure 40A:
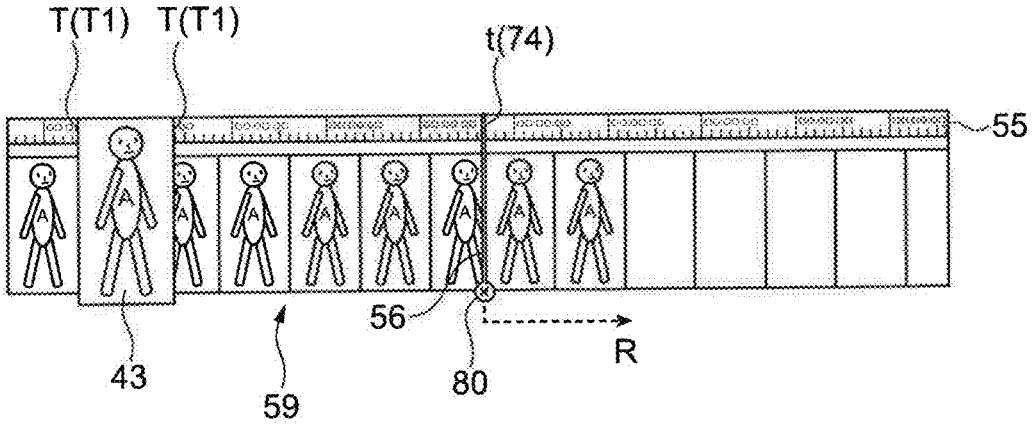
FIGS. 40A and 40B are each a diagram for describing the processing shown in FIG. 39.

For example, as shown in FIG. 40A, it is assumed that the rolled film portion 59 is dragged in the left direction and the point position 74 of the pointer 56 is relatively moved in the right direction. When the cut button 80 is clicked in this state, it is determined that the cut time t is equal to or larger than the time T at an alarm generation (Yes in Step 204). In this case, the start time of cutting is set to be the cut time t, and the end time of cutting is set to be the largest time. In other words, the time range after the cut time t (range R on the right side) is set to be a cut target (Step 205). Subsequently, the track_id of data on the tracked person is newly issued between the start time and the end time (Step 206). Note that only the range in which the target object 73 is detected, that is, the range in which the identical thumbnail image 57 is arranged, may be set to the range to be cut.

Figure 40B:
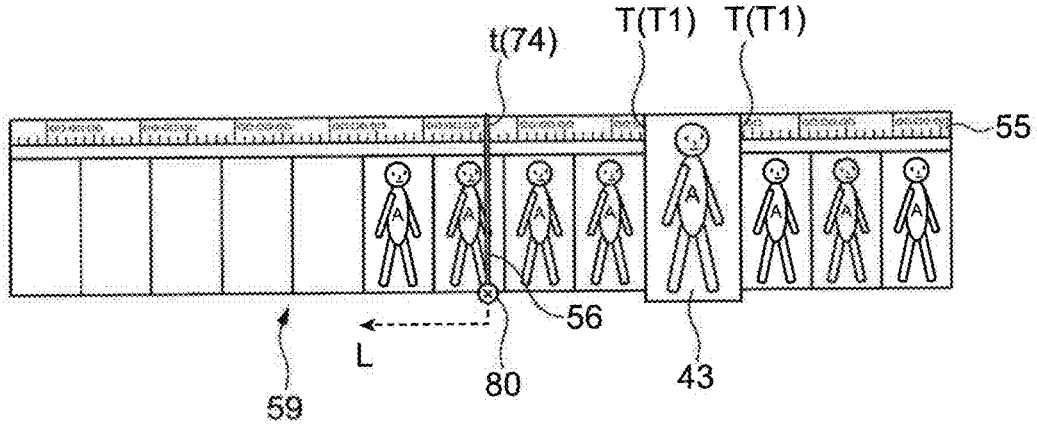

As shown in FIG. 40B, it is assumed that the rolled film portion 59 is dragged in the right direction and the point position 74 of the pointer 56 is relatively moved in the left direction. When the cut button 80 is clicked in this state, it is determined that the cut time t is smaller than the time T at an alarm generation (No in Step 204). In this case, the start time of cutting is set to be the s, and the end time of cutting is set to be the cut time t. In other words, the time range before the cut time t (range L on the left side) is set to be a cut target (Step 207). Subsequently, the track_id of data on the tracked person is newly issued between the start time and the end time (Step 206).

In Step 201, when it is determined that the cut button 80 is not clicked (No in Step 201), it is determined whether the cut button 80 is dragged or not (Step 208). When it is determined that the cut button 80 is not dragged (No in Step 208), the processing returns to the initial status (before the correction). When it is determined that the cut button 80 is dragged (Yes in Step 208), the dragged range is set to be a range selected by the user, and a GUI to depict this range is displayed (Step 209).

It is determined whether the drag operation on the cut button 80 is finished or not (Step 210). When it is determined that the drag operation is not finished (No in Step 210), that is, when it is determined that the drag operation is going on, the selected range is continued to be depicted. When it is determined that the drag operation on the cut button 80 is finished (Yes in Step 210), the cut time t_a is calculated based on the position where the drag is started. Further, the cut time t_b is calculated based on the position where the drag is finished (Step 211).

The calculated cut time t_a and cut time t_b are compared with each other (Step 212). As a result, when both of the cut time t_a and the cut time t_b are equal to each other (when t_a=t_b), the processing after the instruction of cutting at one point is determined is executed. Specifically, the time t_a is set to be the cut time t in Step 203, and the processing proceeds to Step 204.

When the cut time t_a is smaller than the cut time t_b (when t_a<t_b), the start time of cutting is set to be the cut time t_a, and the end time of cutting is set to be the cut time t_b (Step 213). For example, when the drag operation is input toward the future time (in the right direction) with the cut button 80 being pressed, t_a<t_b is obtained. In this case, the cut time t_a is the start time, and the cut time t_b is the end time.

When the cut time t_a is larger than the cut time t_b (when t_a>t_b), the start time of cutting is set to be the cut time t_b, and the end time of cutting is set to be the cut time t_a (Step 214). For example, when the drag operation is input toward the past time (in the left direction) with the cut button 80 being pressed, t_a>t_b is obtained. In this case, the cut time t_b is the start time, and the cut time t_a is the end time. Specifically, of the cut time t_a and the cut time t_b, the smaller one is set to be the start time, and the other larger one is set to be the end time.

Figure 41A:
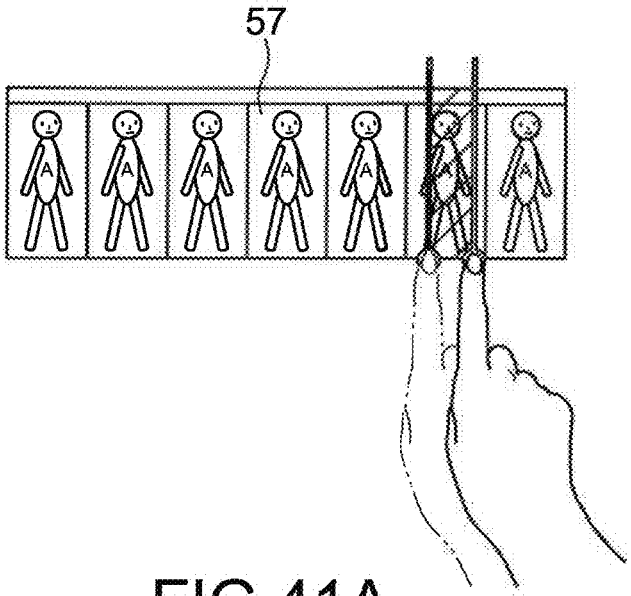
FIGS. 41A and 41B are each a diagram for describing the processing shown in FIG. 39.
Figure 41B:
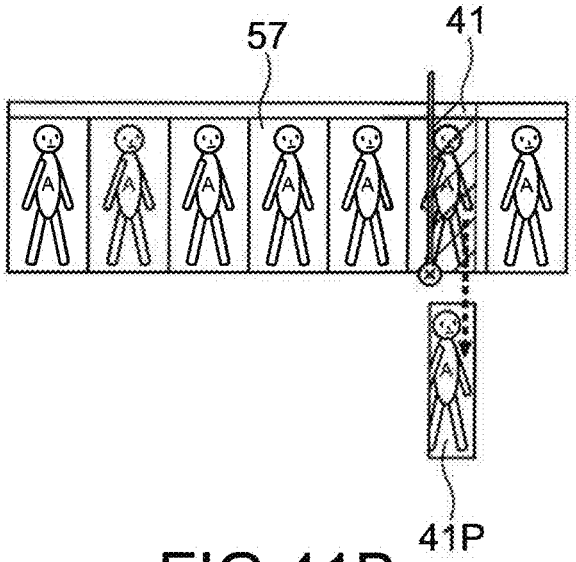

When the start time and the end time are set, the track_id of data on the tracked person is newly issued between the start time and the end time (Step 206). In such a manner, the identical thumbnail image 57 is corrected and the GUI after the correction is updated (Step 215). The one or more identical thumbnail images 57 may be corrected by the processing as shown in the examples of FIGS. 36 and 39. Note that as shown in FIGS. 41A and 41B, a range with a width smaller than the width of the identical thumbnail image 57 may be selected as a range to be cut. In this case, a part 41P of the thumbnail image 41, which corresponds to the range to be cut, only needs to be cut.

Figure 42A:
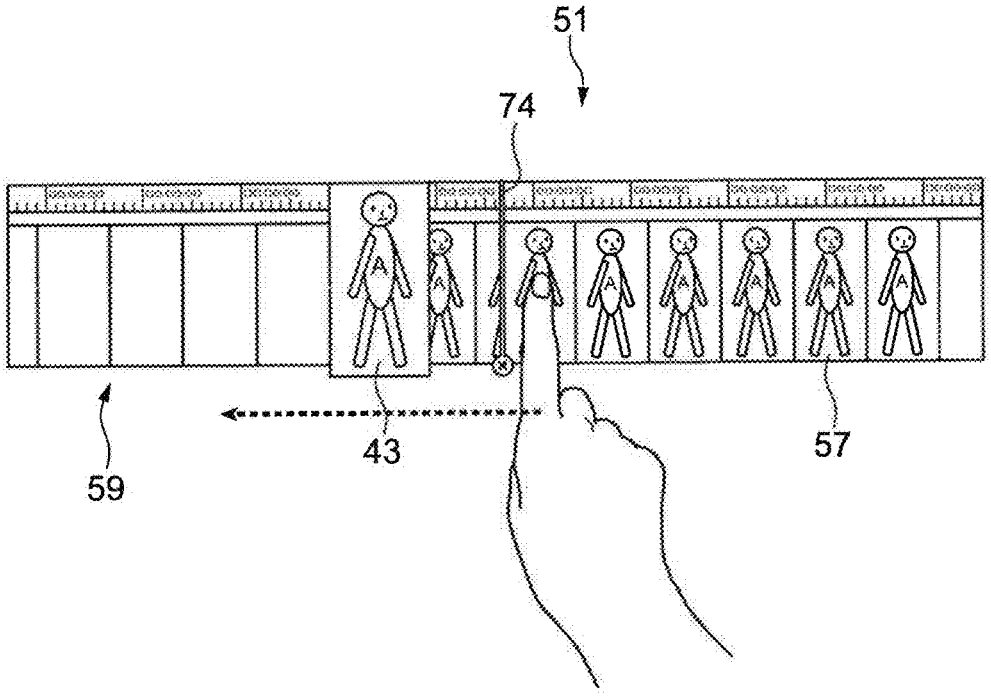
FIGS. 42A and 42B are each a diagram for describing another example of a configuration and an operation of a rolled film image.
Figure 42B:
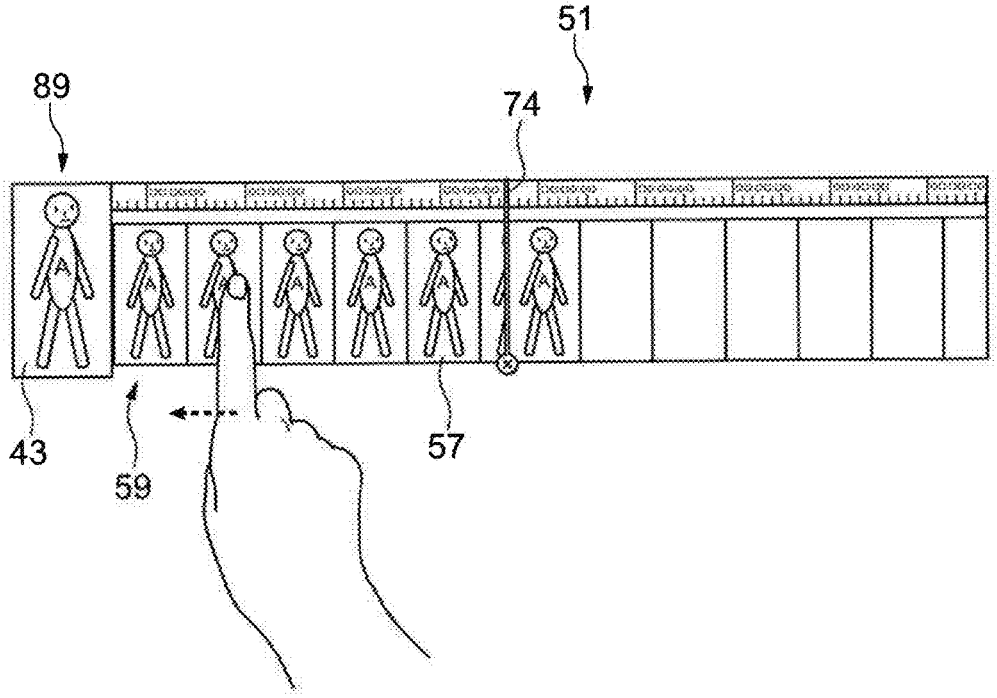
Figure 43A:
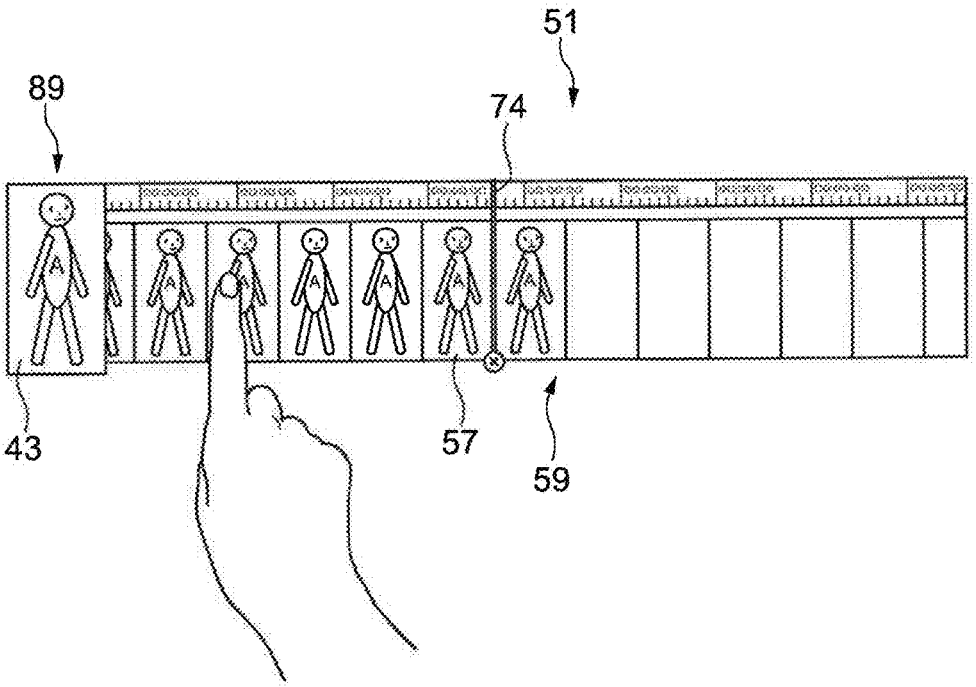
FIGS. 43A and 43B are each a diagram for describing the example of the configuration and the operation of the rolled film image.
Figure 43B:
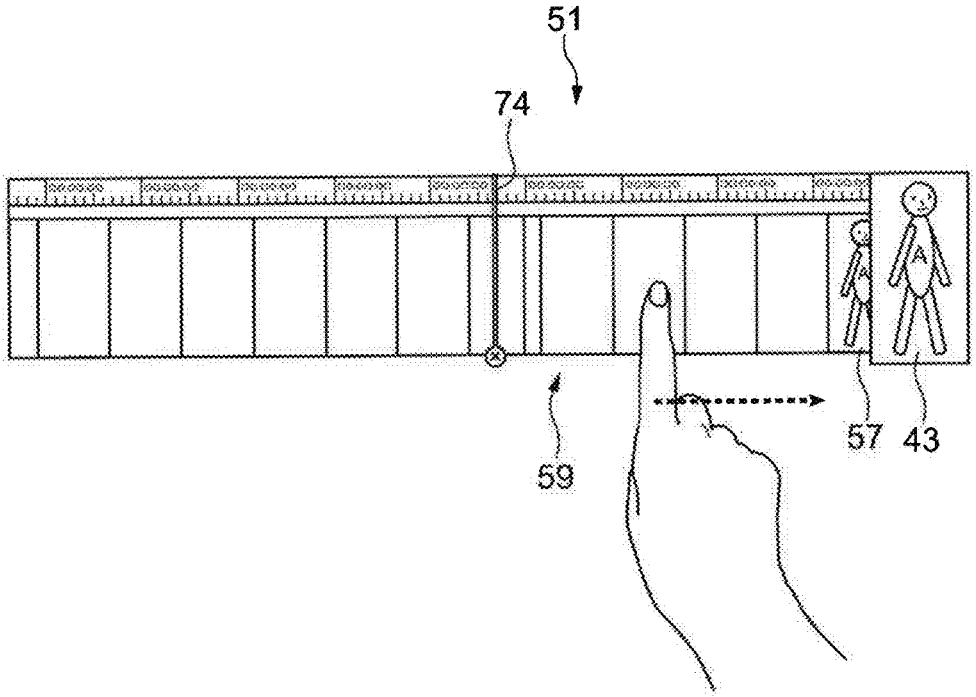

Here, other examples of a configuration and an operation of the rolled film image 51 will be described. FIGS. 42 to 45 are diagrams for describing the examples. For example, as shown in FIG. 42A, the drag of the identical thumbnail image 57 in the left direction allows the point position 74 to be relatively moved. As shown in FIG. 42B, it is assumed that the reference thumbnail image 43 with a large size is dragged to reach a left end 89 of the rolled film image 51. At that time, the reference thumbnail image 43 may be fixed at the position of the left end 89. When the drag operation is further input from this state in the left direction, as shown in FIG. 43A, the other identical thumbnail images 57 are moved in the left direction so as to overlap with the reference thumbnail image 43 and travel on the back side of the reference thumbnail image 43. Specifically, also when the drag operation is input until the reference time reaches the outside of the rolled film image 51, the reference thumbnail image 43 is continued to be displayed in the rolled film image 51. This allows the firstly detected target object to be referred to, when the target object is falsely detected or the sight of the target object is lost, for example. As a result, the target object that is detected to be a suspicious person can be sufficiently monitored. Note that as shown in FIG. 43B, also when the drag operation is input in the right direction, the similar processing may be executed.

Figure 44A:
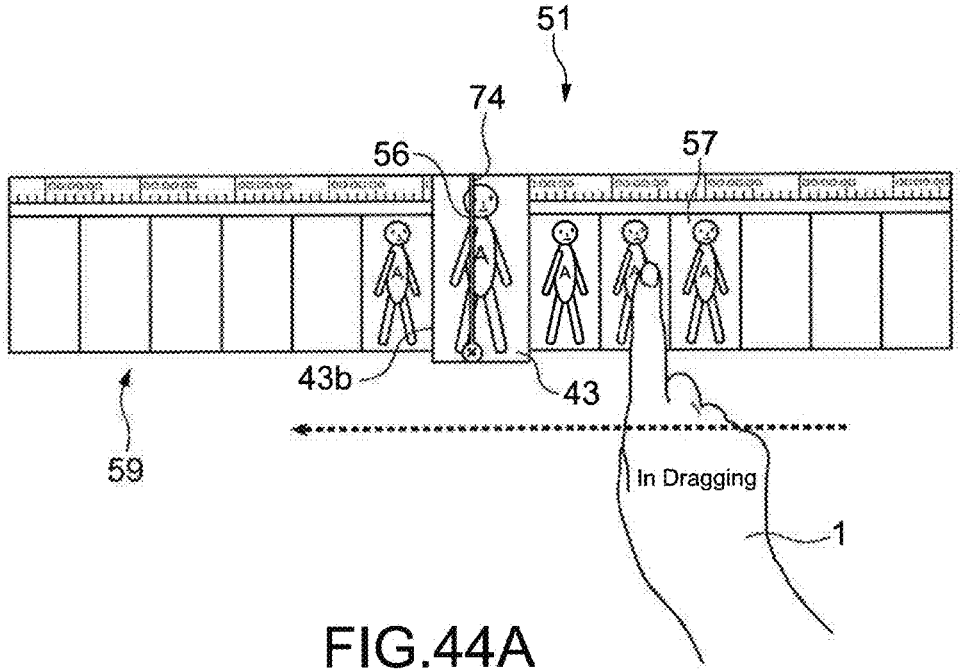
FIGS. 44A and 44B are each a diagram for describing the example of the configuration and the operation of the rolled film image.
Figure 44B:
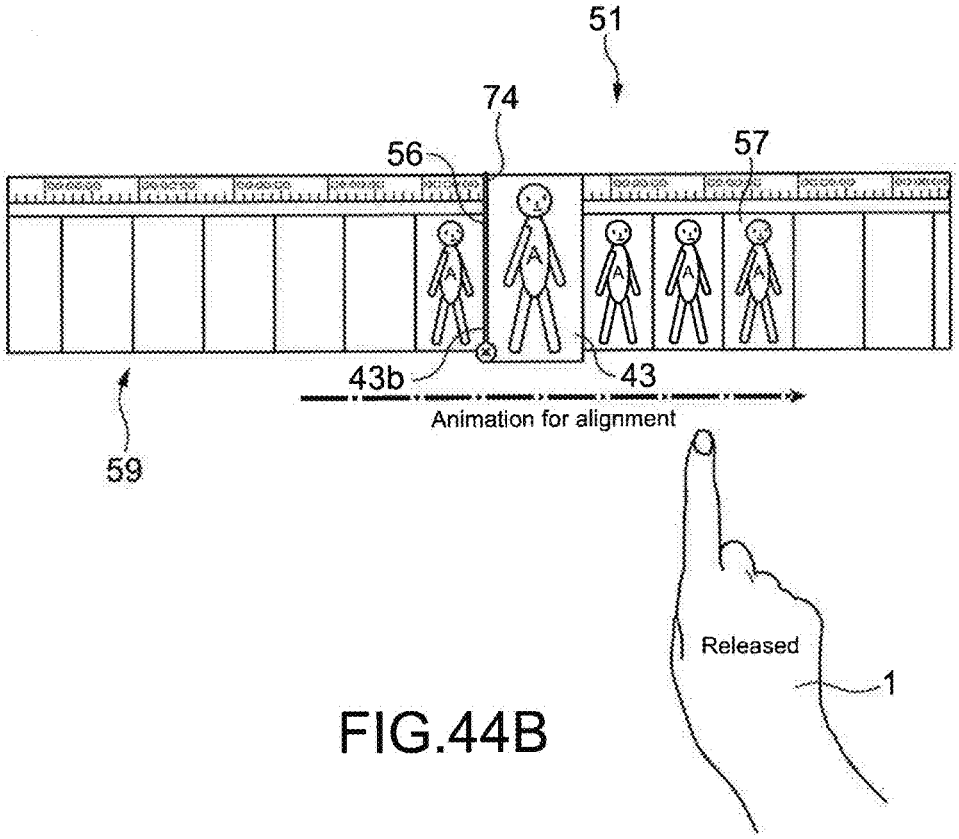

Additionally, when the drag operation is input and a finger of the user 1 is released, an end of the identical thumbnail image 57 arranged at the closest position to the pointer 56 may be automatically moved to the point position 74 of the pointer 56. For example, as shown in FIG. 44A, it is assumed that the drag operation is input until the pointer 56 overlaps the reference thumbnail image 43 and the finger of the user 1 is released at that position. In this case, as shown in FIG. 44B, the left end 43*b* of the reference thumbnail image 43 located closest to the pointer 56 may be automatically aligned with the point position 74. At that time, an animation in which the rolled film portion 59 is moved in the right direction is displayed. Note that the same processing may be performed on the other identical thumbnail images 57 other than the reference thumbnail image 43. This allows the operability on rolled film image 51 to be improved.

Figure 45:
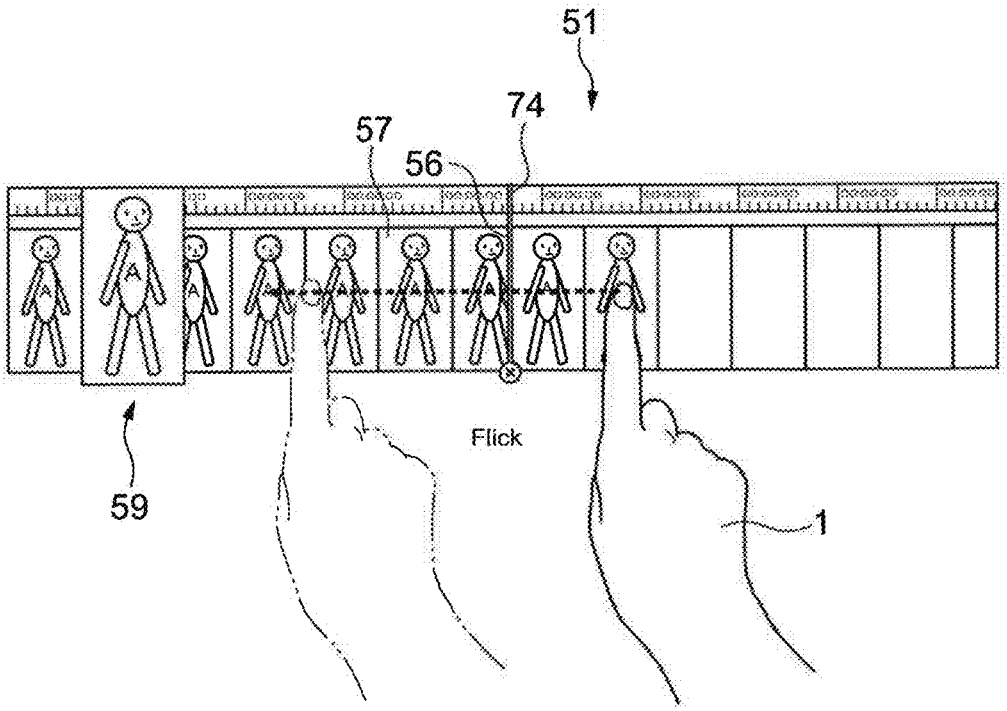
FIG. 45 is a diagram for describing the example of the configuration and the operation of the rolled film image.

As shown in FIG. 45, the point position 74 may also be moved by a flick operation. When a flick operation in the horizontal direction is input, a moving speed at a moment at which the finger of the user 1 is released is calculated. Based on the moving speed, the one or more identical thumbnail images 57 are moved in the flick direction with a constant deceleration. The pointer 56 is relatively moved in the direction opposite to the flick direction. The method of calculating the moving speed and the method of setting a deceleration are not limited, and well-known techniques may be used instead.

Next, the change of the standard, i.e., the scale, of the rolled film portion 59 will be described. FIGS. 46 to 56 are diagrams for describing the change. For example, it is assumed that a fixed size S1 is set for the size in the horizontal direction of each identical thumbnail image 57 arranged in the rolled film portion 59. A time assigned to the fixed size S1 is set as a standard of the rolled film portion 59. Under such settings, the operation and processing to change the standard of the rolled film portion 59 will be described. Note that the fixed size S1 may be set as appropriate based on the size of the UI screen, for example.

Figure 46:
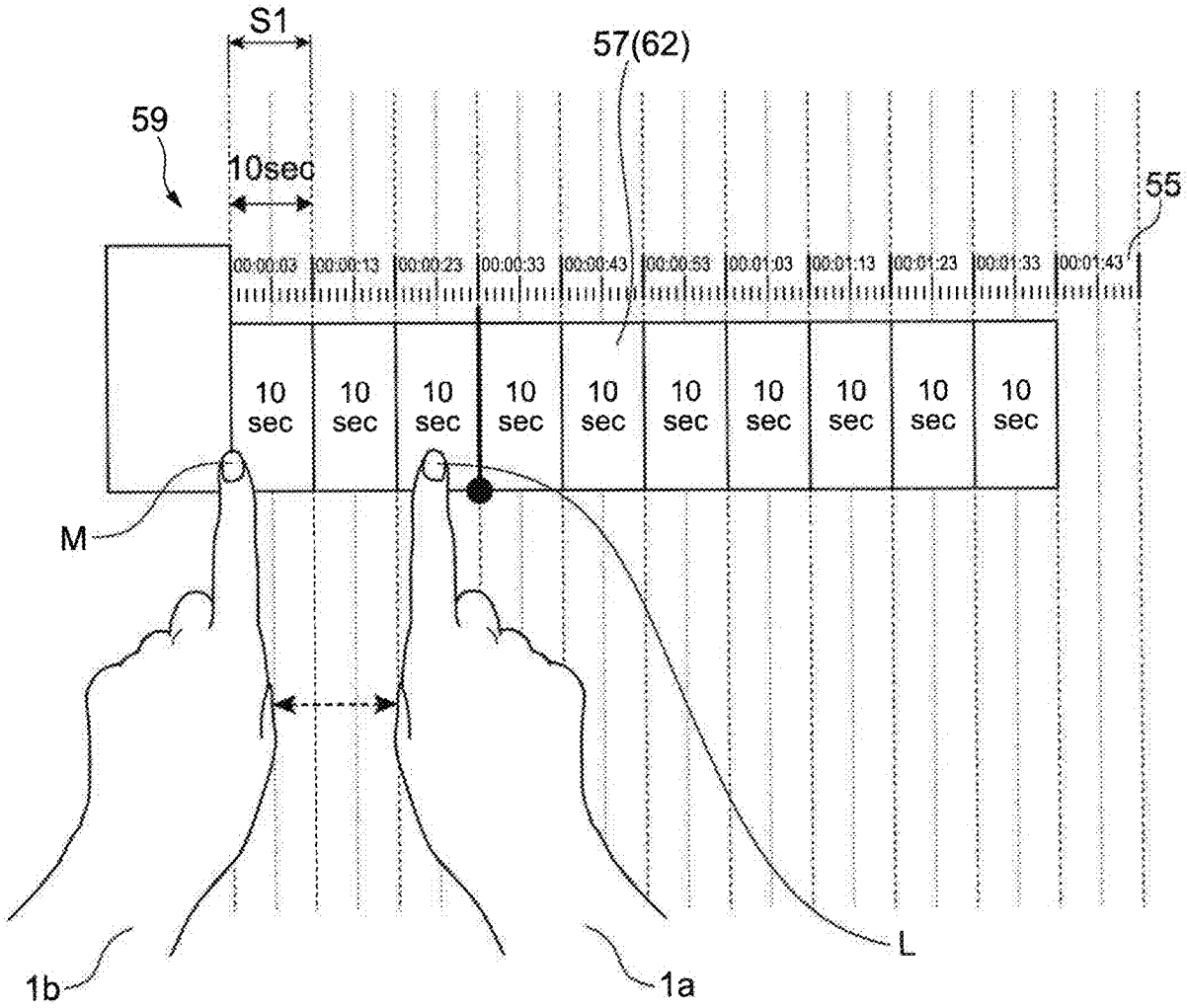
FIG. 46 is a diagram for describing a change in standard of a rolled film portion.

In FIG. 46, the standard of the rolled film portion 59 is set to 10 seconds. Consequently, the graduations of 10 seconds on the time axis 55 are assigned to the fixed size S1 of the identical thumbnail image 57. The display thumbnail image 62 displayed in the rolled film portion 59 is a thumbnail image 41 that is captured at a predetermined time in the assigned 10 seconds.

As shown in FIG. 46, a touch operation is input to two points L and M in the rolled film portion 59. Subsequently, right and left hands 1*a* and 1*b* are separated from each other so as to increase a distance between the touched points L and M in the horizontal direction. As shown in FIG. 46, the operation may be input with the right and left hands 1*a* and 1*b* or input by a pinch operation with two fingers of one hand. The pinch operation is a motion of the two fingers that simultaneously come into contact with the two points and open and close, for example.

Figure 47:
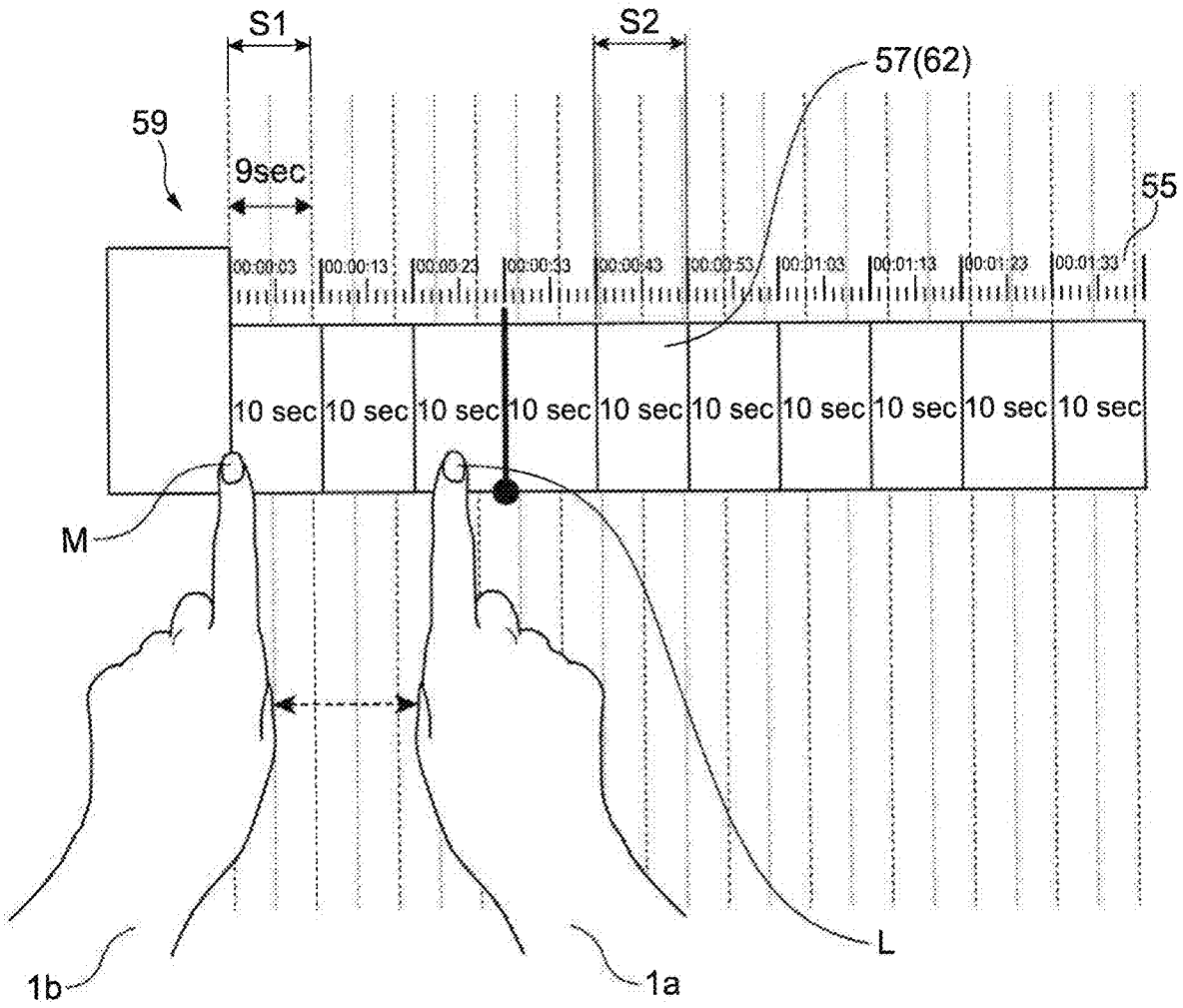
FIG. 47 is a diagram for describing a change in standard of the rolled film portion.

As shown in FIG. 47, in accordance with the increase of the distance between the two points L and M, the size S2 of each display thumbnail image 62 in the horizontal direction increases. For example, an animation in which each display thumbnail image 62 is increased in size in the horizontal direction is displayed in accordance with the operation with both of the hands. Along with the increase in size, a distance between the graduations, i.e., the size of graduations, on the time axis 55 also increases in the horizontal direction. As a result, the number of graduations assigned to the fixed size S1 decreases. FIG. 47 shows a state where the graduations of 9 seconds are assigned to the fixed size S1.

Figure 48:
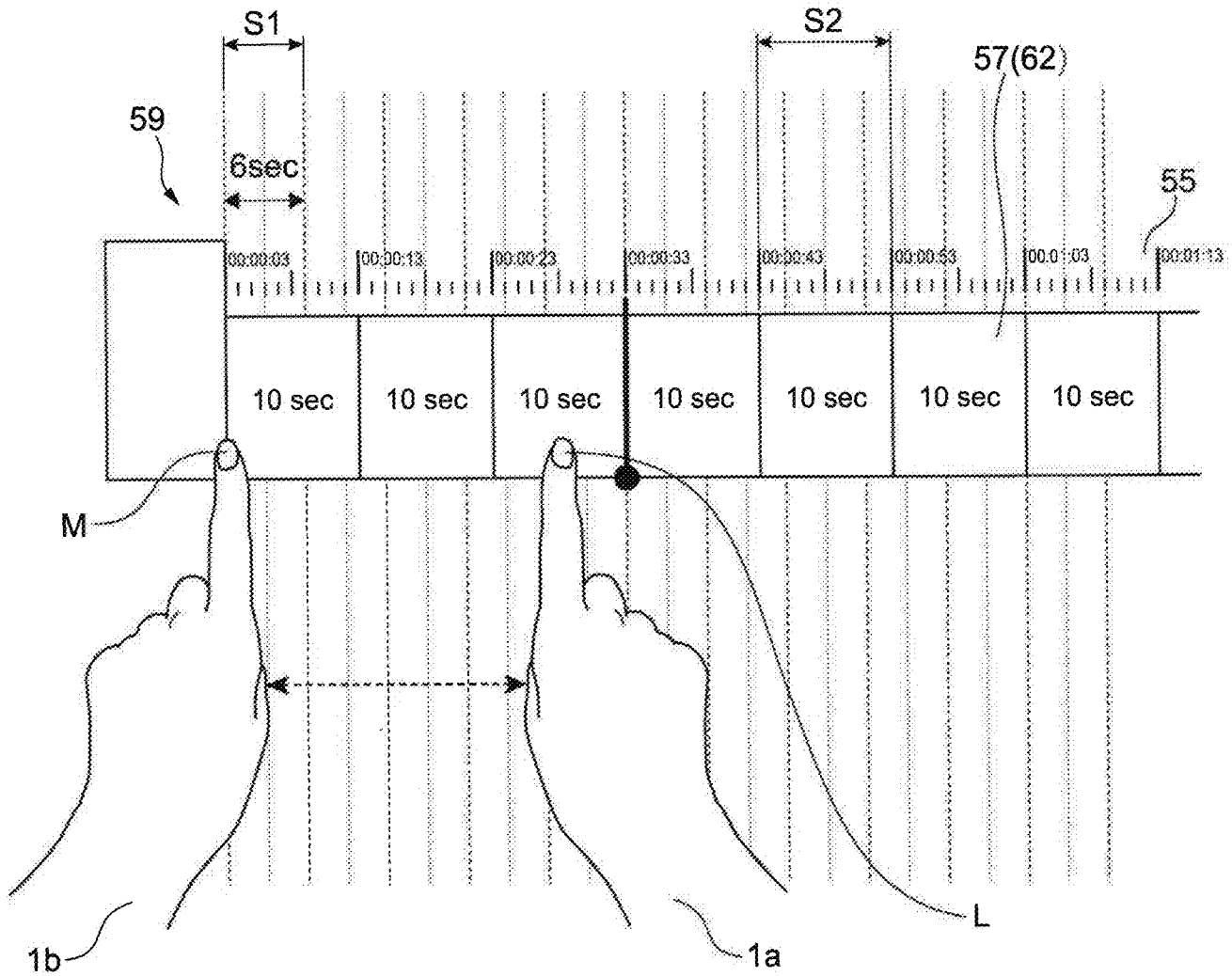
FIG. 48 is a diagram for describing a change in standard of the rolled film portion.
Figure 49:
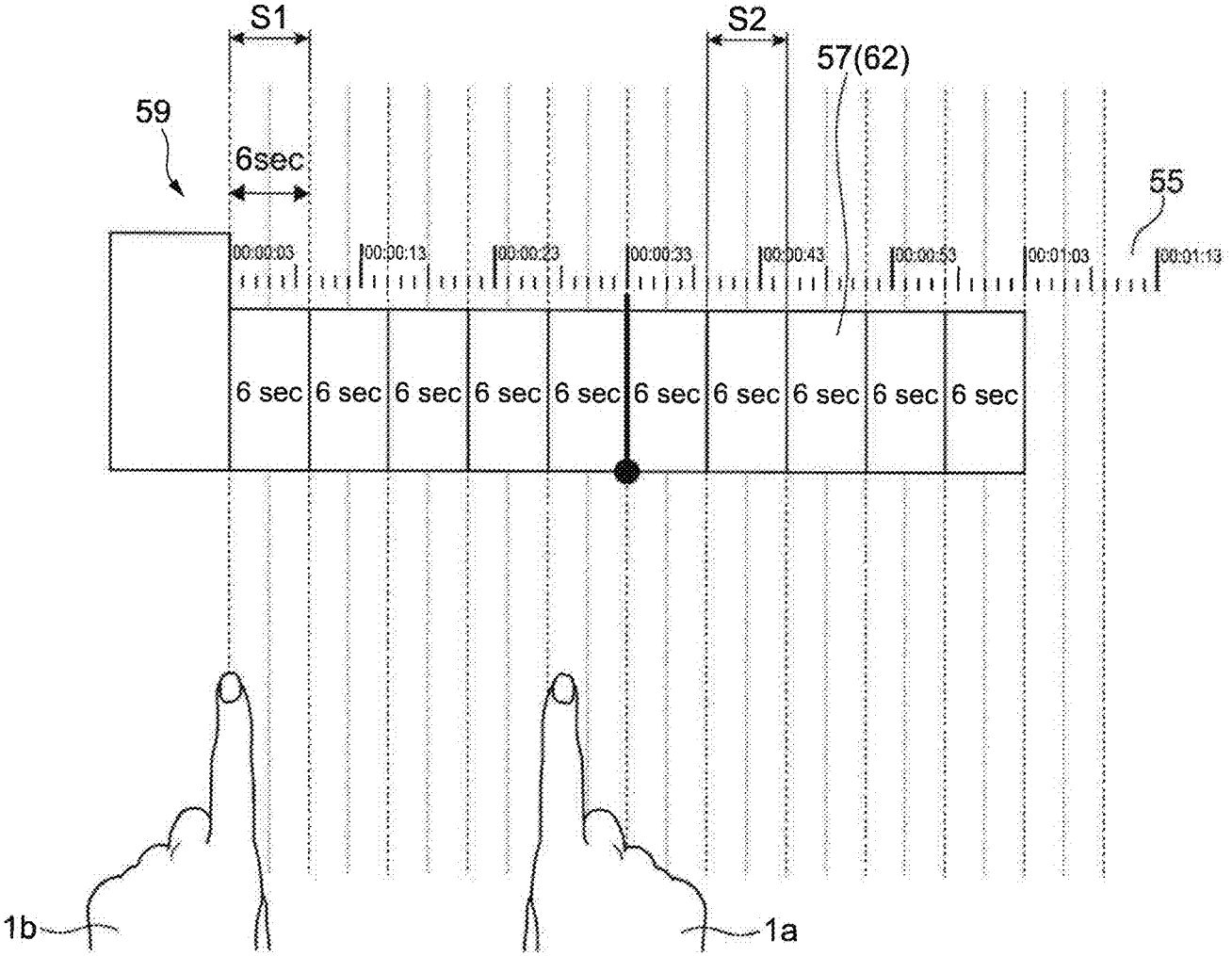
FIG. 49 is a diagram for describing a change in standard of the rolled film portion.
Figure 50:
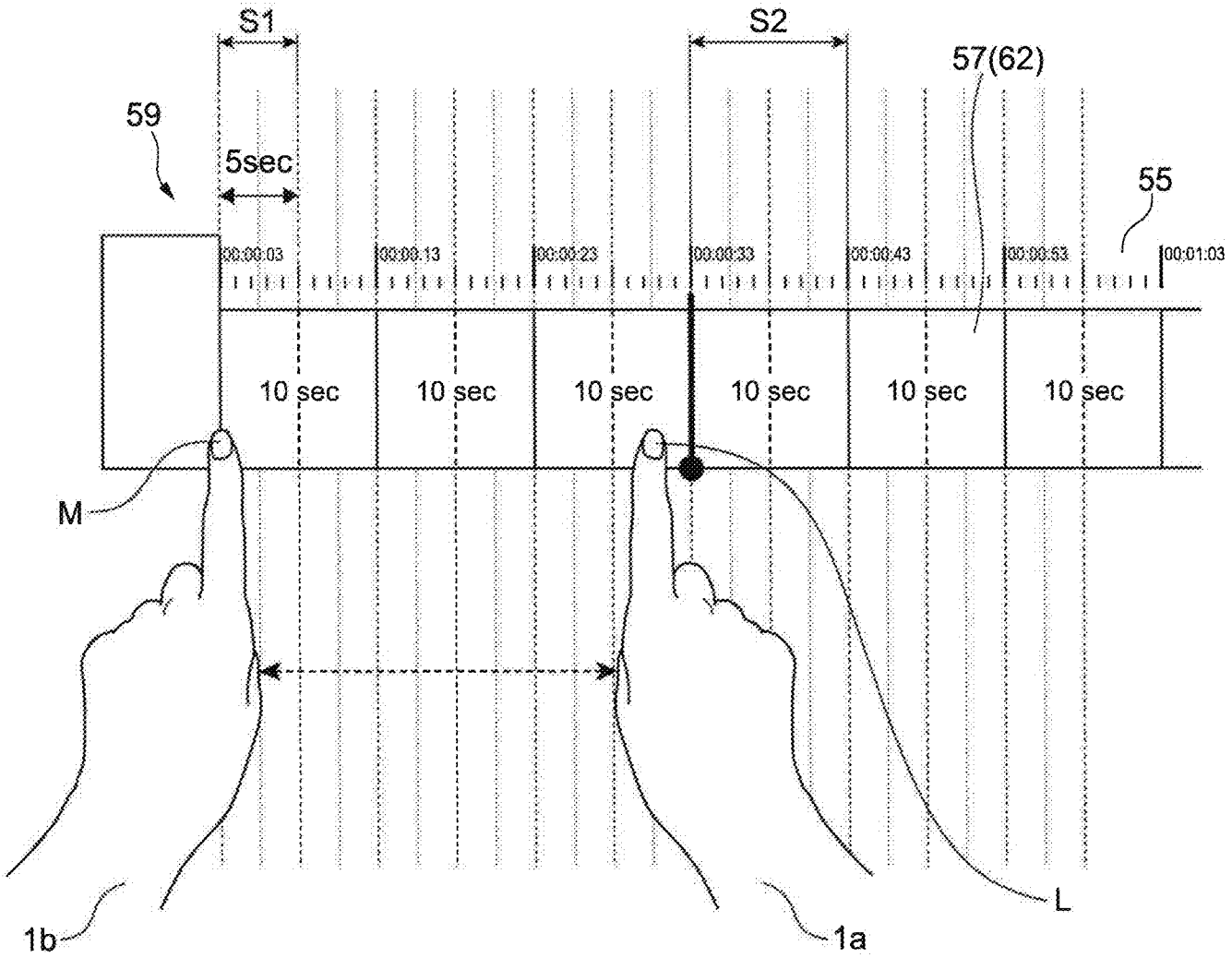
FIG. 50 is a diagram for describing a change in standard of the rolled film portion.

As shown in FIG. 48, the distance between the two points L and M is further increased, and both of the hands 1*a* and 1*b* are released in the state where the graduations of 6 seconds are assigned to the fixed size S1. As shown in FIG. 49, an animation in which the size S2 of each display thumbnail image 62 is changed to the fixed size S1 again is displayed. Subsequently, the standard of the rolled film portion 59 is set to 6 seconds. At that time, the thumbnail image 41 displayed as the display thumbnail image 62 may be selected anew from the identical thumbnail images 57.

Figure 51:
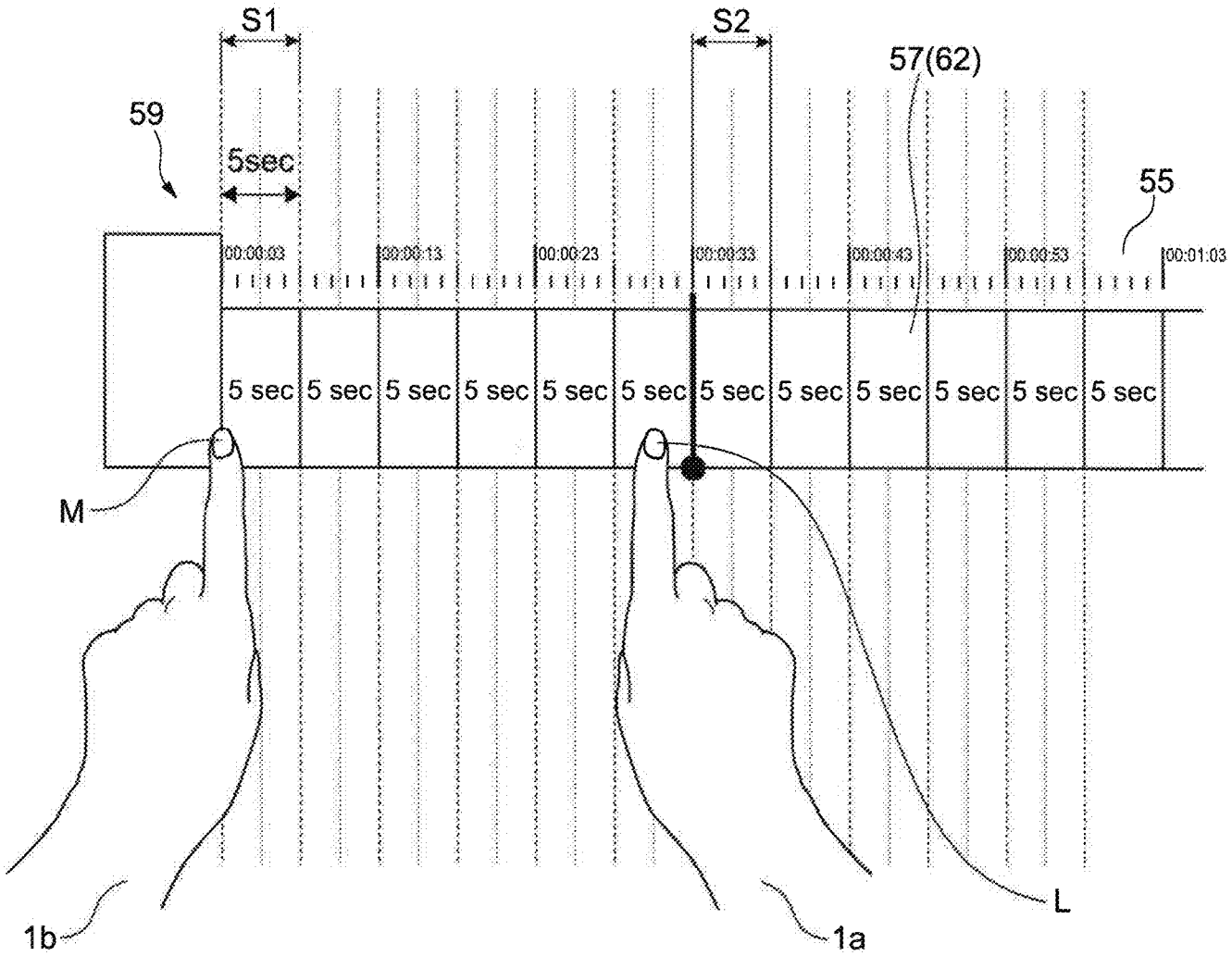
FIG. 51 is a diagram for describing a change in standard of the rolled film portion.

The shortest time that can be assigned to the fixed size S1 may be preliminarily set. At a time point when the distance between the two points L and M is increased to be longer than the size to which the shortest time is assigned, the standard of the rolled film portion 59 may be automatically set to the shortest time. For example, assuming that the shortest time is set to 5 seconds in FIG. 50, a distance in which the graduations of 5 seconds are assigned to the fixed size S1 is a distance in which the size S2 of the display thumbnail image 62 has the size twice as large as the fixed size S1. When the distance between the two points L and M is increased to be larger than the above-mentioned distance of the display thumbnail image 62, as shown in FIG. 51, the standard is automatically set to the shortest time, 5 seconds, if the right and left hands 1*a* and 1*b* are not released. Such processing allows the operability of the rolled film image 51 to be improved. Note that the time set to be the shortest time is not limited. For example, the standard set to the initial status may be used as a reference, and one-half or one-third of the time may be set to be the shortest time.

In the above description, the method of changing the standard of the rolled film portion 59 to be smaller, that is, the method of displaying the rolled film image 51 in detail has been described. Conversely, a change of the standard of the rolled film portion 59 to be larger to overview the rolled film image 51 is also allowed.

Figure 52:
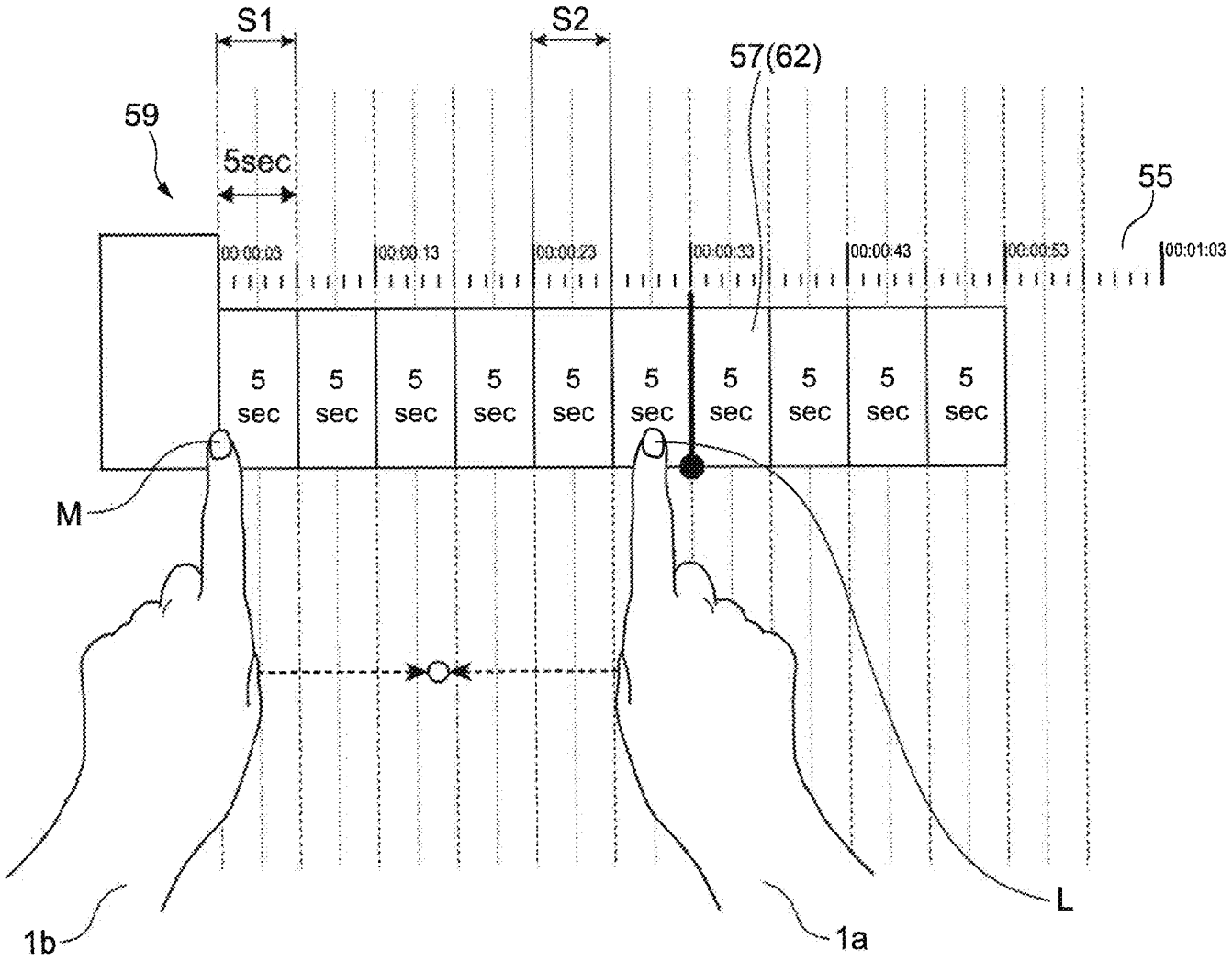
FIG. 52 is a diagram for describing a change in standard of the rolled film portion.

For example, as shown in FIG. 52, a touch operation is input with the right and left hands 1*a* and 1*b* in the state where the standard of the rolled film portion 59 is set to 5 seconds. Subsequently, the right and left hands 1*a* and 1*b* are brought close to each other so as to reduce the distance between the two points L and M. A pinch operation may be input with two fingers of one hand.

Figure 53:
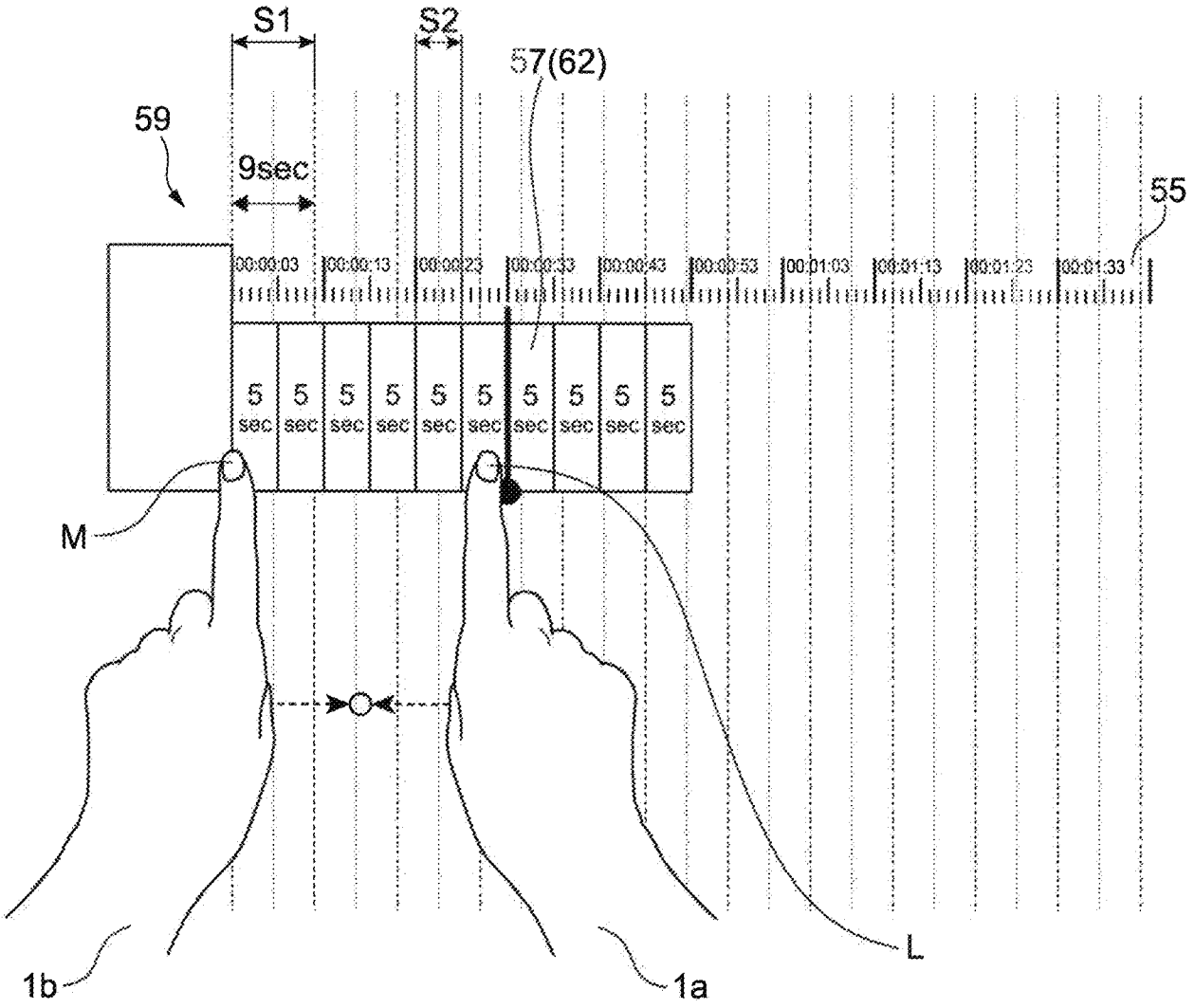
FIG. 53 is a diagram for describing a change in standard of the rolled film portion.
Figure 54:
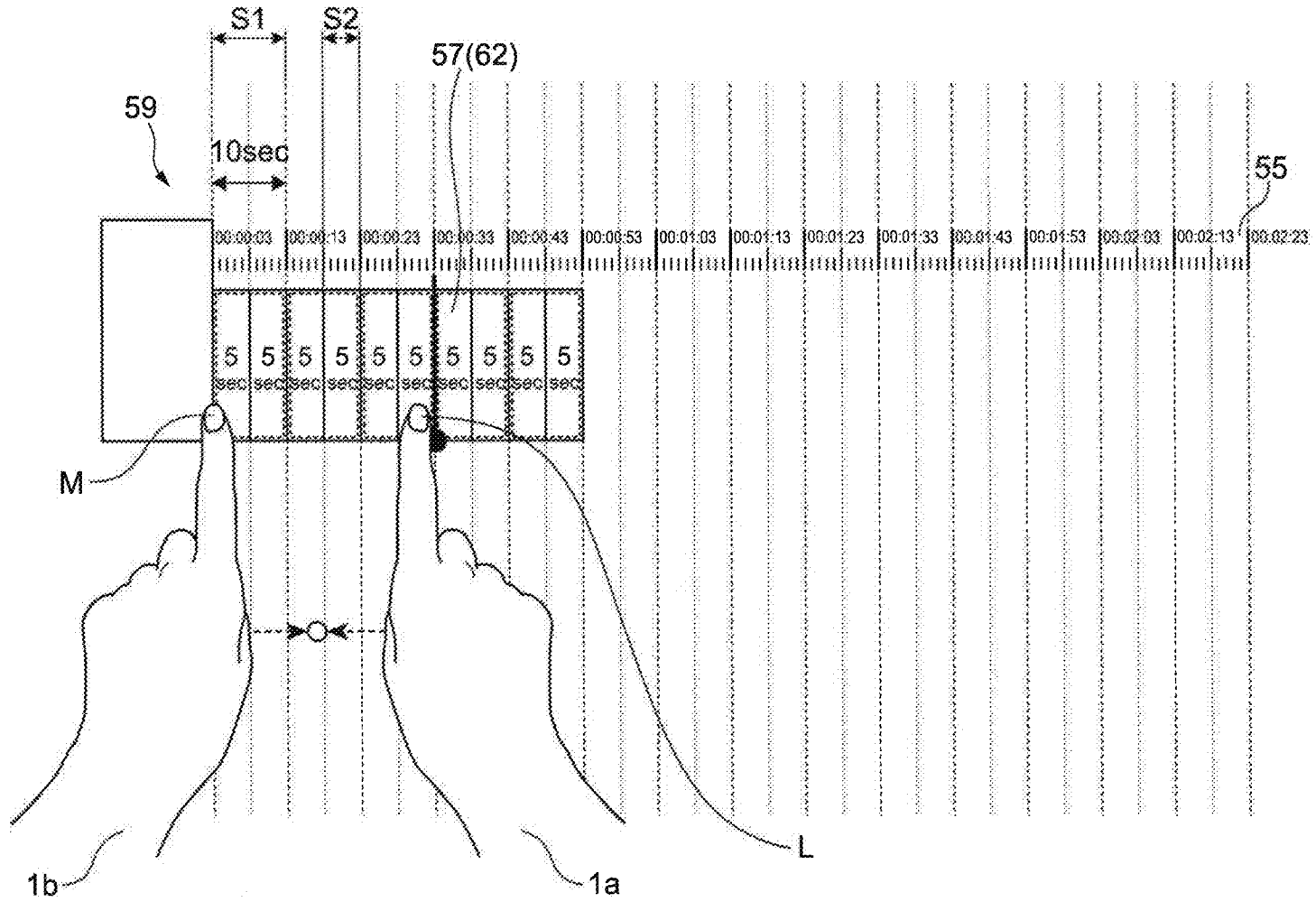
FIG. 54 is a diagram for describing a change in standard of the rolled film portion.

As shown in FIG. 53, in accordance with the decrease of the distance between the two points L and M, the size S2 of each display thumbnail image 62 and the size of each graduation of the time axis 55 decrease. As a result, the number of graduations assigned to the fixed size S1 increases. In FIG. 53, the graduations of 9 seconds are assigned to the fixed size S1. When the right and left hands 1*a* and 1*b* are released in the state where the distance between the two points L and M is reduced, the size S2 of each display thumbnail image 62 is changed to the fixed size S1 again. Subsequently, the time corresponding to the number of graduations assigned to the fixed size S1 when the hands are released is set as the standard of the rolled film portion 59. At that time, the thumbnail image 41 displayed as the display thumbnail image 62 may be selected anew from the identical thumbnail images 57.

Figure 55:
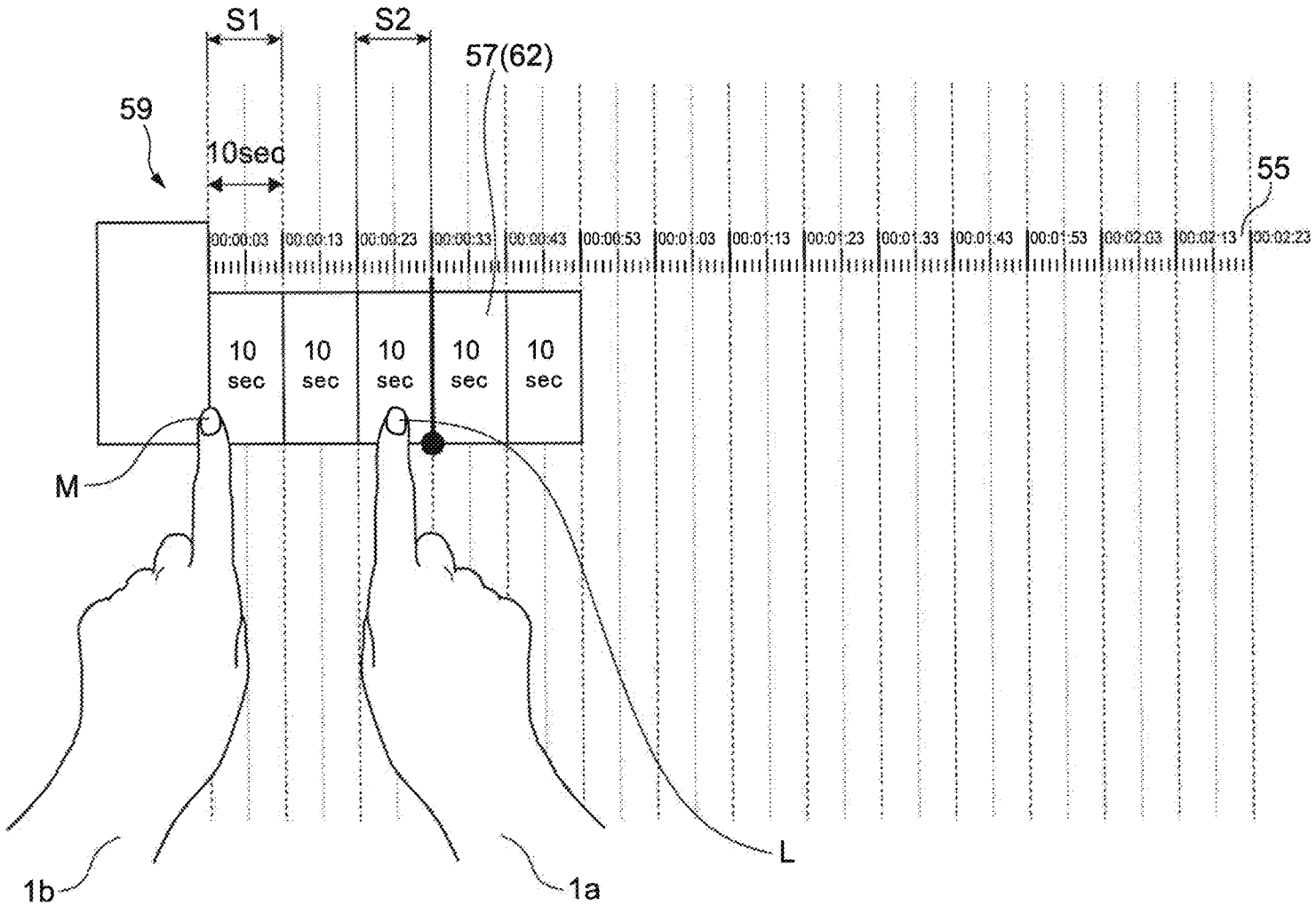
FIG. 55 is a diagram for describing a change in standard of the rolled film portion.
Figure 56:
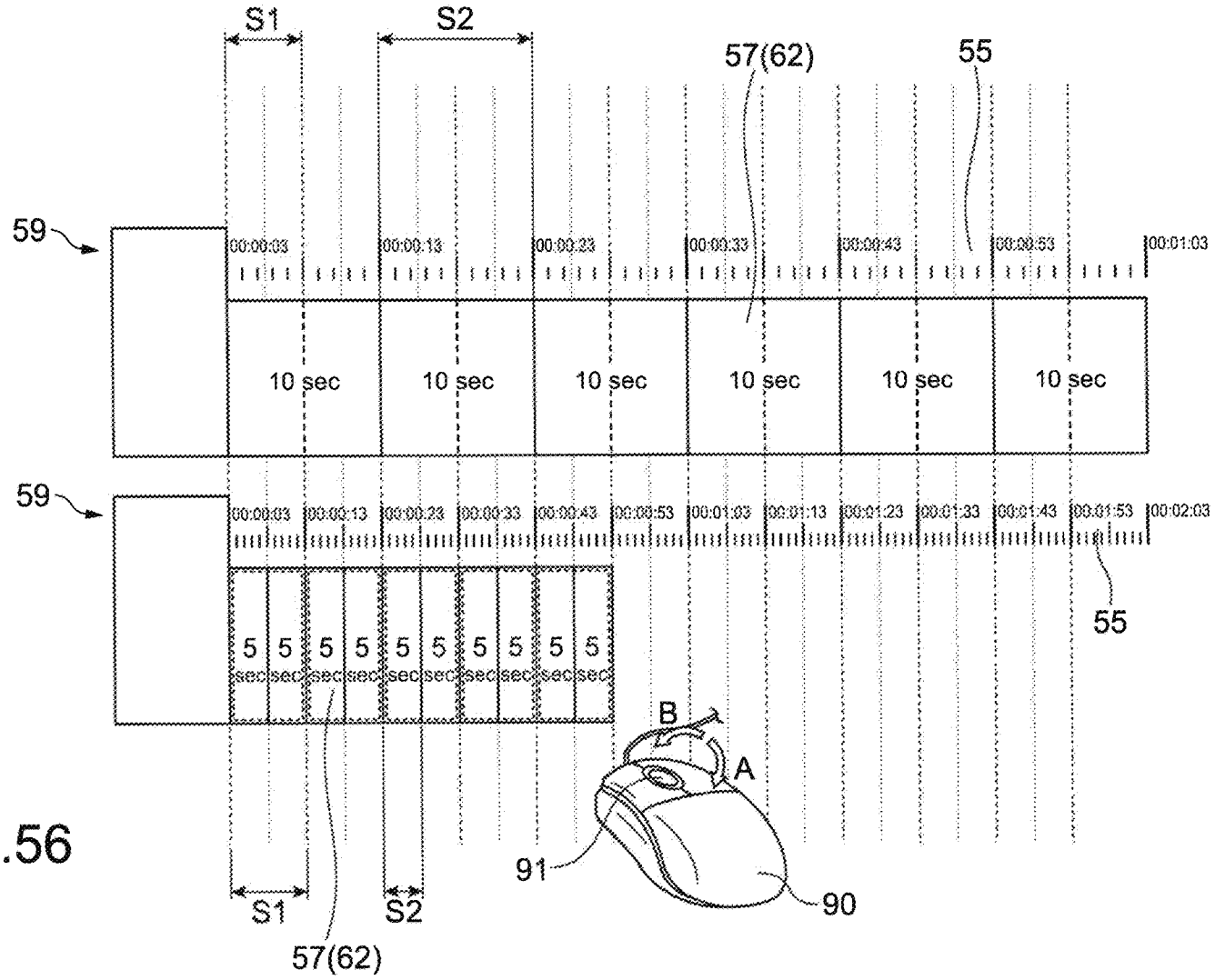
FIG. 56 is a diagram for describing a change in standard of the rolled film portion.

The longest time that can be assigned to the fixed size S1 may be preliminarily set. At a time point when the distance between the two points L and M is reduced to be shorter than the size to which the longest time is assigned, the standard of the rolled film portion 59 may be automatically set to the longest time. For example, assuming that the longest time is set to 10 seconds in FIG. 54, a distance in which the graduations of 10 seconds are assigned to the fixed size S1 is a distance in which the size S2 of the display thumbnail image 62 has half the size of the size S1. When the distance between the two points L and M is reduced to be smaller than the above-mentioned distance of the display thumbnail image 62, as shown in FIG. 55, the standard is automatically set to the longest time, 10 seconds, if the right and left hands 1*a* and 1*b* are not released. Such processing allows the operability of the rolled film image 51 to be improved. Note that the time set to be the longest time is not limited. For example, the standard set to the initial status may be a reference, and two or three times as long as the time may be set to be the longest time.

The standard of the rolled film portion 59 may be changed by an operation with a mouse. For example, as shown in the upper part of FIG. 56, a wheel button 91 of a mouse 90 is rotated toward the near side, i.e., in the direction of the arrow A. In accordance with the amount of the rotation, the size S2 of the display thumbnail image 62 and the size of the graduations are increased. When such a state is held for a predetermined period of time or more, the standard of the rolled film portion 59 is changed to have a smaller value. On the other hand, when the wheel button 91 of the mouse 90 is rotated to the deep side, i.e., in the direction of the arrow B, the size S2 of the display thumbnail image 62 and the size of the graduations are reduced in accordance with the amount of the rotation. When such a state is held for a predetermined period of time or more, the standard of the rolled film portion 59 is changed to have a larger value. Such processing can also be easily achieved. Note that the setting for the shortest time and the longest time described above can also be achieved. In other words, at the time point at which a predetermined amount or more of the rotation is added, the shortest time or the longest time only needs to be set as a standard of the rolled film portion 59 in accordance with the rotation direction.

Since such a simple operation allows the standard of the rolled film portion 59 to be changed, a suspicious person or the like can be sufficiently monitored along with the operation of the rolled film image 51. As a result, a useful surveillance camera system can be achieved.

Figure 57:
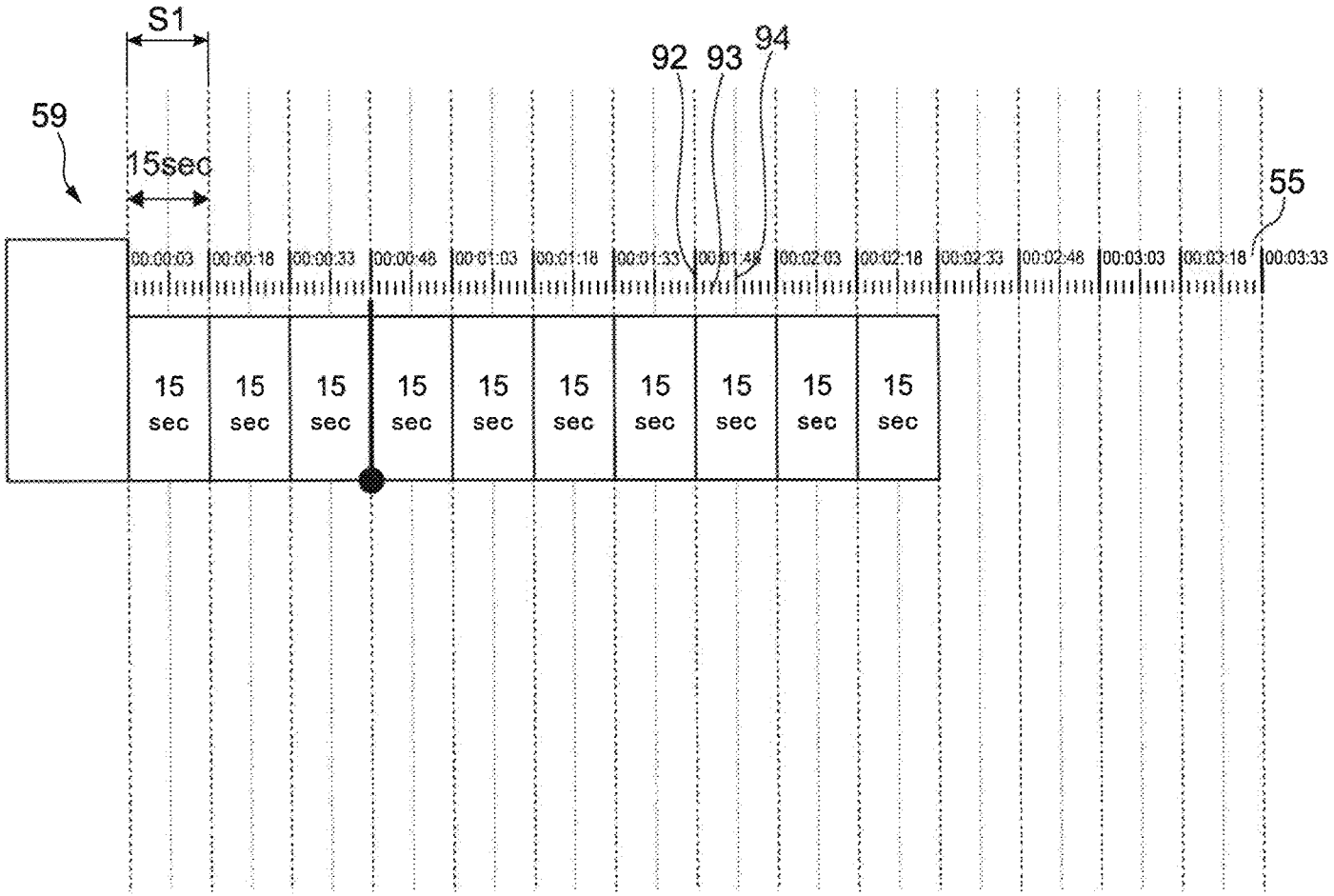
FIG. 57 is a diagram for describing a change in standard of graduations indicated on a time axis.

The standard of graduations displayed on the time axis 55, that is, the time standard can also be changed. For example, in the example shown in FIG. 57, the standard of the rolled film portion 59 is set to 15 seconds. Meanwhile, long graduations 92 with a large length, short graduations 93 with a short length, and middle graduations 94 with a middle length between the large and short lengths are provided on the time axis 55. One middle graduation 94 is arranged at the middle of the long graduations 92, and four short graduations 93 are arranged between the middle graduation 94 and the long graduation 92. In the example shown in FIG. 57, the fixed size S1 is set to be equal to the distance between the long graduations 92. Consequently, the time standard is set such that the distance between the long graduations 92 is set to 15 seconds.

Here, it is assumed that the time set for the distance between the long graduations 92 is preliminarily determined as follows: 1 sec, 2 sec, 5 sec, 10 sec, 15 sec, and 30 sec (mode in seconds); 1 min, 2 min, 5 min, 10 min, 15 min, and 30 min (mode in minutes); and 1 hour, 2 hours, 4 hours, 8 hours, and 12 hours (mode in hours). Specifically, it is assumed that the mode in seconds, the mode in minutes, and the mode in hours are set to be selectable and the times described above are each prepared as a time that can be set in each mode. Note that the time that can be set in each mode is not limited to the above-mentioned times.

Figure 58:
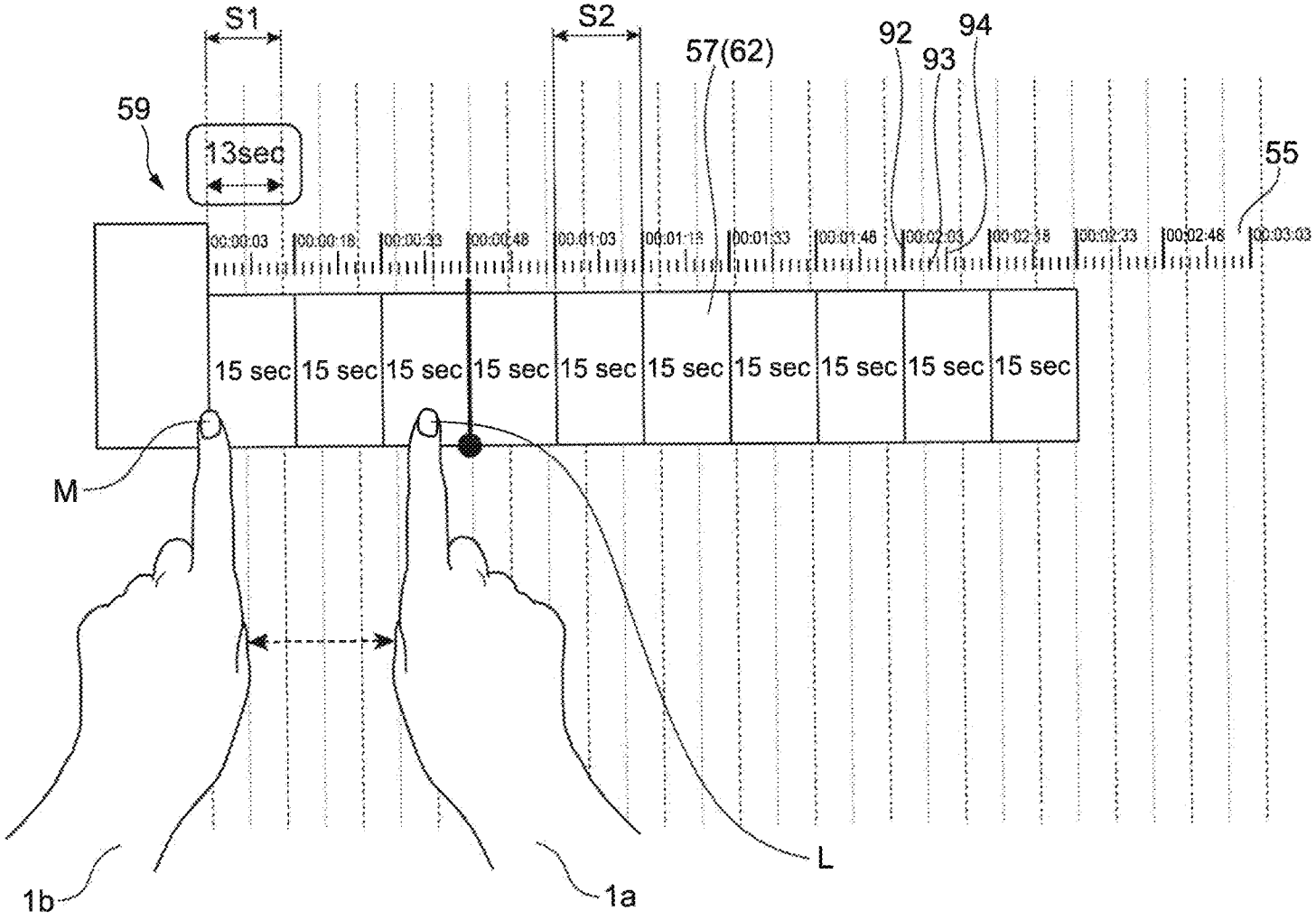
FIG. 58 is a diagram for describing a change in standard of graduations indicated on the time axis.
Figure 59:
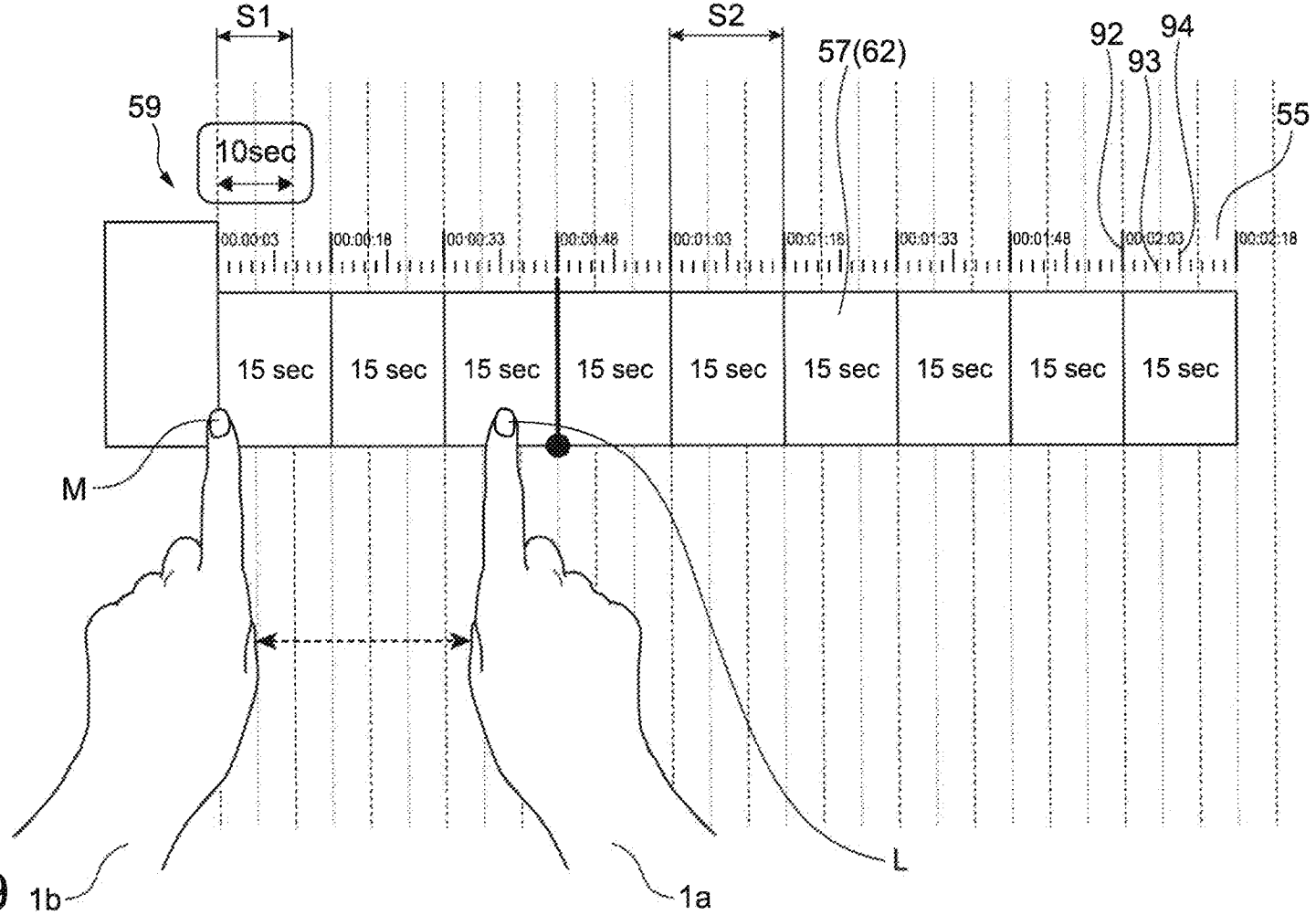
FIG. 59 is a diagram for describing a change in standard of graduations indicated on the time axis.
Figure 60:
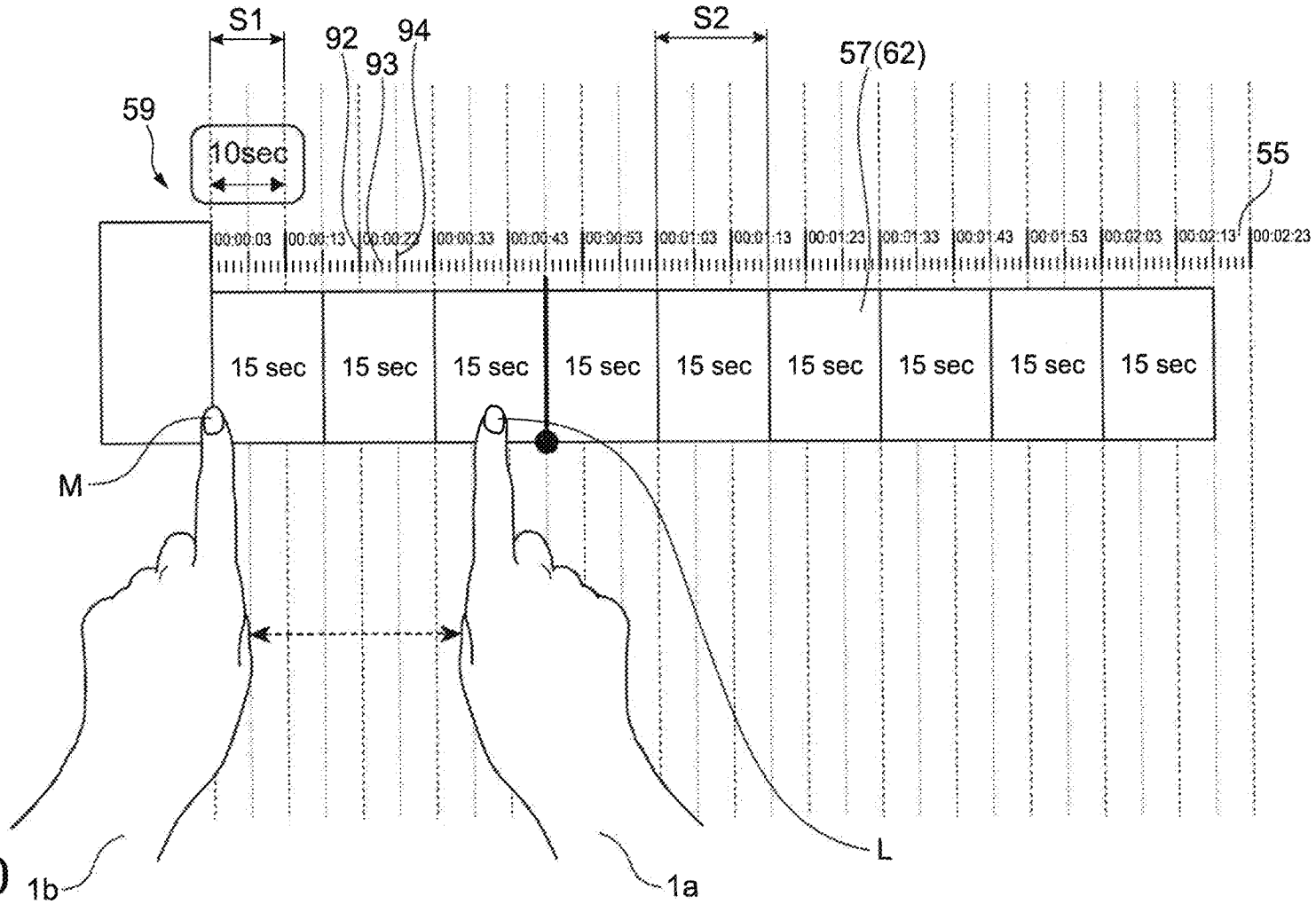
FIG. 60 is a diagram for describing a change in standard of graduations indicated on the time axis.

As shown in FIG. 58, a multi-touch operation is input to the two points L and M in the rolled film portion 59, and the distance between the two points L and M is increased. Along with the increase, the size S2 of the display thumbnail image 62 and the size of each graduation increase. In the example shown in FIG. 58, the time assigned to the fixed size S1 is set to 13 seconds. Because the value of "13 seconds" is not a preliminarily set value, the time standard is not changed. As shown in FIG. 59, the distance between the right and left hands 1*a* and 1 *b* is further increased, the time assigned to the fixed size S1 is set to 10 seconds. The value of "10 seconds" is a preliminarily set time. Consequently, at the time at which the assigned time is changed to be 10 seconds, as shown in FIG. 60, the time standard is changed such that the distance between the long graduations 92 is set to 10 seconds. Subsequently, two fingers of the right and left hands 1*a* and 1*b* are released, and the size of the display thumbnail image 62 is changed to the fixed size S1 again. At that time, the size of the graduations is reduced and displayed on the time axis 55. Alternatively, the distance between the long graduations 92 may be fixed and the size of the display thumbnail image 62 may be increased.

When the time standard is increased, the distance between the two points L and M only needs to be reduced. At the time point at which the time assigned to the fixed size S1 is set to 30 seconds preliminarily determined, the standard is changed such that the distance between the long graduations 92 is set to 30 seconds. Note that the operation described here is identical to the above-mentioned operation to change the standard of the rolled film portion 59. It may be determined as appropriate whether the operation to change the distance between the two points L and M may be used to change the standard of the rolled film portion 59 or to change the time standard. Alternatively, a mode to change the standard of the rolled film portion 59 and a mode to change the time standard may be set to be selectable. Appropriately selecting the mode may allow the standard of the rolled film portion 59 and the time standard to be appropriately changed.

Figure 61:
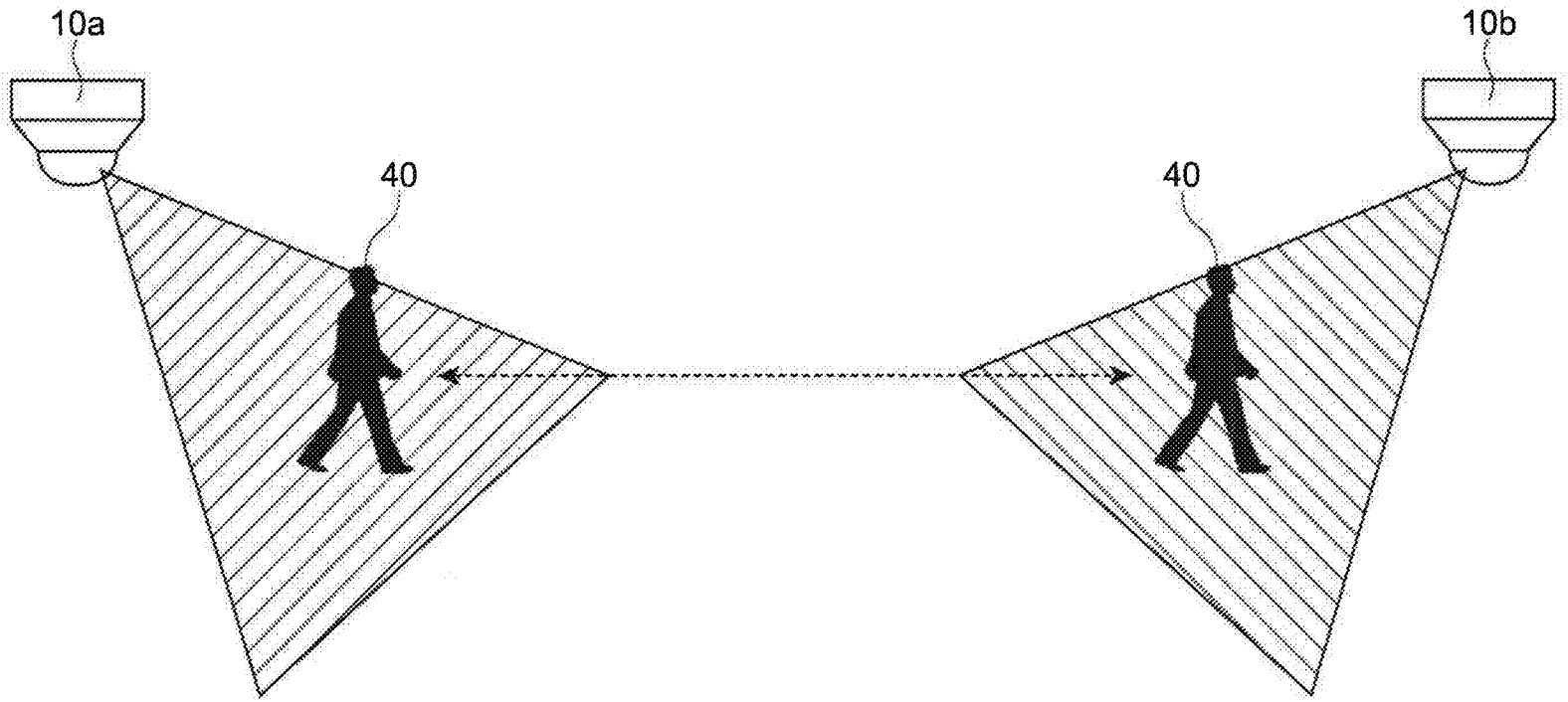
FIG. 61 is a diagram for describing an example of an algorithm of person tracking under an environment using a plurality of cameras.
Figure 62:
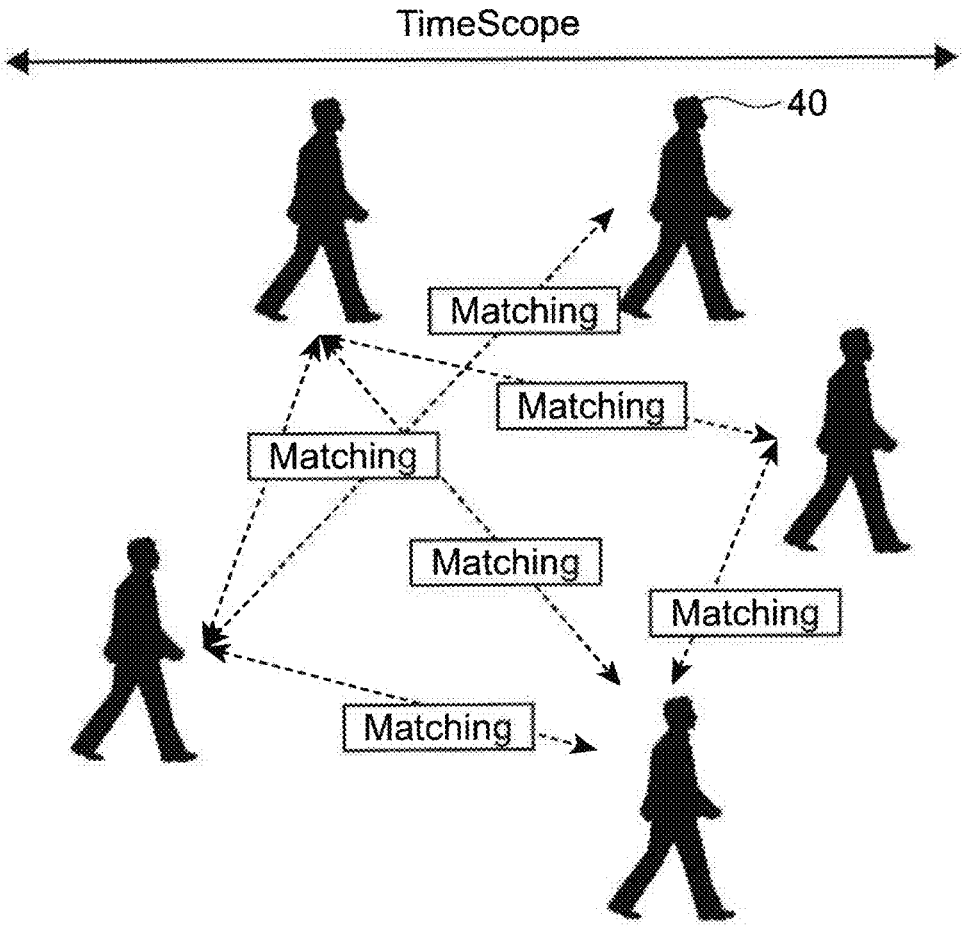
FIG. 62 is a diagram for describing the example of the algorithm of person tracking under the environment using the plurality of cameras.

As described above, in the surveillance camera system 100 according to an embodiment, the plurality of cameras 10 are used. Here, an example of the algorithm of the person tracking under an environment using a plurality of cameras will be described. FIGS. 61 and 62 are diagrams for describing the outline of the algorithm. For example, as shown in FIG. 61, an image of the person 40 is captured with a first camera 10*a*, and another image of the person 40 is captured later with a second camera 10*b* that is different from the first camera 10*a*. In such a case, whether the persons captured with the respective surveillance cameras 10*a* and 10*b* are identical or not is determined by the following person tracking algorithm. This allows the tracking of the person 40 across the coverage of the cameras 10*a* and 10*b*.

As shown in FIG. 62, in the algorithm described herein, the following two prominent types of processing are executed so as to track a person with a plurality of cameras.

1. One-to-one matching processing for detected persons 40

2. Calculation of optimum combinations for the whole of one or more persons 40 in close time range, i.e., in Time-Scope shown in FIG. 62

Specifically, one-to-one matching processing is performed on a pair of the persons in a predetermined range. By the matching processing, a score on the degree of similarity is calculated for each pair. Together with such processing, an optimization is performed on a combination of persons determined to be identical to each other.

Figure 63:
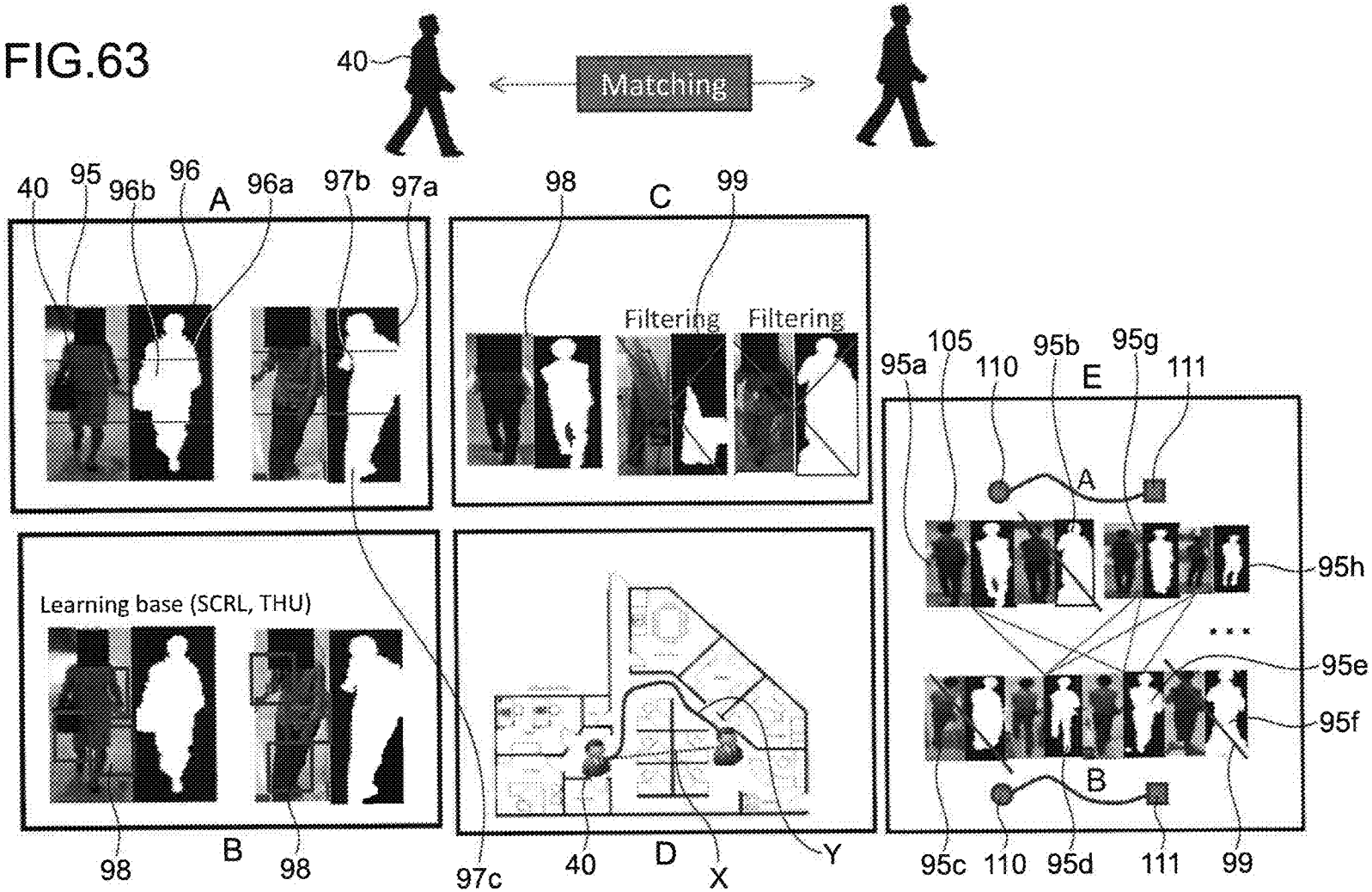
FIG. 63 is a diagram including photographs, showing an example of one-to-one matching processing.

FIG. 63 shows pictures and diagrams showing an example of the one-to-one matching processing. Note that a face portion of each person is taken out in each picture. This is processing for privacy protection of the persons who appear in the pictures used herein and has no relation with the processing executed in an embodiment of the present disclosure. Additionally, the one-to-one matching processing is not limited to the following one and any technique may be used instead.

As shown in a frame A, edge detection processing is performed on an image 95 of the person 40 (hereinafter, referred to as person image 95), and an edge image 96 is generated. Subsequently, matching is performed on color information of respective pixels in inner areas 96*b* of edges 96*a* of the persons. Specifically, the matching processing is performed by not using the entire image 95 of the person 40 but using the color information of the inner area 96*b* of the edge 96*a* of the person 40. Additionally, the person image 95 and the edge image 96 are each divided into three areas in the vertical direction. Subsequently, the matching processing is performed between upper areas 97*a*, between middle areas 97*b*, and between lower areas 97*c*. In such a manner, the matching processing is performed for each of the partial areas. This allows highly accurate matching processing to be executed. Note that the algorithm used for the edge detection processing and for the matching processing in which the color information is used is not limited.

As shown in a frame B, an area to be matched 98 may be selected as appropriate. For example, based on the results of the edge detection, areas including identical parts of bodies may be detected and the matching processing may be performed on those areas.

As shown in a frame C, out of images detected as the person images 95, an image 99 that is improper as a matching processing target may be excluded by filtering and the like. For example, based on the results of the edge detection, an image 99 that is improper as a matching processing target is determined. Additionally, the image 99 that is improper as a matching processing target may be determined based on the color information and the like. Executing such filtering and the like allows highly accurate matching processing to be executed.

As shown in a frame D, based on person information and map information stored in the storage unit, information on a travel distance and a travel time of the person 40 may be calculated. For example, not a distance represented by a straight line X and a travel time of the distance but a distance and a travel distance associated with the structure, paths, and the like of an office are calculated (represented by curve Y). Based on the information, a score on the degree of similarity is calculated or a predetermined range (TimeScope) may be set. For example, based on the arrangement positions of the cameras 10 and the information on the distance and the travel time, a time at which one person is sequentially imaged with each of two cameras 10. With the calculation results, a possibility that the person imaged with the two cameras 10 is identical may be determined.

As shown in a frame E, a person image 105 that is most suitable for the matching processing may be selected when the processing is performed. In the present disclosure, a person image 95 at a time point 110 at which the detections is started, that is, at which the person 40 appears, and a person image 95 at a time point 111 at which the detection is ended, that is, at which the person 40 disappears, are used for the matching processing. At that time, the person images 105 suitable for the matching processing are selected as the person images 95 at the appearance point 110 and the disappearance point 111, from a plurality of person images 95 generated from the plurality of frame images 12 captured at times close to the respective time points. For example, a person image 95*a* is selected from the person images 95*a* and 95*b* to be an image of the person A at the appearance point 110 shown in the frame E. A person image 95*d* is selected from the person images 95*c* and 95*d* to be an image of the person B at the appearance point 110. A person image 95*e* is selected from the person images 95*e* and 95*f* to be an image of the person B at the disappearance point 111. Note that two person images 95*g* and 95*h* are adopted as the images of the person A at the disappearance point 111. In such a manner, a plurality of images determined to be suitable for the matching processing, that is, images having high scores, may be selected, and the matching processing may be executed in each image. This allows highly accurate matching processing to be executed.

Figure 64:
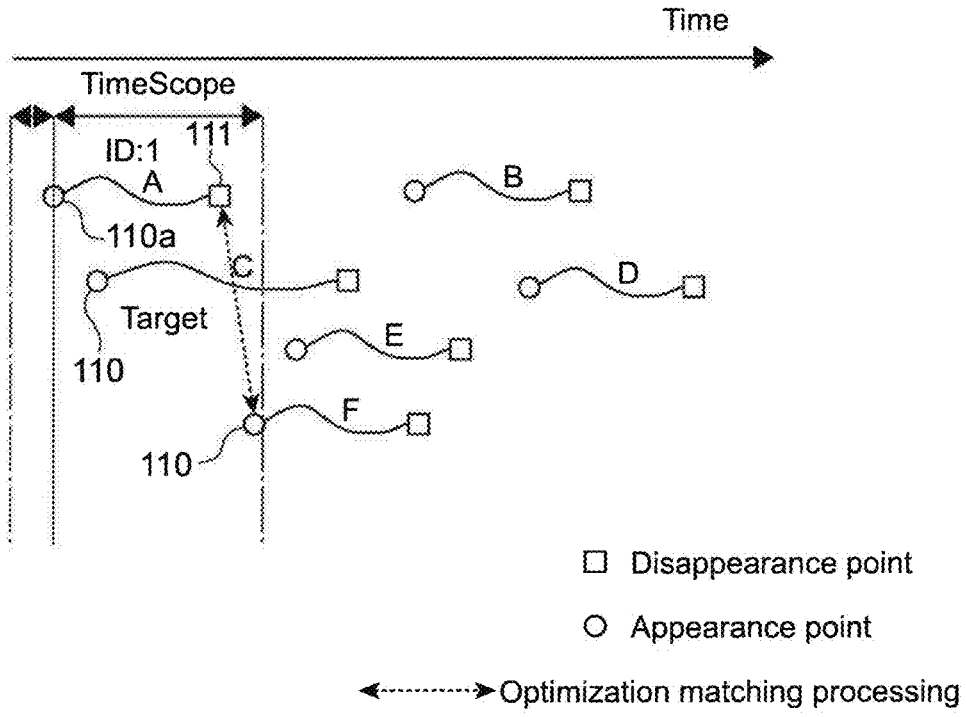
FIG. 64 is a schematic diagram showing an application example of the algorithm of person tracking according to an embodiment of the present disclosure.
Figure 70:
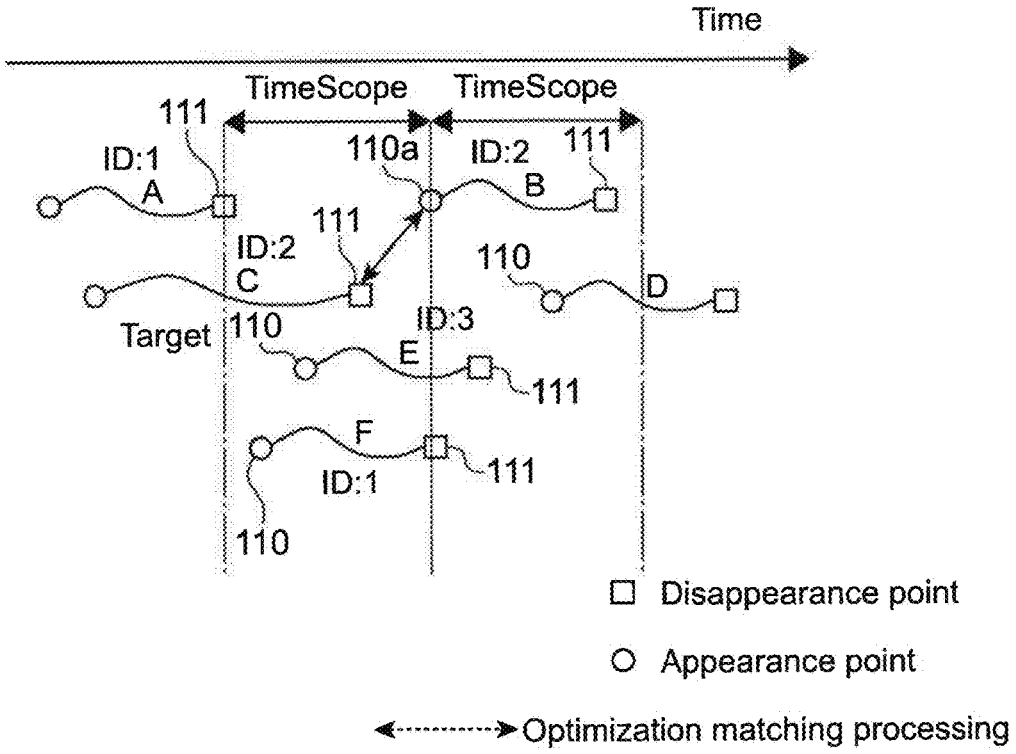
FIG. 70 is a schematic diagram showing an application example of the algorithm of person tracking according to an embodiment of the present disclosure.

FIGS. 64 and 70 are schematic diagrams each showing an application example of the algorithm of the person tracking according to an embodiment of the present disclosure. Here, which tracking ID is set for the person image 95 at the appearance point 110 (hereinafter, referred to as appearance point 110, omitting "person image 95") is determined. Specifically, if the person at the appearance point 110 is identical to the person appearing in the person image 95 at the past disappearance point 111 (hereinafter, referred to as disappearance point 111, omitting "person image 95"), the same ID is set continuously. If the person is new, a new ID is set for the person. So, a disappearance point 111 and an appearance point 110 later than the disappearance point 111 are used to perform the one-to-one matching processing and the optimization processing. Hereinafter, the matching processing and the optimization processing are referred to as optimization matching processing.

Firstly, an appearance point 110*a* for which the tracking ID is set is assumed to be a reference, and TimeScope is set in a past/future direction. The optimization matching processing is performed on appearance points 110 and disappearance points 111 in the TimeScope. As a result, when it is determined that there is no tracking ID to be assigned to the reference appearance point 110*a*, a new tracking ID is assigned to the appearance point 110*a*. On the other hand, when it is determined that there is a tracking ID to be assigned to the reference appearance point 110*a*, the tracking ID is continuously assigned. Specifically, when the tracking ID is determined to be identical to the ID of the past disappearance point 111, the ID assigned to the disappearance point 111 is continuously assigned to the appearance point 110.

Figure 65:
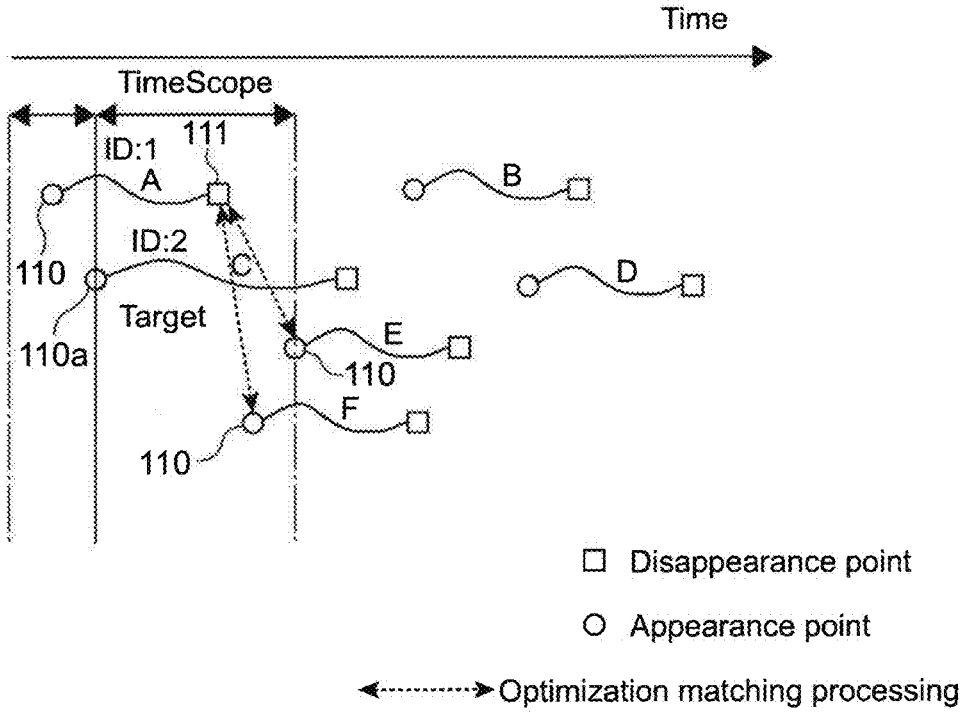
FIG. 65 is a schematic diagram showing an application example of the algorithm of person tracking according to an embodiment of the present disclosure.

In the example shown in FIG. 64, the appearance point 110*a* of the person A is set to be a reference and the TimeScope is set. The optimization matching processing is performed on a disappearance point 111 of the person A and an appearance point 110 of a person F in the TimeScope. As a result, it is determined that there is no ID to be assigned to the appearance point 110*a* of the person A, and a new ID:1 is assigned to the appearance point 110*a*. Next, as shown in FIG. 65, an appearance point 110*a* of a person C is set to be a reference and the TimeScope is selected. Subsequently, the optimization matching processing is performed on the disappearance point 111 of the person A and each of later appearance points 10. As a result, it is determined that there is no ID to be assigned to the appearance point 110*a* of the person C, and a new ID:2 is assigned to the appearance point 110*a* of the person C.

Figure 66:
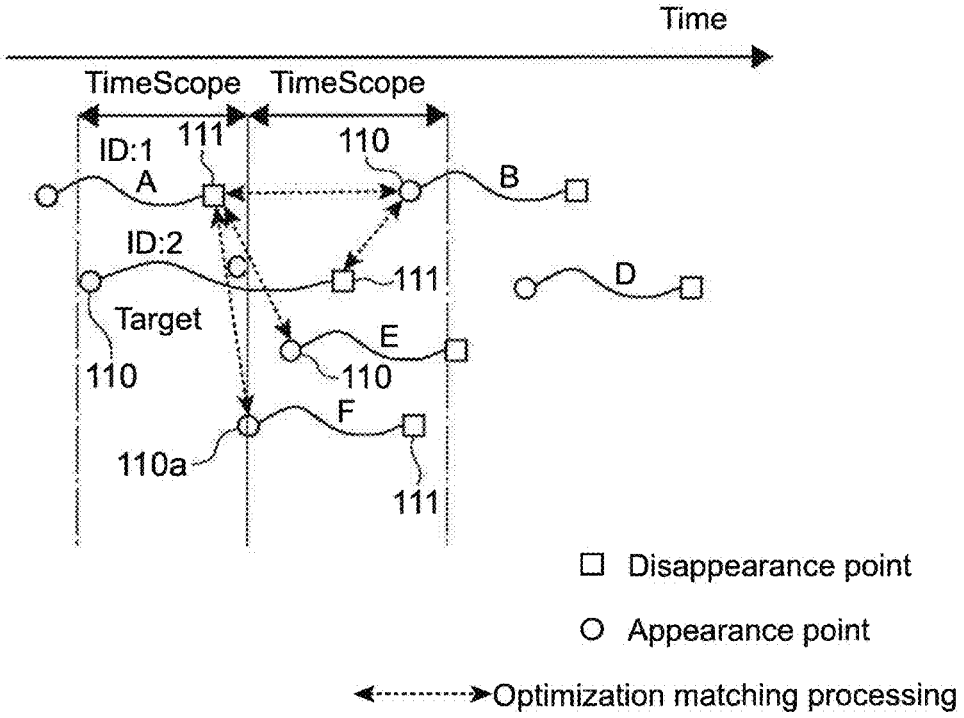
FIG. 66 is a schematic diagram showing an application example of the algorithm of person tracking according to an embodiment of the present disclosure.
Figure 67:
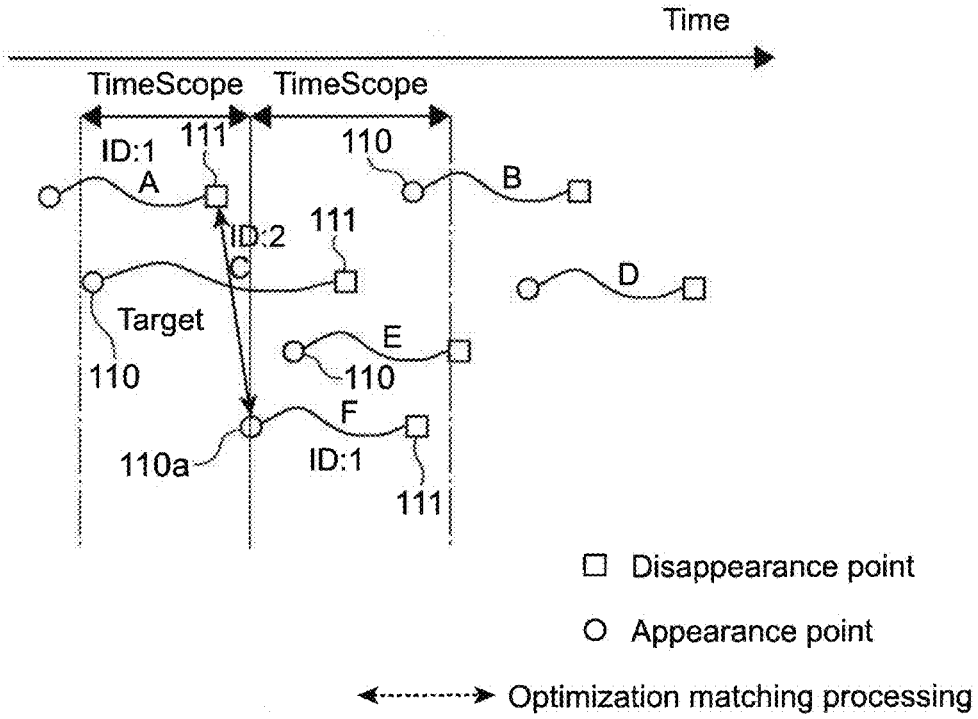
FIG. 67 is a schematic diagram showing an application example of the algorithm of person tracking according to an embodiment of the present disclosure.

As shown in FIG. 66, an appearance point 110*a* of the person F is set to be a reference and the TimeScope is selected. The optimization matching processing is performed on the disappearance point 111 of the person A and each of later appearance points 110. Further, the optimization matching processing is performed on a disappearance point 111 of the person C and each of later appearance points 110. As a result, for example, as shown in FIG. 67, it is determined that the ID:1, which is the tracking ID of the disappearance point 111 of the person A, is assigned to the appearance point 110*a* of the person F. Specifically, in this case, the person A and the person F are determined to be identical.

Figure 68:
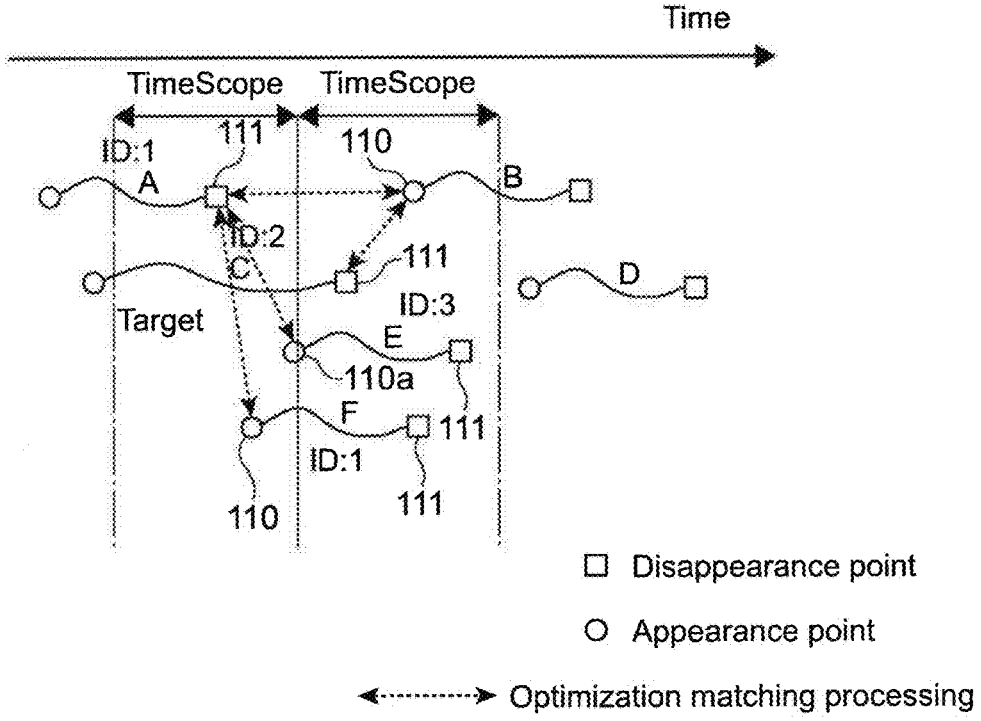
FIG. 68 is a schematic diagram showing an application example of the algorithm of person tracking according to an embodiment of the present disclosure.

As shown in FIG. 68, an appearance point 110*a* of a person E is set to be a reference and the TimeScope is selected. The optimization matching processing is performed on the disappearance point 111 of the person A and each of later appearance points 110. Further, the optimization matching processing is performed on the disappearance point 111 of the person C and each of later appearance points 110. As a result, it is determined that there is no ID to be assigned to the appearance point 110*a* of the person E, and a new ID:3 is assigned to the appearance point 110*a* of the person E.

Figure 69:
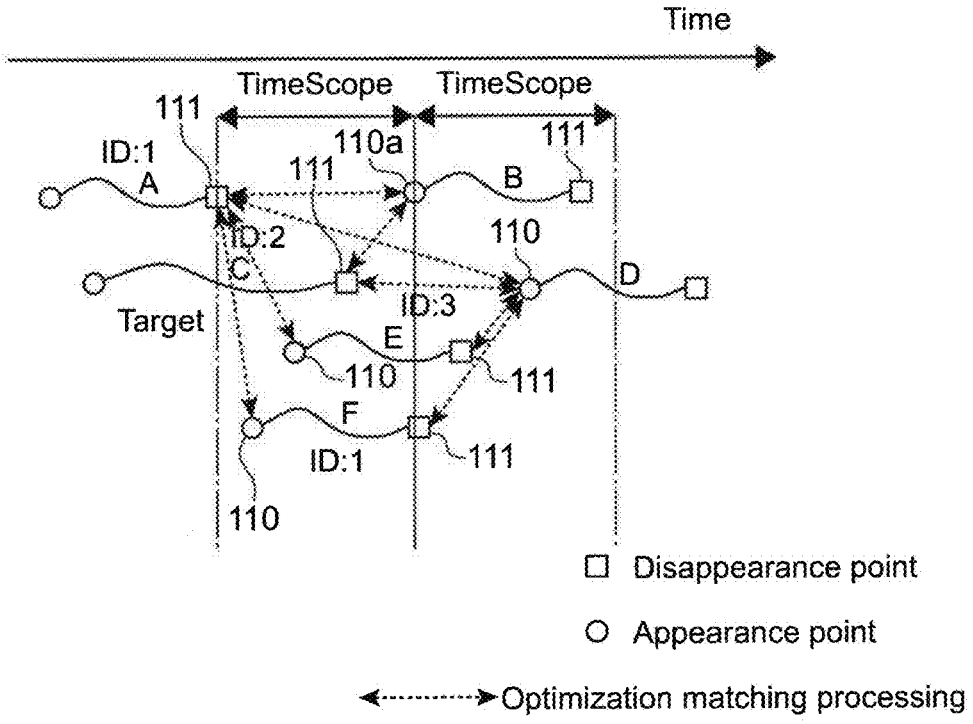
FIG. 69 is a schematic diagram showing an application example of the algorithm of person tracking according to an embodiment of the present disclosure.

As shown in FIG. 69, an appearance point 110*a* of the person B is set to be a reference and the TimeScope is selected. The optimization matching processing is performed on the disappearance point 111 of the person A and each of later appearance points 110. Further, the optimization matching processing is performed on the disappearance point 111 of the person C and each of later appearance points 110. Furthermore, the optimization matching processing is performed on a disappearance point 111 of the person F and each of later appearance points 110. Furthermore, the optimization matching processing is performed on a disappearance point 111 of the person E and each of later appearance points 110. As a result, for example, as shown in FIG. 70, it is determined that the ID:2, which is the tracking ID of the disappearance point 111 of the person C, is assigned to the appearance point 110*a* of the person B. Specifically, in this case, the person C and the person B are determined to be identical. For example, in such a manner, the person tracking under the environment using the plurality of cameras is executed.

Hereinabove, in the information processing apparatus (server apparatus 20) according to an embodiment, the predetermined person 40 is detected from each of the plurality of frame images 12, and a thumbnail image 41 of the person 40 is generated. Further, the image capture time information and the tracking ID that are associated with the thumbnail image 41 are stored. Subsequently, one or more identical thumbnail images 57 having the identical tracking ID are arranged based on the image capture time information of each image. This allows the person 40 of interest to be sufficiently observed. With this technique, the useful surveillance camera system 100 can be achieved.

For example, surveillance images of a person tracked with the plurality of cameras 10 are easily arranged in the rolled film portion 59 on a timeline. This allows a highly accurate surveillance. Further, the target object 73 can be easily corrected and can be observed with a high operability accordingly.

In surveillance camera systems in related art, images from surveillance cameras are displayed in divided areas of a screen. Consequently, it has been difficult to achieve a large-scale surveillance camera system using a lot of cameras. Further, it has also been difficult to track a person whose images are captured with a plurality of cameras. Using the surveillance camera system according to an embodiment of the present disclosure described above can provide a solution of such a problem.

Specifically, camera images that track the person 40 are connected to one another, so that the person can be easily observed irrespective of the total number of cameras. Further, editing the rolled film portion 59 can allow the tracking history of the person 40 to be easily corrected. The operation for the correction can be intuitively executed.

Figure 71:
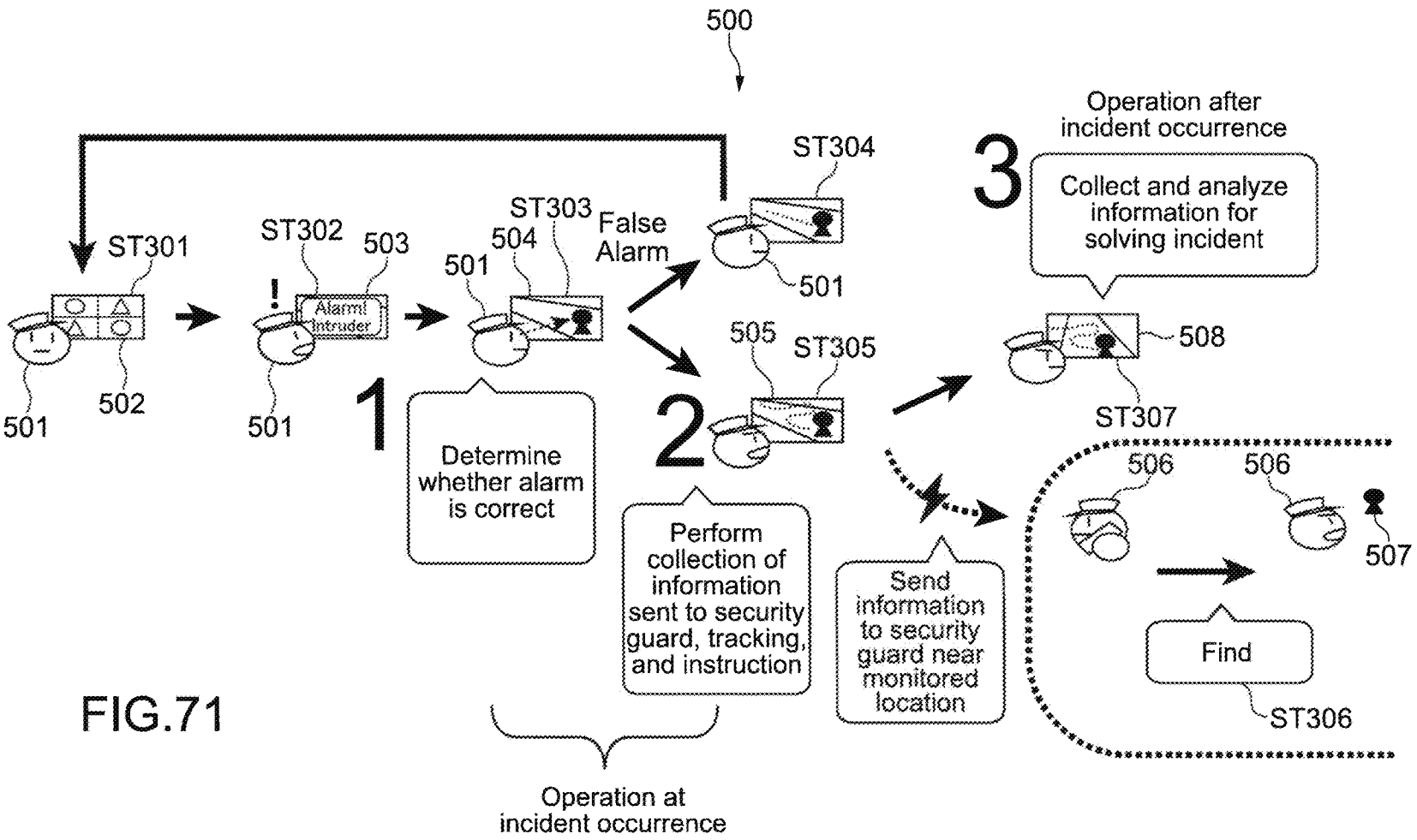
FIG. 71 is a diagram for describing the outline of a surveillance system using the surveillance camera system according to an embodiment of the present disclosure.

FIG. 71 is a diagram for describing the outline of a surveillance system 500 using the surveillance camera system 100 according to an embodiment of the present disclosure. Firstly, a security guard 501 observes surveillance images captured with a plurality of cameras on a plurality of monitors 502 (Step 301). A UI screen 503 indicating an alarm generation is displayed to notify the security guard 501 of a generation of an alarm (Step 302). As described above, an alarm is generated when a suspicious person appears, a sensor or the like detects an entry of a person into an off-limits area, and a fraudulent access to a secured door is detected, for example. Further, an alarm may be generated when a person lying for a long period of time is detected by an algorithm by which a posture of a person can be detected, for example. Furthermore, an alarm may be generated when a person who fraudulently acquires an ID card such as an employee ID card is found.

An alarm screen 504 displaying a state at an alarm generation is displayed. The security guard 501 can observe the alarm screen 504 to determine whether the generated alarm is correct or not (Step 303). This step is seen as a first step in this surveillance system 500.

When the security guard 501 determines that the alarm is falsely generated through the check of the alarm screen 504 (Step 304), the processing returns to the surveillance state of Step 301. When the security guard 501 determines that the alarm is appropriately generated, a tracking screen 505 for tracking a person set as a suspicious person is displayed. While watching the tracking screen 505, the security guard 501 collects information to be sent to another security guard 506 located near the monitored location. Further, while tracking a suspicious person 507, the security guard 501 issues an instruction to the security guard 506 at the monitored location (Step 305). This step is seen as a second step in this surveillance system 500. The first and second steps are mainly executed as operations at an alarm generation.

According to the instruction, the security guard 506 at the monitored location can search for the suspicious person 507, so that the suspicious person 507 can be found promptly (Step 306). After the suspicious person 507 is found and the incident comes to an end, for example, an operation to collect information for solving the incident is next executed. Specifically, the security guard 501 observes a UI screen called a history screen 508 in which a time at an alarm generation is set to be a reference. Consequently, the movement and the like of the suspicious person 507 before and after the occurrence of the incident are observed and the incident is analyzed in detail (Step 307). This step is seen as a third step in this surveillance system 500. For example, in Step 307, the surveillance camera system 100 using the UI screen 50 described above can be effectively used. In other words, the UI screen 50 can be used as the history screen 508. Hereinafter, the UI screen 50 according to an embodiment is referred to as the history screen 508.

To serve as the information processing apparatus according to an embodiment, an information processing apparatus that generates the alarm screen 504, the tracking screen 505, and the history screen 508 to be provided to a user may be used. This information processing apparatus allows an establishment of a useful surveillance camera system. Hereinafter, the alarm screen 504 and the tracking screen 505 will be described.

Figure 72:
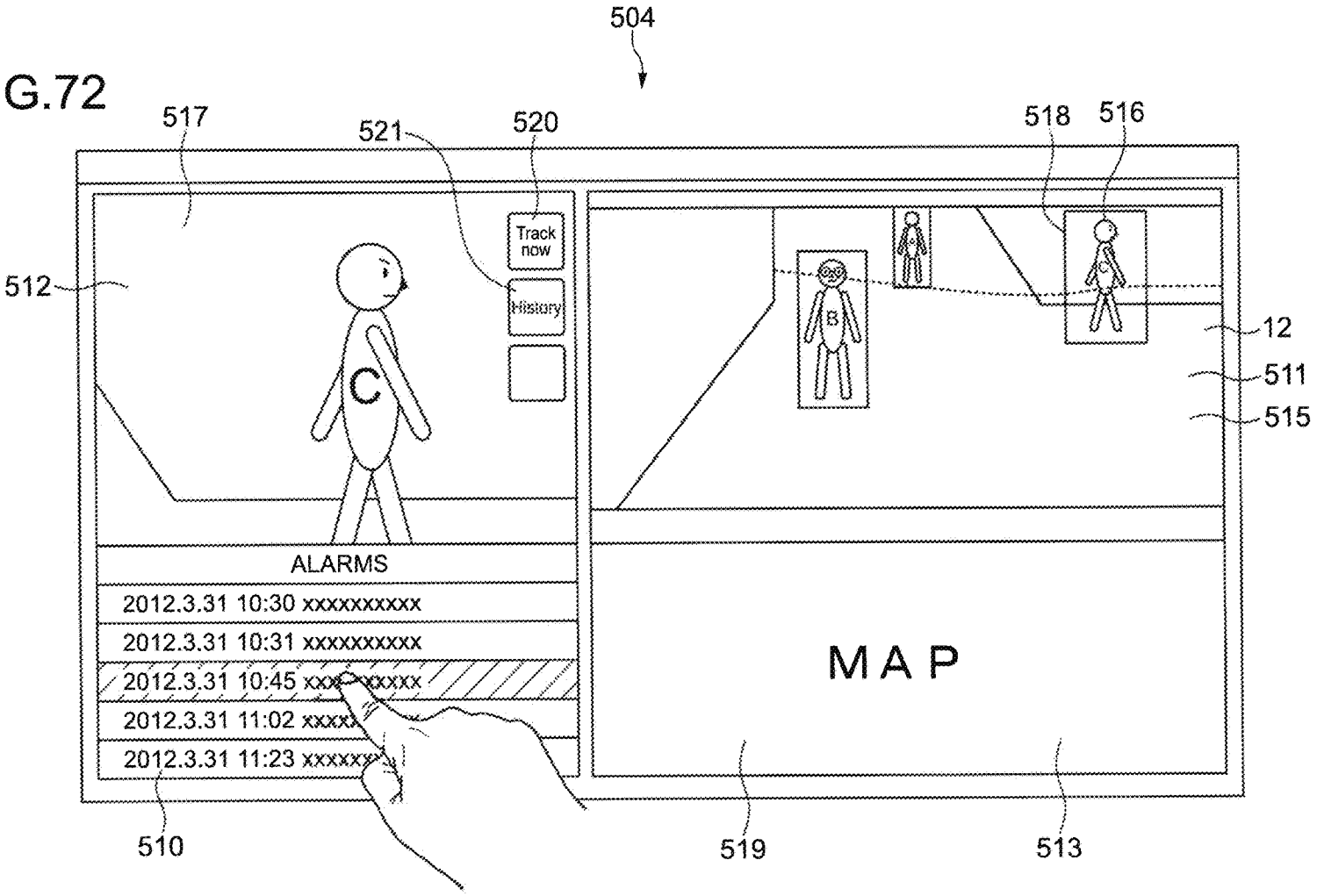
FIG. 72 is a diagram showing an example of an alarm screen.

FIG. 72 is a diagram showing an example of the alarm screen 504. The alarm screen 504 includes a list display area 510, a first display area 511, a second display area 512, and a map display area 513. In the list display area 510, times at which alarms have been generated up to the present time are displayed as a history in the form of a list. In the first display area 511, a frame image 12 at a time at which an alarm is generated is displayed as a playback image 515. In the second display area 512, an enlarged image 517 of an alarm person 516 is displayed. The alarm person 516 is a target for which an alarm is generated and which is displayed in the playback image 515. In the example shown in FIG. 72, the person C is set as the alarm person 516, and an emphasis image 518 of the person C is displayed in red. In the map display area 513, map information 519 indicating a position of the alarm person 516 at the alarm generation is displayed.

As shown in FIG. 72, when one of the listed times at which alarms have been generated is selected, information on the alarm generated at the selected time is displayed in the first and second display areas 511 and 512 and the map display area 513. When the time is changed to another one, the information to be displayed in each display area is also changed.

Further, the alarm screen 504 includes a tracking button 520 for switching to the tracking screen 505 and a history button 521 for switching to the history screen 508.

Figure 73:
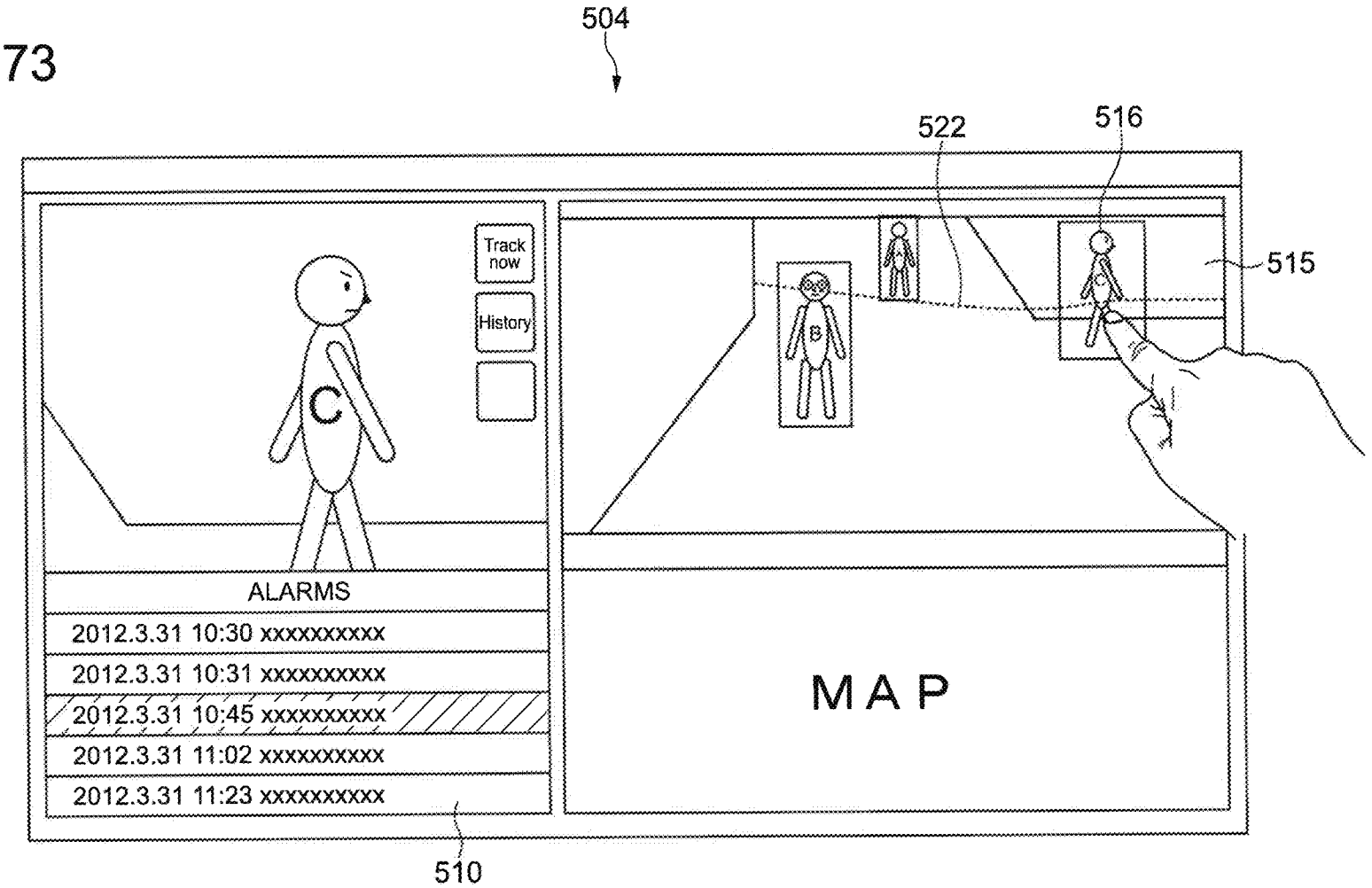
FIG. 73 is a diagram showing an example of an operation on the alarm screen and processing corresponding to the operation.

As shown in FIG. 73, moving the alarm person 516 along a movement image 522 may allow information before and after the alarm generation to be displayed in each display area. At that time, each of various types of information may be displayed in conjunction with the drag operation.

Figure 74:
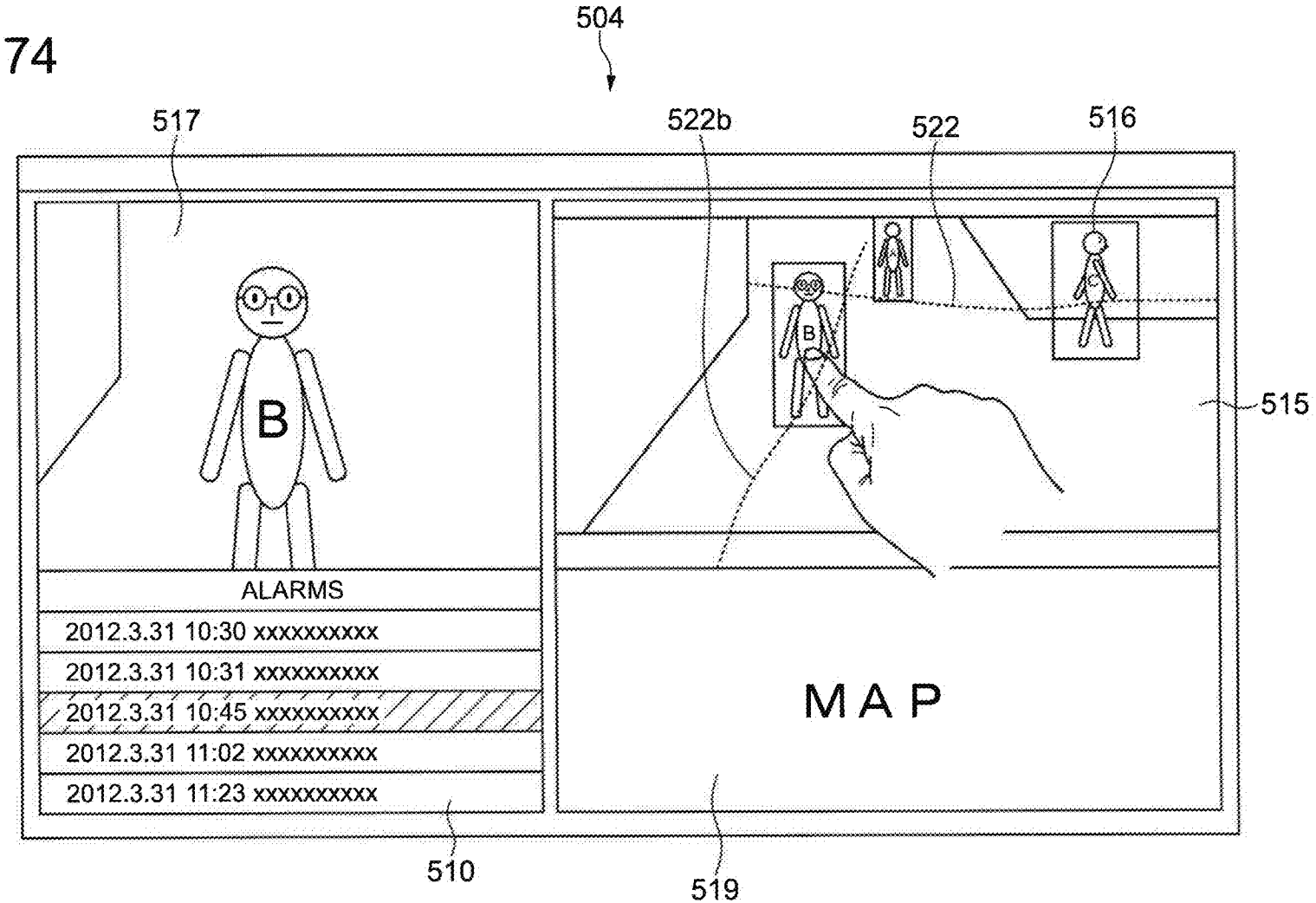
FIG. 74 is a diagram showing an example of an operation on the alarm screen and processing corresponding to the operation.
Figure 75:
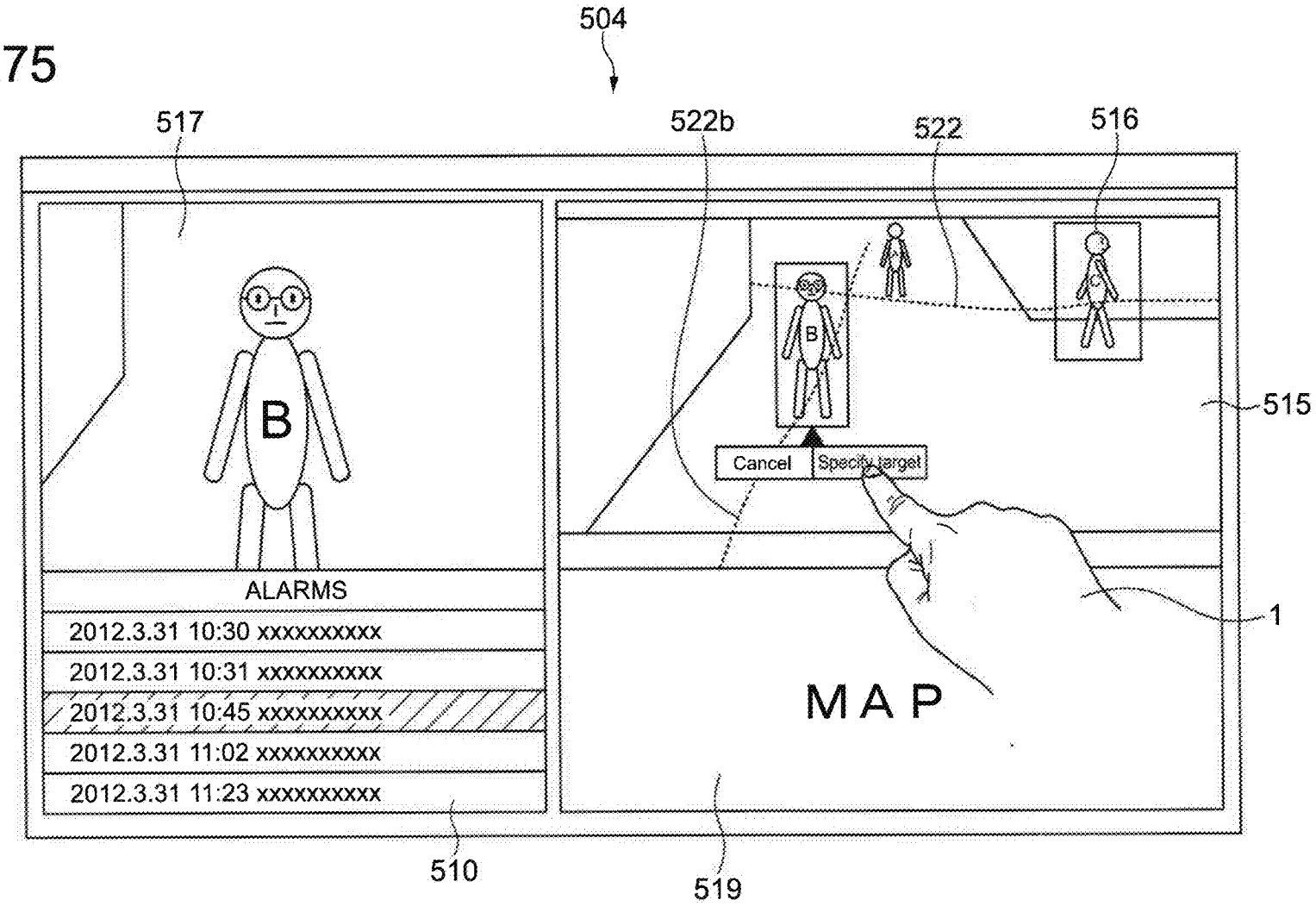
FIG. 75 is a diagram showing an example of an operation on the alarm screen and processing corresponding to the operation.

Further, the alarm person 516 may be changed or corrected. For example, as shown in FIG. 74, another person B in the playback image 515 is selected. Subsequently, an enlarged image 517 and map information 519 on the person B are displayed in each display area. Additionally, a movement image 522*b* indicating the movement of the person B is displayed in the playback image 515. As shown in FIG. 75, when the finger of the user 1 is released, a pop-up 523 for specifying the alarm person 516 is displayed, and when a button for specifying a target is selected, the alarm person 516 is changed. At that time, the information on the listed times at which alarms have been generated is changed from the information of the person C to the information of the person B. Alternatively, alarm information with which the information of the person B is associated may be newly generated as identical alarm generation information. In this case, two identical times of alarm generation are listed in the list display area 510.

Next, the tracking screen 505 will be described. A tracking button 520 of the alarm screen 504 shown in FIG. 76 is pressed so that the tracking screen 505 is displayed.

Figure 77:
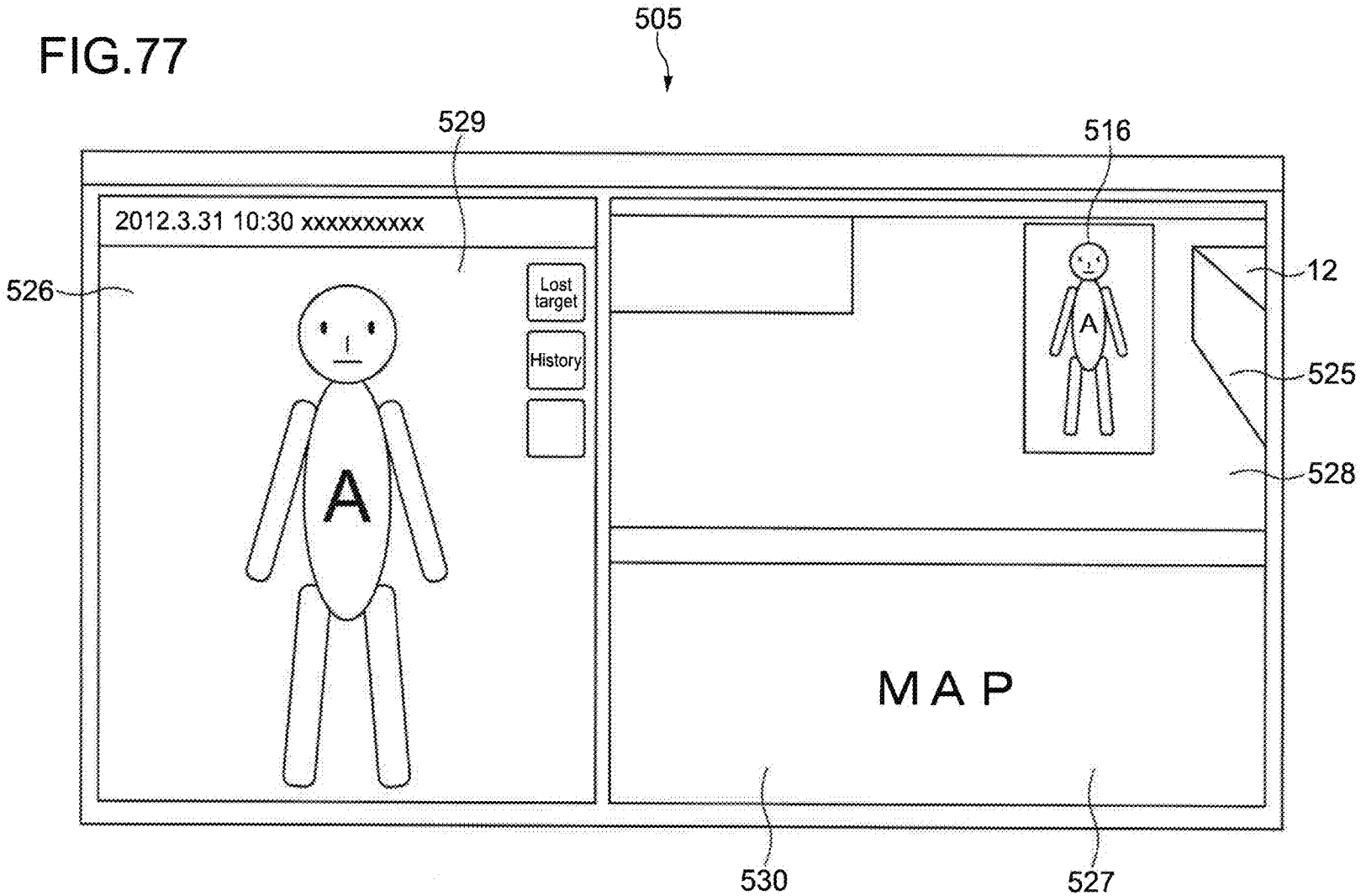
FIG. 77 is a diagram showing an example of a tracking screen.

FIG. 77 is a diagram showing an example of the tracking screen 505. In the tracking screen 505, information on the current time is displayed in a first display area 525, a second display area 526, and a map display area 527. As shown in FIG. 77, in the first display area 525, a frame image 12 of the alarm person 516 that is being captured at the current time is displayed as a live image 528. In the second display area 526, an enlarged image 529 of the alarm person 516 appearing in the live image 528 is displayed. In the map display area 527, map information 530 indicating the position of the alarm person 516 at the current time is displayed. Each piece of the information described above is displayed in real time with a lapse of time.

Figure 76:
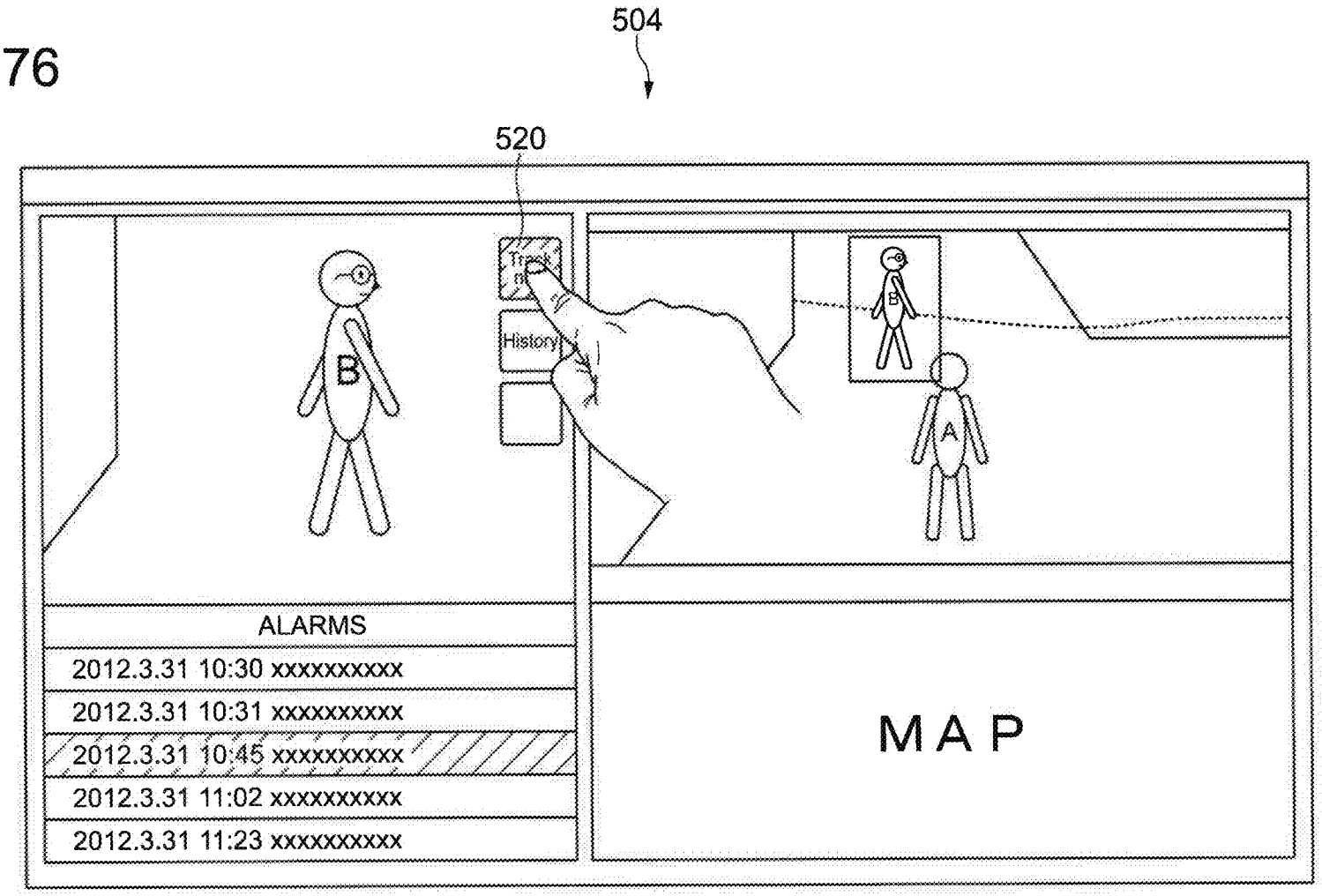
FIG. 76 is a diagram showing an example of an operation on the alarm screen and processing corresponding to the operation.

Note that in the alarm screen 504 shown in FIG. 76, the person B is set as the alarm person 516. In the tracking screen 505 shown in FIG. 77, however, the person A is tracked as the alarm person 516. In such a manner, a person to be tracked as a target may be falsely detected. In such a case, a target to be set as the alarm person 516 (hereinafter, also referred to as target 516 in some cases) has to be corrected. For example, when the person B that is the target 516 appears in the live image 528, a pop-up for specifying the target 516 is used to correct the target 516. On the other hand, as shown in FIG. 77, there are many cases where the target 516 does not appear in the live image 528. Hereinafter, the correction of the target 516 in such a case will be described.

Figure 78:
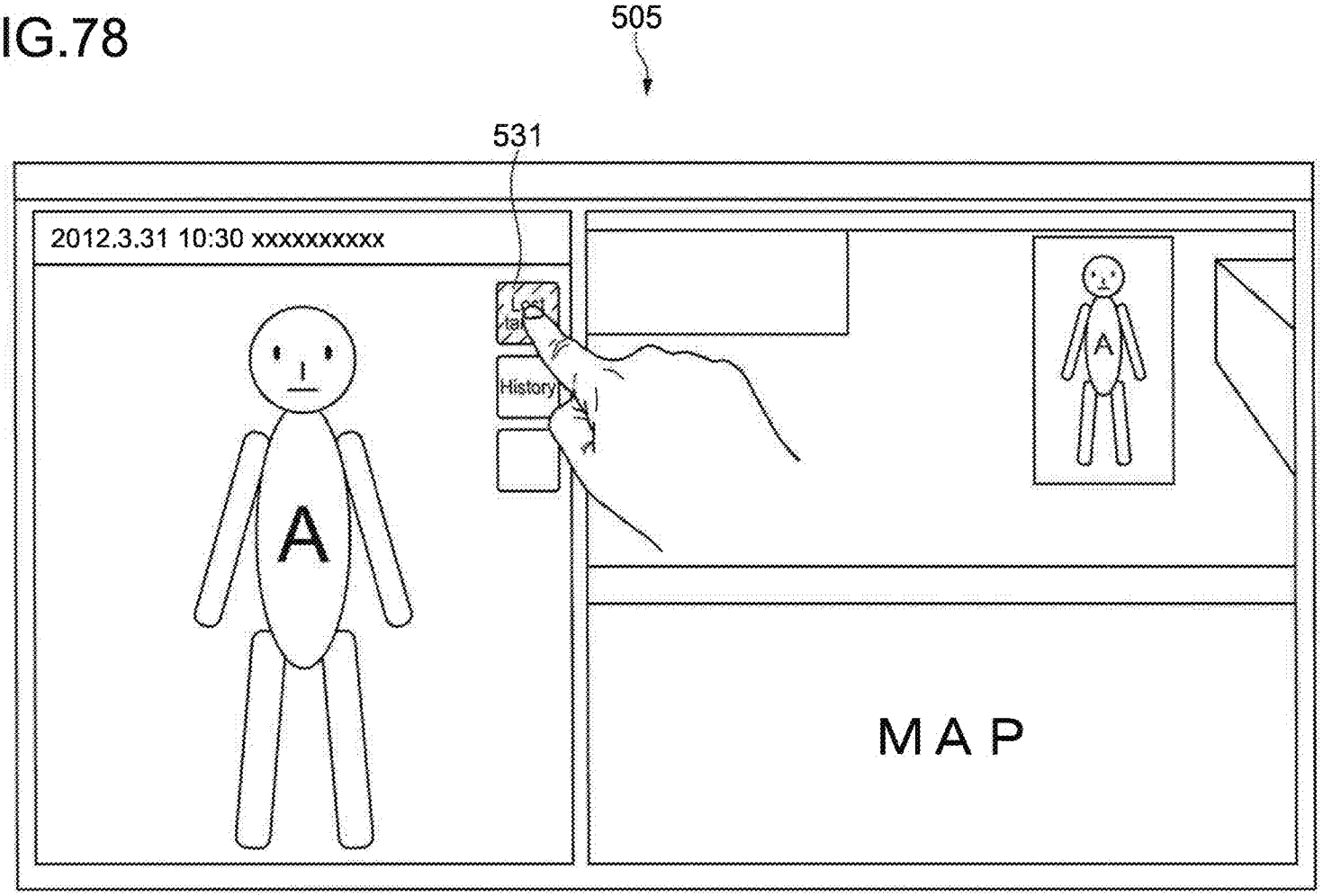
FIG. 78 is a diagram showing an example of a method of correcting a target on a tracking screen.
Figure 79:
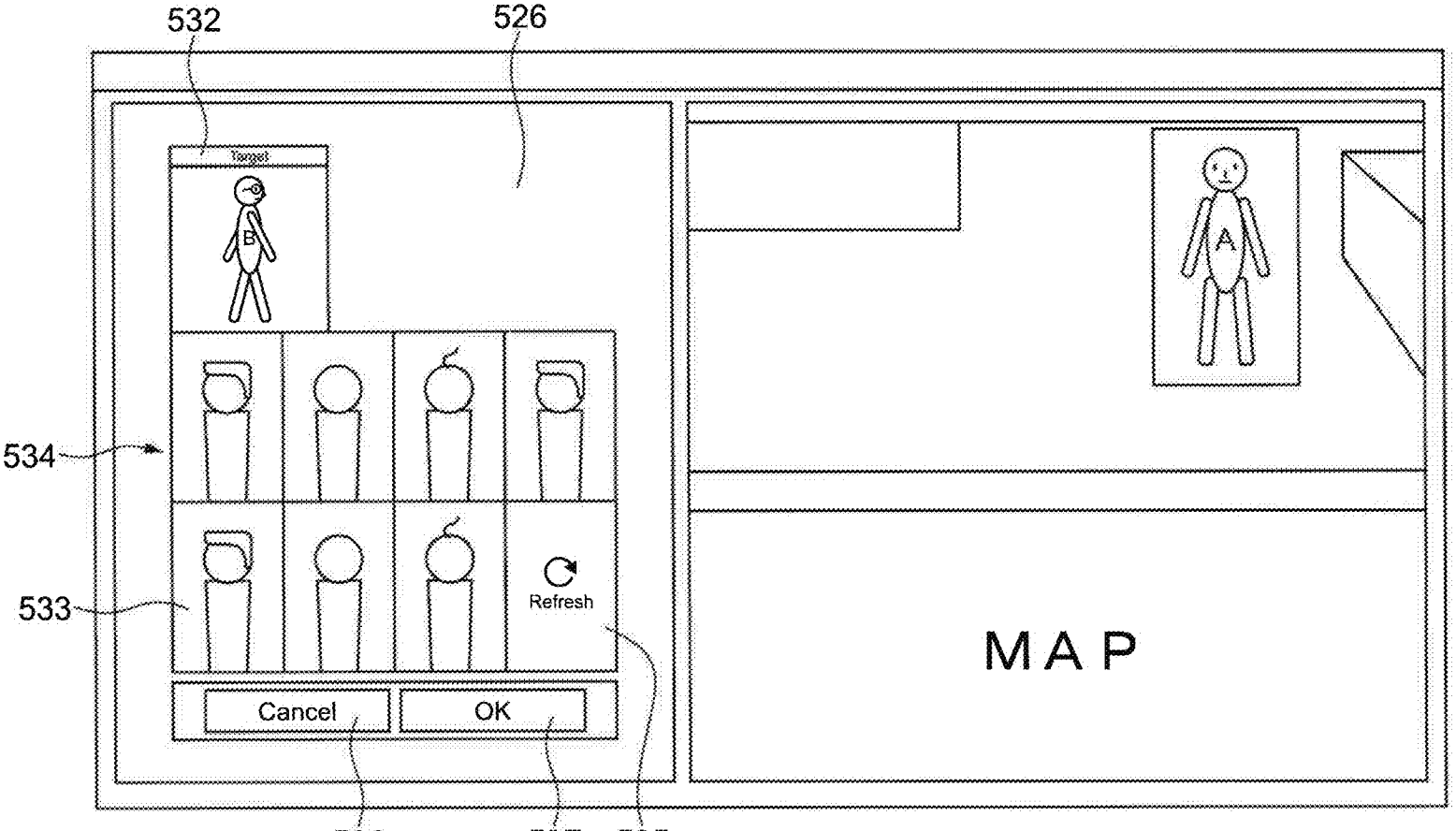
FIG. 79 is a diagram showing an example of the method of correcting a target on the tracking screen.

FIGS. 78 to 82 are diagrams each showing an example of a method of correcting the target 516. As shown in FIG. 78, a lost tracking button 531 is clicked. The lost tracking button 531 is provided for the case where the sight of the target 516 to be tracked is lost. Subsequently, as shown in FIG. 79, a thumbnail image 532 of the person B and a candidate selection UI 534 are displayed in the second display area 526. The person B of the thumbnail image 532 is to be the target 516. The candidate selection UI 534 is used to display a plurality of candidate thumbnail images 533 to be selectable. The candidate thumbnail images 533 are selected from the thumbnail images of the person whose images are captured with each camera at the current time. The candidate thumbnail images 533 are selected as appropriate based on the degree of similarity of a person, a positional relationship between cameras, and the like (the selection method described on the candidate thumbnail images 85 shown in FIG. 32 may be used).

Further, the candidate selection UI 534 is provided with a refresh button 535, a cancel button 536, and an OK button 537. The refresh button 535 is a button for instructing the update of the candidate thumbnail images 533. When the refresh button 535 is clicked, other candidate thumbnail images 533 are retrieved again and displayed. Note that when the refresh button 535 is held down, the mode may be switched to an auto-refresh mode. The auto-refresh mode refers to a mode in which the candidate thumbnail images 533 are automatically updated with every lapse of a predetermined time. The cancel button 536 is a button for cancelling the display of the candidate thumbnail images 533. The OK button 537 is a button for setting a selected candidate thumbnail image 533 as a target.

Figure 80:
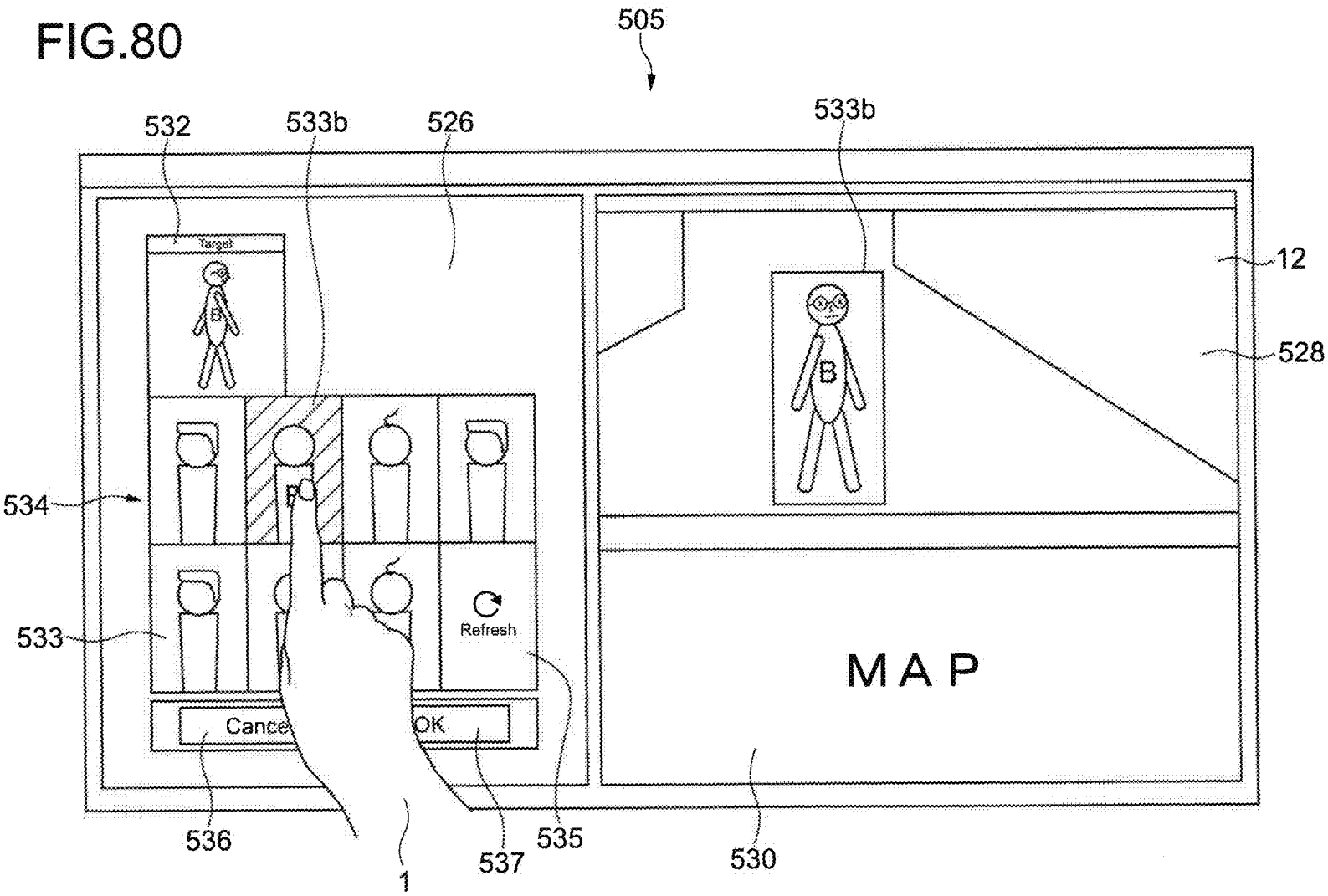
FIG. 80 is a diagram showing an example of the method of correcting a target on the tracking screen.
Figure 81:
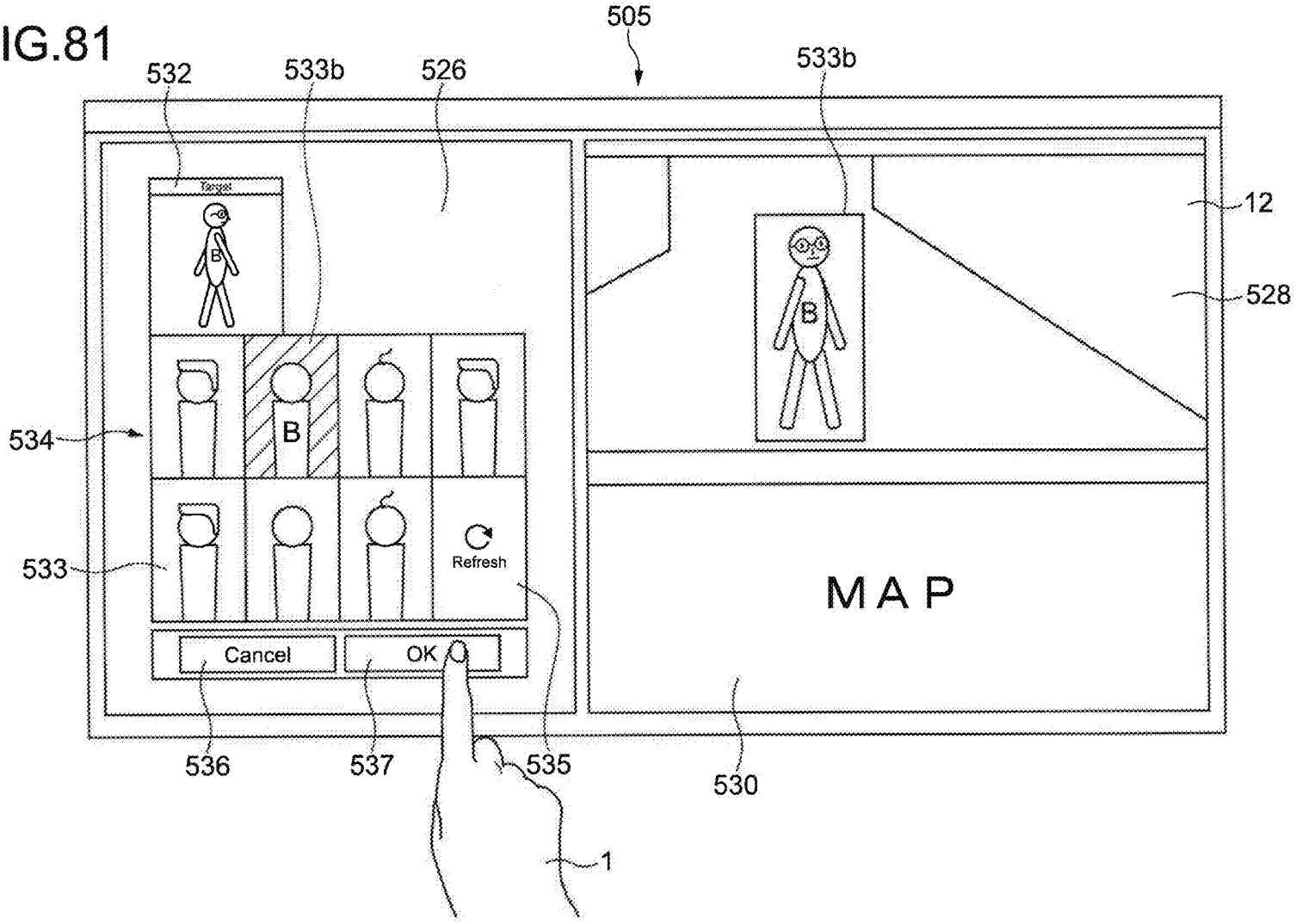
FIG. 81 is a diagram showing an example of the method of correcting a target on the tracking screen.

As shown in FIG. 80, when a thumbnail image 533*b* of the person B is displayed as the candidate thumbnail image 533, the thumbnail image 533*b* is selected by the user 1. Subsequently, the frame image 12 including the thumbnail image 533*b* is displayed in real time as the live image 528. Further, map information 530 related to the live image 528 is displayed. The user 1 can determine that the object is the person B by observing the live image 528 and the map information 530. As shown in FIG. 81, when the object appearing in the live image 528 is determined to be the person B, the OK button 537 is clicked. This allows the person B to be selected as a target and set as an alarm person.

Figure 82:
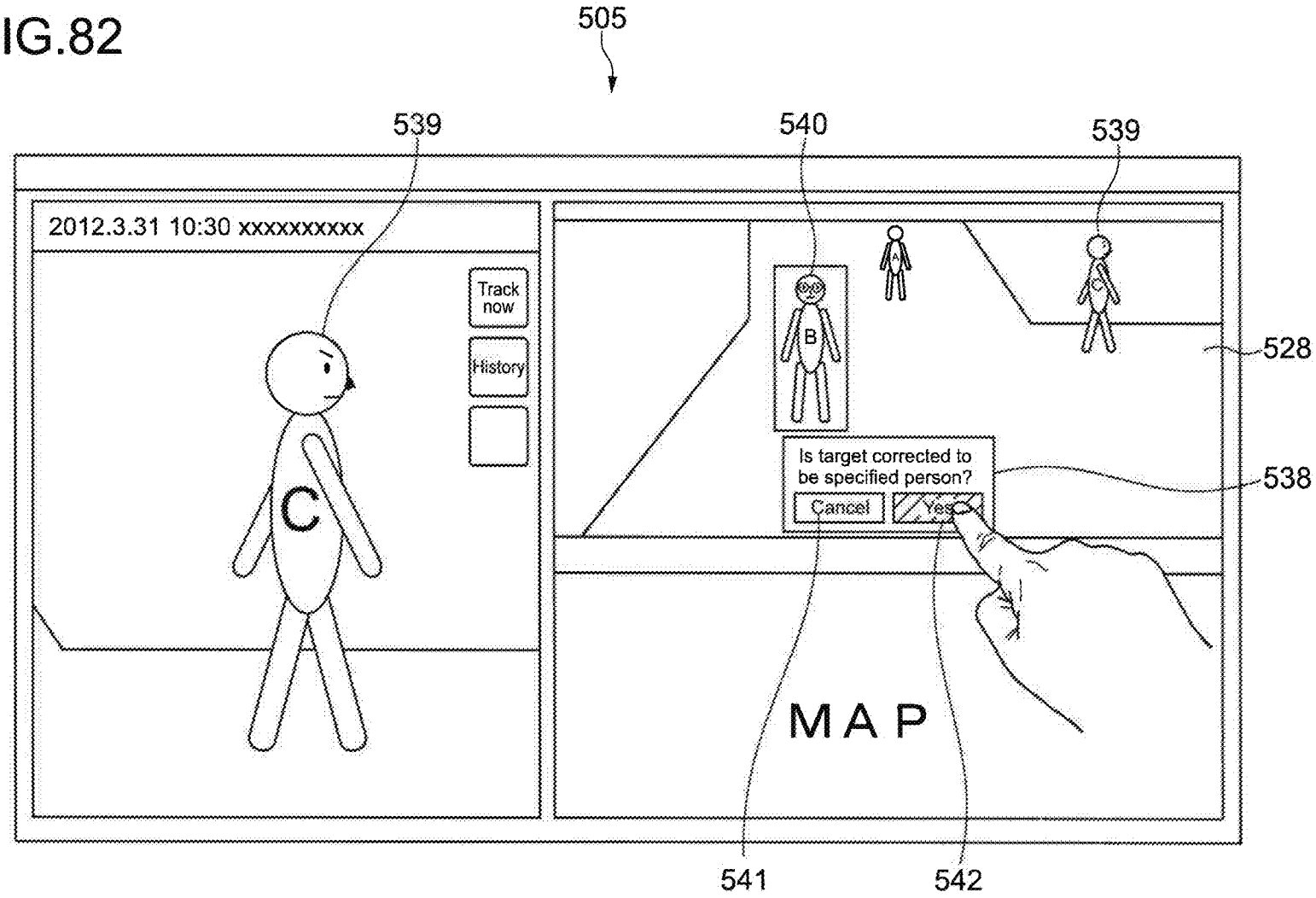
FIG. 82 is a diagram showing an example of the method of correcting a target on the tracking screen.

FIG. 82 is a diagram showing a case where a target 539 is corrected using a pop-up 538. Clicking another person 540 appearing in the live image 528 provides a display of the pop-up 538 for specifying a target. In the tracking screen 505, the live image 528 is displayed in real time. Consequently, the real time display is continued also after the pop-up 538 is displayed, and the clicked person 540 also continues to move. The pop-up 538, which does not follow the moving persons, displays a text asking whether the target 539 is corrected to the specified other person 540, and a cancel button 541 and a yes button 542 to respond to the text. For example, when the screen is switched, the pop-up 538 is not deleted until any of the buttons is pressed. This allows an observation of a real-time movement of a person to be monitored and also allows a determination on whether the person is set to be an alarm person.

FIGS. 83 to 86 are diagrams for describing other processing to be executed using the tracking screen 505. For example, in a surveillance camera system using a plurality of cameras, there may be areas that are not imaged with any of the cameras. Specifically, there may be dead areas that are not covered with any of the cameras. Processing when the target 539 falls within such areas will be described.

Figure 83:
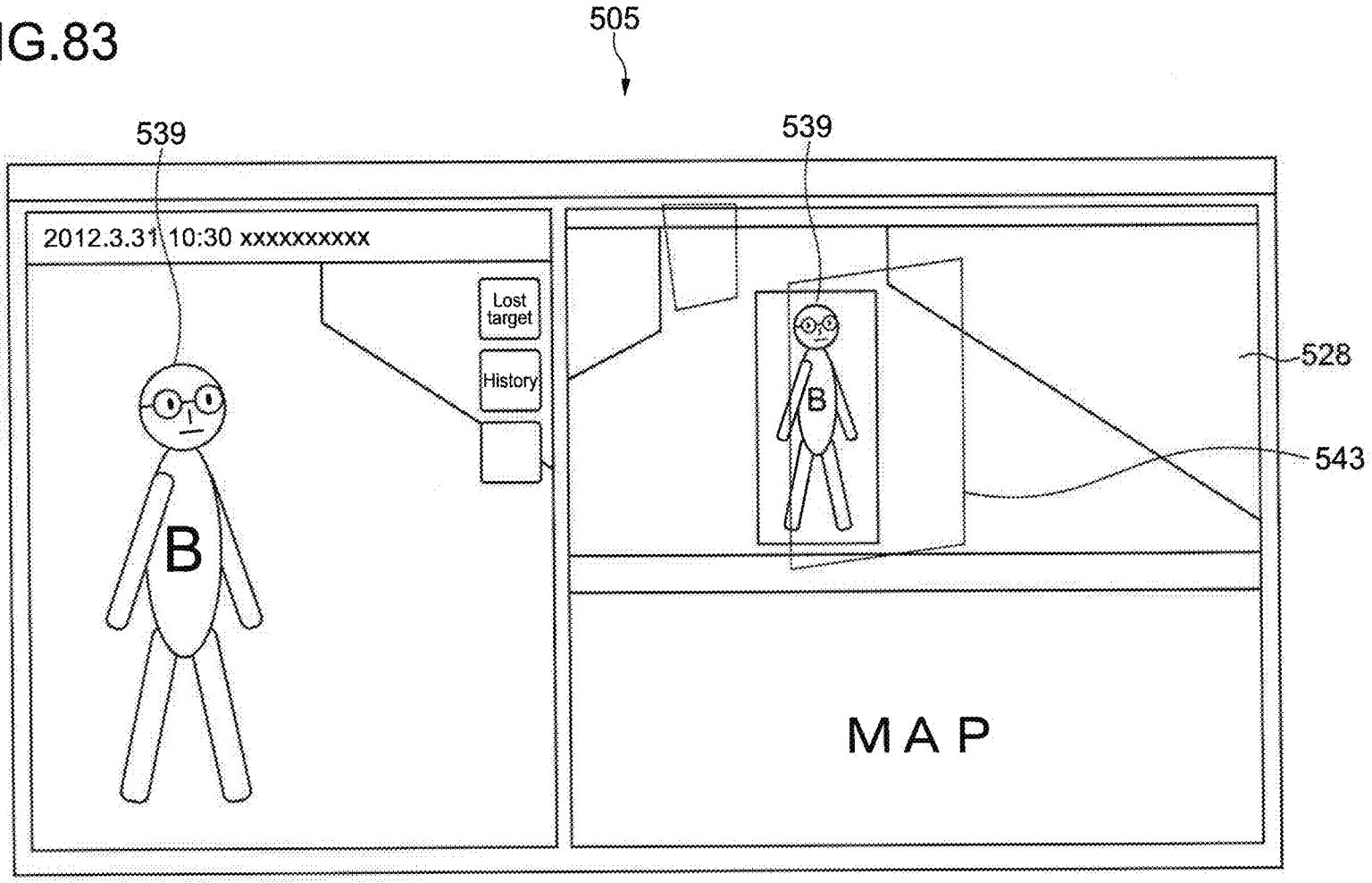
FIG. 83 is a diagram for describing other processing executed on the tracking screen.

As shown in FIG. 83, the person B set as the target 539 moves toward the near side. It is assumed that there is a dead area that is not covered with the cameras in the traveling direction of the target 539. In such a case, as shown in FIG. 83, a gate 543 is set at a predetermined position of the live image 528. The position and the size of the gate 543 may be set as appropriate based on an arrangement relationship between the cameras, that is, situations of dead areas not covered with the cameras, and the like. The gate 543 is displayed in the live image 528 when the person B approaches the gate 543 by a predetermined distance or more. Alternatively, the gate 543 may always be displayed.

Figure 84:
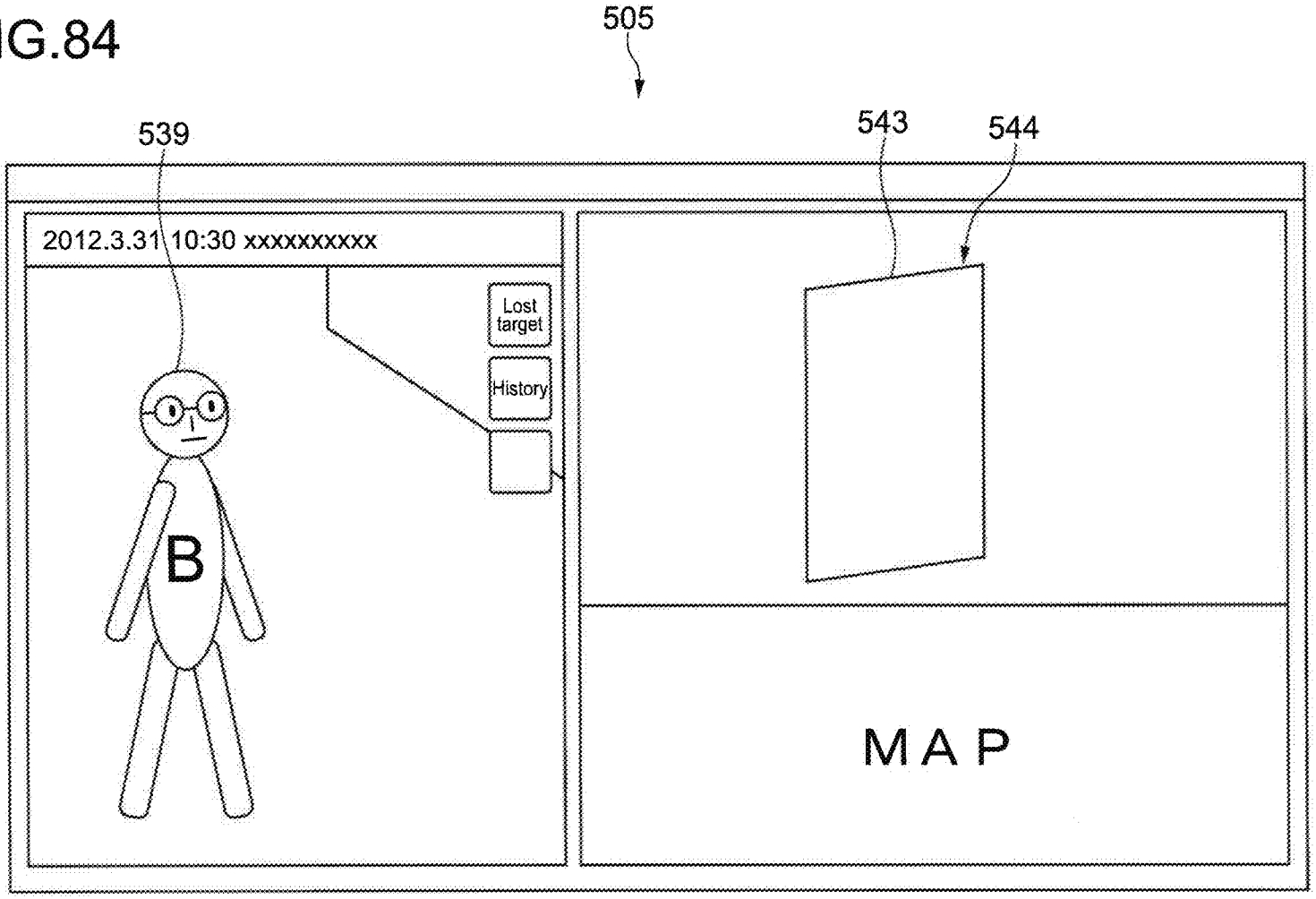
FIG. 84 is a diagram for describing the other processing executed on the tracking screen.
Figure 85:
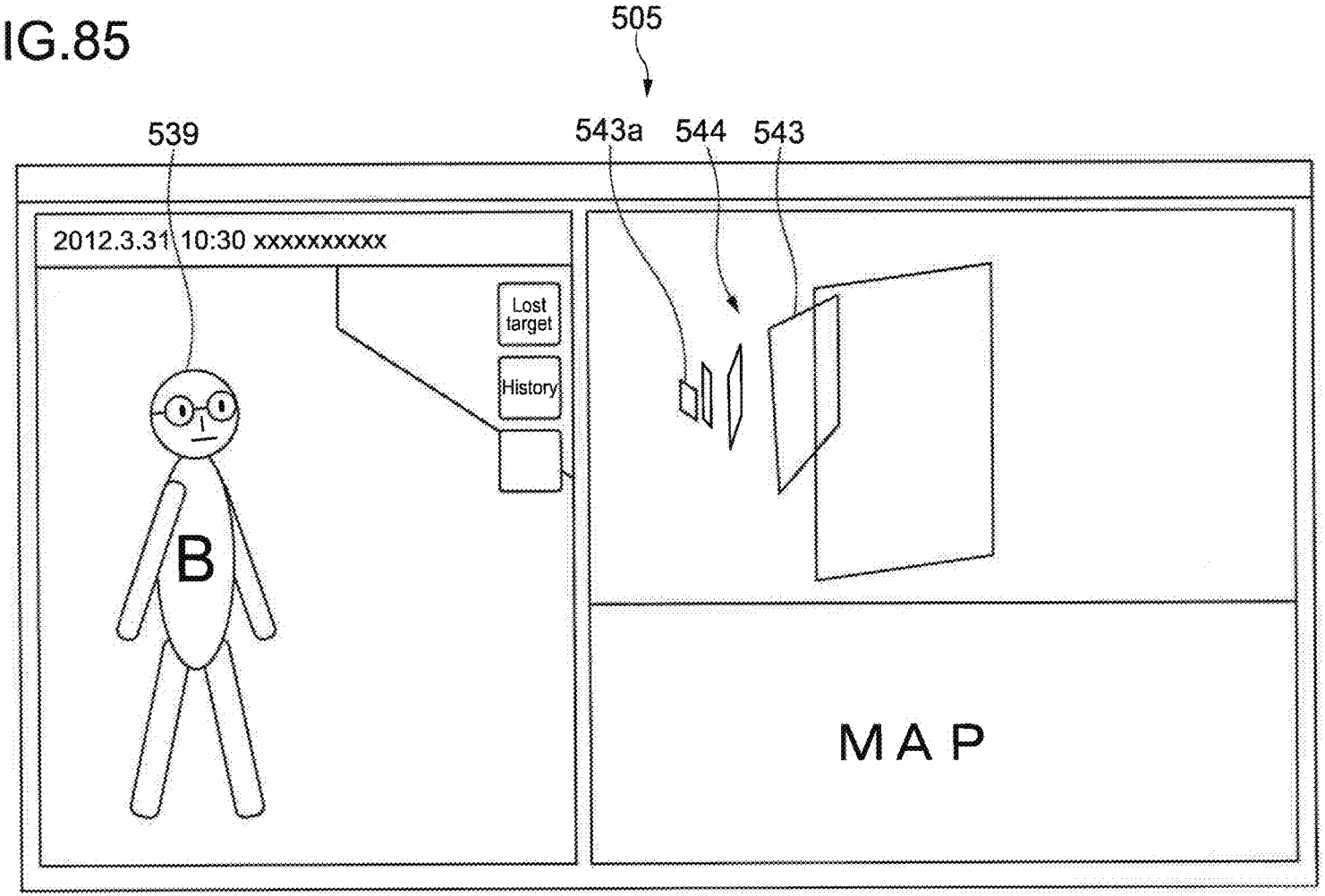
FIG. 85 is a diagram for describing the other processing executed on the tracking screen.

As shown in FIG. 84, when the person B overlaps the gate 543, a moving image 544 that reflects a positional relationship between the cameras is displayed. First, images other than the gate 543 disappear, and an image with the emphasized gate 543 is displayed. Subsequently, as shown in FIG. 85, an animation 544 is displayed. In the animation 544, the gate 543 moves with the movement that reflects the positional relationship between the cameras. The left side of a gate 543*a*, which is the smallest gate shown in FIG. 85, corresponds to the deep side of the live image 528 of FIG. 83. The right side of the smallest gate 543*a* corresponds to the near side of the live image 528. Consequently, the person B approaches the smallest gate 543*a* from the left side and travels to the right side.

Figure 86:
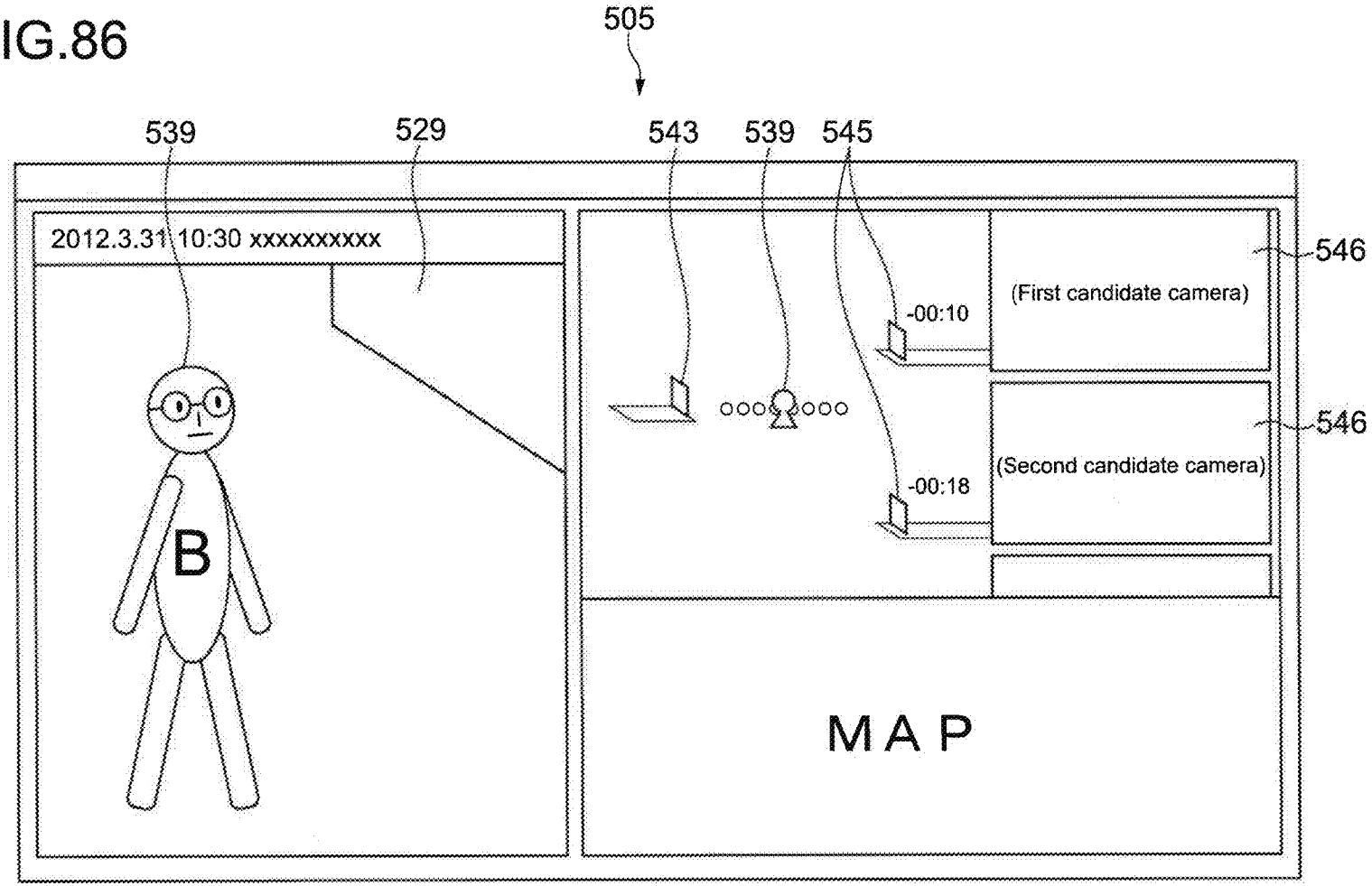
FIG. 86 is a diagram for describing the other processing executed on the tracking screen.

As shown in FIG. 86, gates 545 and live images 546 are displayed. The gates 545 correspond to the imaging ranges of candidate cameras (first and second candidate cameras) that are assumed to capture the person B next. The live images 546 are captured with the respective candidate cameras. The candidate cameras are each selected as a camera with a highly possibility of capturing next an image of the person B situated at a position of dead areas where the cameras are not covered. The selection may be executed as appropriate based on the positional relationship between the cameras, the person information of the person B, and the like. Numerical values are assigned to the gates 545 of the respective candidate cameras. Each of the numerical values represents a predicted time at which the person B is assumed to appear in the gate 545. Specifically, a time at which an image of the person B is assumed to be captured with each candidate camera as the live image 546 is predicted. The information on the predicted time is calculated based on the map information, information on the structure of a building, and the like. Note that an image captured last is displayed in the enlarged image 529 shown in FIG. 86. Specifically, the latest enlarged image of the person B is displayed. This allows an easy checking of the appearance of the target on the live image 546 captured with the candidate camera.

Figure 87:
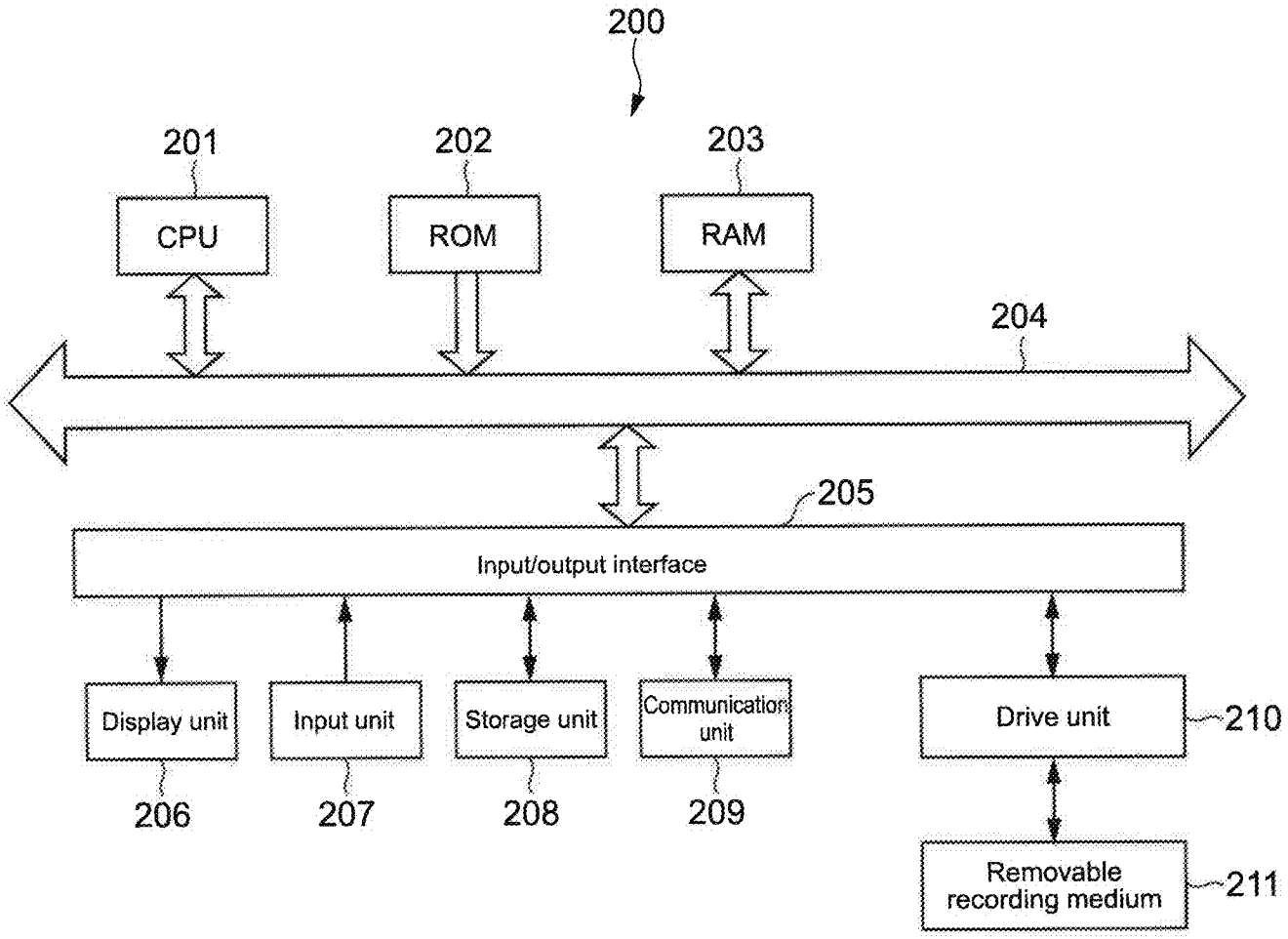
FIG. 87 is a schematic block diagram showing a configuration example of a computer to be used as a client apparatus and a server apparatus.

In embodiments described above, various computers such as a PC (Personal Computer) are used as the client apparatus 30 and the server apparatus 20. FIG. 87 is a schematic block diagram showing a configuration example of such a computer.

A computer 200 includes a CPU (Central Processing Unit) 201, a ROM (Read Only Memory) 202, a RAM (Random Access Memory) 203, an input/output interface 205, and a bus 204 that connects those components to one another.

The input/output interface 205 is connected to a display unit 206, an input unit 207, a storage unit 208, a communication unit 209, a drive unit 210, and the like.

The display unit 206 is a display device using, for example, liquid crystal, EL (Electro-Luminescence), or a CRT (Cathode Ray Tube).

The input unit 207 is, for example, a controller, a pointing device, a keyboard, a touch panel, and other operational devices. When the input unit 207 includes a touch panel, the touch panel may be integrated with the display unit 206.

The storage unit 208 is a non-volatile storage device and is, for example, a HDD (Hard Disk Drive), a flash memory, or other solid-state memory.

The drive unit 210 is a device that can drive a removable recording medium 211 such as an optical recording medium, a floppy (registered trademark) disk, a magnetic recording tape, and a flash memory. On the other hand, the storage unit 208 is often used to be a device that is preliminarily mounted on the computer 200 and mainly drives a non-removable recording medium.

The communication unit 209 is a modem, a router, or another communication device that is used to communicate with other devices and is connected to a LAN (Local Area Network), a WAN (Wide Area Network), and the like. The communication unit 209 may use any of wired and wireless communications. The communication unit 209 is used separately from the computer 200 in many cases.

The information processing by the computer 200 having the hardware configuration as described above is achieved in cooperation with software stored in the storage unit 208, the ROM 202, and the like and hardware resources of the computer 200. Specifically, the CPU 201 loads programs constituting the software into the RAM 203, the programs being stored in the storage unit 208, the ROM 202, and the like, and executes the programs so that the information processing by the computer 200 is achieved. For example, the CPU 201 executes a predetermined program so that each block shown in FIG. 1 is achieved.

The programs are installed into the computer 200 via a recording medium, for example. Alternatively, the programs may be installed into the computer 200 via a global network and the like.

Further, the program to be executed by the computer 200 may be a program by which processing is performed chronologically along the described order or may be a program by which processing is performed at a necessary timing such as when processing is performed in parallel or an invocation is performed.

Other Embodiments

The present disclosure is not limited to embodiments described above and can achieve other various embodiments.

Figure 88:
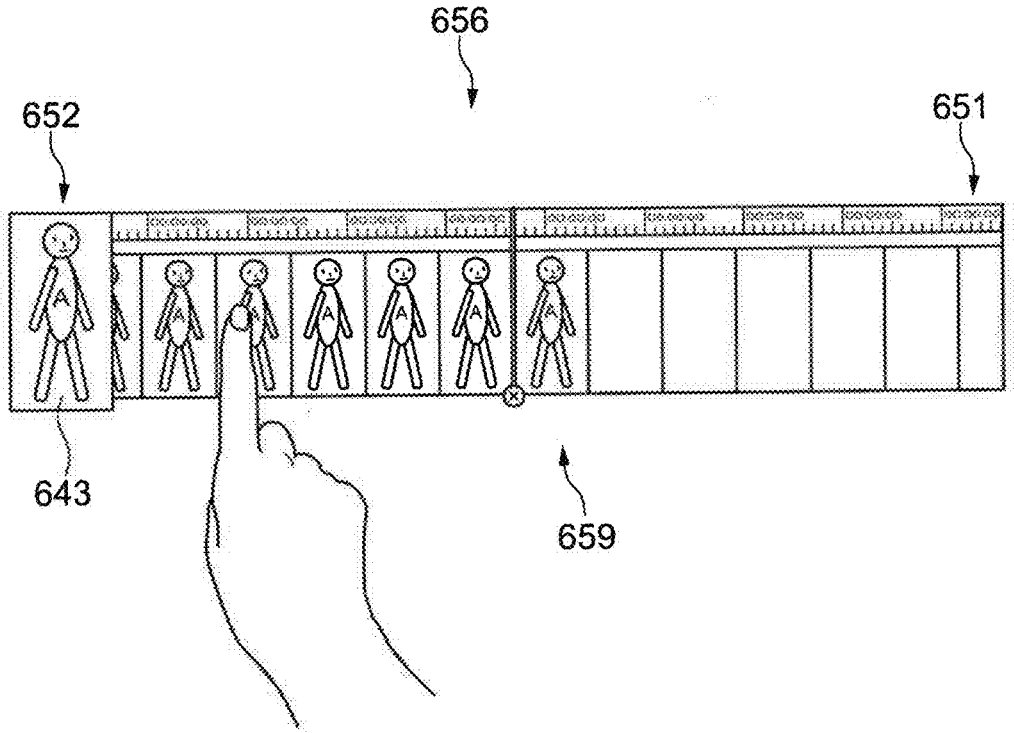
FIG. 88 is a diagram showing a rolled film image according to another embodiment.

For example, FIG. 88 is a diagram showing a rolled film image 656 according to another embodiment. In an embodiment described above, as shown in FIG. 7 and the like, the reference thumbnail image 43 is displayed at substantially the center of the rolled film portion 59 so as to be connected to the pointer 56 arranged at the reference time T1. Additionally, the reference thumbnail image 43 is also moved in the horizontal direction in accordance with the drag operation on the rolled film portion 59. Instead of this operation, as shown in FIG. 88, a reference thumbnail image 643 may be fixed to a right end 651 or a left end 652 of the rolled film portion 659 from the beginning. In addition, the position to display the reference thumbnail image 643 may be changed as appropriate.

In an embodiment described above, a person is set as an object to be detected, but the object is not limited to the person. Other moving objects such as animals and automobiles may be detected as an object to be observed.

Although the client apparatus and the server apparatus are connected via the network and the server apparatus and the plurality of cameras are connected via the network in an embodiment described above, the network may not be used to connect the apparatuses. Specifically, a method of connecting the apparatuses is not limited. Further, although the client apparatus and the server apparatus are arranged separately in an embodiment described above, the client apparatus and the server apparatus may be integrated to be used as an information processing apparatus according to an embodiment of the present disclosure. An information processing apparatus according to an embodiment of the present disclosure may be configured including a plurality of imaging apparatuses.

For example, the image switching processing according to an embodiment of the present disclosure described above may be used for another information processing system other than the surveillance camera system.

At least two of the features of embodiments described above can be combined.

Note that the present disclosure can take the following configurations.

(1) An image processing apparatus including: an obtaining unit configured to obtain a plurality of segments compiled from at least one media source, wherein each segment of the plurality of segments contains at least one image frame within which a specific target object is found to be captured; and a providing unit configured to provide image frames of the obtained plurality of segments for display along a timeline and in conjunction with a tracking status indicator that indicates a presence of the specific target object within the plurality of segments in relation to time.

(2) The image processing apparatus of (1), wherein an object is specified as the specific target object prior to the compiling of the plurality of segments.

(3) The image processing apparatus of (1) or (2), wherein the timeline is representative of capture times of the plurality of segments and the tracking status indicator is displayed along the timeline in conjunction with the displayed plurality of segments, the displayed plurality of segments being arranged along the timeline at corresponding capture times.

(4) The image processing apparatus of any of (1) through (3), wherein each one of the displayed plurality of segments is selectable, and upon selection of a desired segment of the plurality of segments, the desired segment is reproduced.

(5) The image processing apparatus of any of (1) through (4), wherein the desired segment is reproduced within a viewing display area while the image frames of the plurality of segments are displayed along the timeline.

(6) The image processing apparatus of any of (1) through (5), wherein a focus is displayed in conjunction with at least one image of the reproduced desired segment to indicate a position of the specific target object within the at least one image.

(7) The image processing apparatus of any of (1) through (6), wherein a map with an icon which indicates a location of the specific target object is displayed together with the reproduced desired segment and the image frames along the timeline in the viewing display area.

(8) The image processing apparatus of any of (1) through (7), wherein the focus includes at least one of an identity mark, a highlighting, an outlining, and an enclosing box.

(9) The image processing apparatus of any of (1) through (8), wherein a path of movement over a period of time of the specific target object captured within the image frames of the plurality of segments is displayed at corresponding positions within images reproduced for display.

(10) The image processing apparatus of any of (1) through (9), wherein when a user specifies, from within the viewing display area, a desired position of the specific target object along the path of movement, a focus is placed upon a corresponding segment displayed along the timeline within which corresponding segment the specific target object is found to be captured at a location of the desired position.

(11) The image processing apparatus of any of (1) through (10), wherein the at least one image frame of each segment is represented by at least one respective representative image for display along the timeline, and the respective representative image for each segment of the plurality of segments is extracted from contents of each corresponding segment.

(12) The image processing apparatus of any of (1) through (11), wherein an object which is displayed in the viewing display area can be selectable by a user as the specific target object, and based on the selection by the user, at least a part of the plurality of segments displayed along the timeline is replaced by a segment which contains the specific target object selected by the user in the viewing display area.

(13) The image processing apparatus of any of (1) through (12), wherein the plurality of segments are generated based on images captured by different imaging devices.

(14) The image processing apparatus of any of (1) through (13), wherein the different imaging devices include at least one of a mobile imaging device and a video surveillance device.

(15) The image processing apparatus of any of (1) through (14), wherein the at least one media source includes a database of video contents containing recognized objects, and the specific target object is selected from among the recognized objects.

(16) The image processing apparatus of any of (1) through (15), wherein a monitor display area in which different images which represents different media sources are displayed is provided together with the viewing display area, and at least one displayed image in the viewing display area is changed based on a selection of an image displayed in the monitor display area.

(17) The image processing apparatus of any of (1) through (16), wherein a plurality of candidate thumbnail images to be selectable as the specific target object by a user are displayed in connection with a position of the plurality of segments along the timeline.

(18) The image processing apparatus of any of (1) through (17), wherein the plurality of candidate thumbnail images correspond to respective selected positions of the plurality of segments along the timeline and have high probability for inclusion of the specific target object.

(19) The image processing apparatus of any of (1) through (18), wherein the specific target object is found to be captured based on a degree of similarity of objects appearing within the plurality of segments.

(20) The image processing apparatus of any of (1) through (19), wherein the specific target object is recognized as being present within the plurality of segments according to a result of facial recognition processing.

(21) An image processing method including: obtaining a plurality of segments compiled from at least one media source, wherein each segment of the plurality of segments contains at least one image frame within which a specific target object is found to be captured; and providing image frames of the obtained plurality of segments for display along a timeline and in conjunction with a tracking status indicator that indicates a presence of the specific target object within the plurality of segments in relation to time.

(22) A non-transitory computer-readable medium having embodied thereon a program, which when executed by a computer causes the computer to perform a method, the method including: obtaining a plurality of segments compiled from at least one media source, wherein each segment of the plurality of segments contains at least one image frame within which a specific target object is found to be captured; and providing image frames of the obtained plurality of segments for display along a timeline and in conjunction with a tracking status indicator that indicates a presence of the specific target object within the plurality of segments in relation to time.

(23) An information processing apparatus, including: a detection unit configured to detect a predetermined object from each of a plurality of captured images that are captured with an imaging apparatus and are temporally successive; a first generation unit configured to generate a partial image including the object, for each of the plurality of captured images from which the object is detected, to generate at least one object image; a storage unit configured to store, in association with the generated at least one object image, information on an image capture time of each of the captured images each including the at least one object image, and identification information used to identify the object included in the at least one object image; and an arrangement unit configured to arrange at least one identical object image having the same stored identification information from among the at least one object image, based on the stored information on the image capture time of each image.

(24) The information processing apparatus of (23), further including a selection unit configured to select a reference object image from the at least one object image, the reference object image being a reference, in which the arrangement unit is configured to arrange the at least one identical object image storing identification information that is the same as the identification information of the selected reference object image, based on the information on the image capture time of the reference object image.

(25) The information processing apparatus of (23) or (24), in which the detection unit is configured to detect the predetermined object from each of the plurality of captured images that are captured with each of a plurality of imaging apparatuses.

(26) The information processing apparatus of any one of (23) through (25), further including a first output unit configured to output a time axis, in which the arrangement unit is configured to arrange the at least one identical object image along the time axis.

(27) The information processing apparatus of any of (23) through (26), in which the arrangement unit is configured to arrange the at least one identical object image for each predetermined range on the time axis, the at least one identical object image having the image capture time within the predetermined range.

(28) The information processing apparatus of any of (23) through (27), in which the first output unit is configured to output a pointer indicating a predetermined position on the time axis, the information processing apparatus further including a second output unit configured to select the at least one identical object image corresponding to the predetermined position on the time axis indicated by the pointer and to output object information that is information related to the at least one identical object image.

(29) The information processing apparatus of any of (23) through (28), in which the second output unit is configured to change the selection of the at least one identical object image corresponding to the predetermined position and the output of the object information, in conjunction with a change of the predetermined position indicated by the pointer.

(30) The information processing apparatus of any of (23) through (29), in which the second output unit is configured to output one of the captured images that includes the at least one identical object image corresponding to the predetermined position.

(31) The information processing apparatus of any of (23) through (30), further including a second generation unit configured to detect a movement of the object and generate a movement image expressing the movement, in which the second output unit is configured to output the movement image of the object included in the at least one identical object image corresponding to the predetermined position.

(32) The information processing apparatus of any of (23) through (31), in which the second output unit is configured to output map information indicating a position of the object included in the at least one identical object image corresponding to the predetermined position.

(33) The information processing apparatus of any of (23) through (32), further including an input unit configured to input an instruction from a user, in which the first output unit is configured to change the predetermined position indicated by the pointer according to an instruction given to the at least one identical object image, the instruction being input with the input unit.

(34) The information processing apparatus of any of (23) through (33), in which the first output unit is configured to change the predetermined position indicated by the pointer according to an instruction given to the output object information.

(35) The information processing apparatus of any of (23) through (34), further including a correction unit configured to correct the at least one identical object image according to a predetermined instruction input with the input unit.

(36) The information processing apparatus of any of (23) through (35), in which the correction unit is configured to correct the at least one identical object image according to an instruction to select another object included in the captured image that is output as the object information.

(37) The information processing apparatus of any of (23) through (36), in which the correction unit is configured to correct the at least one identical object image according to an instruction to select at least one image from the at least one identical object image.

(38) The information processing apparatus of any of (23) through (37), in which the correction unit is configured to select a candidate object image that is to be a candidate of the at least one identical object image, from the at least one object image storing identification information that is different from the identification information of the selected reference object image.

(39) The information processing apparatus of any of (23) through (38), further including a determination unit configured to determine whether the detected object is a person to be monitored, in which the selection unit is configured to select, as the reference object image, the at least one object image including the object that is determined to be the person to be monitored.

(40) An information processing method executed by a computer, the method comprising: detecting a predetermined object from each of a plurality of captured images that are captured with an imaging apparatus and are temporally successive; generating a partial image including the object, for each of the plurality of captured images from which the object is detected, to generate at least one object image; storing, in association with the generated at least one object image, information on an image capture time of each of the captured images each including the at least one object image, and identification information used to identify the object included in the at least one object image; and arranging at least one identical object image having the same stored identification information from among the at least one object image, based on the stored information on the image capture time of each image.

(41) A program causing a computer to execute: detecting a predetermined object from each of a plurality of captured images that are captured with an imaging apparatus and are temporally successive; generating a partial image including the object, for each of the plurality of captured images from which the object is detected, to generate at least one object image; storing, in association with the generated at least one object image, information on an image capture time of each of the captured images each including the at least one object image, and identification information used to identify the object included in the at least one object image; and arranging at least one identical object image having the same stored identification information from among the at least one object image, based on the stored information on the image capture time of each image.

(42) An information processing system, comprising: at least one imaging apparatus configured to capture a plurality of images that are temporally successive; and an information processing apparatus including a detection unit configured to detect a predetermined object from each of the plurality of images that are captured with the at least one imaging apparatus, a generation unit configured to generate a partial image including the object, for each of the plurality of images from which the object is detected, to generate at least one object image, a storage unit configured to store, in association with the generated at least one object image, information on an image capture time of each of the images each including the at least one object image, and identification information used to identify the object included in the at least one object image, and an arrangement unit configured to arrange at least one identical object image having the same stored identification information from among the at least one object image, based on the stored information on the image capture time of each image.

It should be understood by those skilled in the art that various modifications, combinations, sub-combinations and alterations may occur depending on design requirements and other factors insofar as they are within the scope of the appended claims or the equivalents thereof.

It should be understood by those skilled in the art that various modifications, combinations, sub-combinations and alterations may occur depending on design requirements and other factors insofar as they are within the scope of the appended claims or the equivalents thereof.

REFERENCE SIGNS LIST

T1 reference time
1 user
5 network
10 camera
12 frame image
20 server apparatus
23 image analysis unit
24 data management unit
25 alarm management unit
27 communication unit
30 client apparatus
40 person
41 thumbnail image
42 person tracking metadata
43 reference thumbnail image
53 object information
55 time axis
56 pointer
57 identical thumbnail image
61 predetermined range
65 map information
69 movement image
80 cut button
85 candidate thumbnail image
100 surveillance camera system
500 surveillance system
504 alarm screen
505 tracking screen
508 history screen

The invention claimed is:

1. An image processing apparatus comprising:

circuitry configured to obtain a plurality of segments compiled from at least one media source, wherein each segment of the plurality of segments consists of at least one image frame within which a specific target object is found to be captured, generate an object image which is a partial image comprising the specific target of each of the at least one image frame within which the specific target object is found to be captured, and display the object image along a timeline and in conjunction with a tracking status indicator that indicates a presence of the specific target object within the plurality of segments in relation to time.

2. The image processing apparatus of claim 1, wherein an object is specified as the specific target object prior to the compiling of the plurality of segments.

3. The image processing apparatus of claim 1, wherein the timeline is representative of capture times of the plurality of segments and the tracking status indicator is displayed along the timeline in conjunction with the displayed plurality of segments, the displayed plurality of segments being arranged along the timeline at corresponding capture times.

4. The image processing apparatus of claim 1, wherein each one of the displayed plurality of segments is selectable, and upon selection of a desired segment of the plurality of segments, the desired segment is reproduced.

5. The image processing apparatus of claim 4, wherein the desired segment is reproduced within a viewing display area while the image frames of the plurality of segments are displayed along the timeline.

6. The image processing apparatus of claim 5, wherein a focus is displayed in conjunction with at least one image of the reproduced desired segment to indicate a position of the specific target object within the at least one image.

7. The image processing apparatus of claim 6, wherein a map with an icon which indicates a location of the specific target object is displayed together with the reproduced desired segment and the image frames along the timeline in the viewing display area.

8. The image processing apparatus of claim 6, wherein the focus comprises at least one of an identity mark, a highlighting, an outlining, and an enclosing box.

9. The image processing apparatus of claim 5, wherein a path of movement over a period of time of the specific target object captured within the image frames of the plurality of segments is displayed at corresponding positions within images reproduced for display.

10. The image processing apparatus of claim 9, wherein when a user specifies, from within the viewing display area, a desired position of the specific target object along the path of movement, a focus is placed upon a corresponding segment displayed along the timeline within which corresponding segment the specific target object is found to be captured at a location of the desired position.

11. The image processing apparatus of claim 1, wherein the at least one image frame of each segment is represented by at least one respective representative image for display along the timeline, and the respective representative image for each segment of the plurality of segments is extracted from contents of each corresponding segment.

12. The image processing apparatus of claim 5, wherein an object which is displayed in the viewing display area can be selectable by a user as the specific target object, and based on the selection by the user, at least a part of the plurality of segments displayed along the timeline is replaced by a segment which contains the specific target object selected by the user in the viewing display area.

13. The image processing apparatus of claim 1, wherein the plurality of segments are generated based on images captured by different imaging devices.

14. The image processing apparatus of claim 13, wherein the different imaging devices comprise at least one of a mobile imaging device and a video surveillance device.

15. The image processing apparatus of claim 1, wherein the at least one media source comprises a database of video contents containing recognized objects, and the specific target object is selected from among the recognized objects.

16. The image processing apparatus of claim 5, wherein a monitor display area in which different images which represents different media sources are displayed is provided together with the viewing display area, and at least one displayed image in the viewing display area is changed based on a selection of an image displayed in the monitor display area.

17. The image processing apparatus of claim 1, wherein a plurality of candidate thumbnail images to be selectable as the specific target object by a user are displayed in connection with a position of the plurality of segments along the timeline.

18. The image processing apparatus of claim 17, wherein the plurality of candidate thumbnail images correspond to respective selected positions of the plurality of segments along the timeline and have high probability for inclusion of the specific target object.

19. The image processing apparatus of claim 1, wherein the specific target object is found to be captured based on a degree of similarity of objects appearing within the plurality of segments.

20. The image processing apparatus of claim 1, wherein the specific target object is recognized as being present within the plurality of segments according to a result of facial recognition processing.

21. An image processing method, the method being executed via at least one processor having circuitry, and comprising:

obtaining a plurality of segments compiled from at least one media source, wherein each segment of the plurality of segments consists of at least one image frame within which a specific target object is found to be captured;

generating an object image which is a partial image including the specific target of each of the at least one image frame within which the specific target object is found to be captured; and displaying the object image along a timeline and in conjunction with a tracking status indicator that indicates a presence of the specific target object within the plurality of segments in relation to time.

22. A non-transitory computer-readable medium having embodied thereon a program, which when executed by a computer having circuitry, causes the computer to perform a method, the method comprising:

obtaining a plurality of segments compiled from at least one media source, wherein each segment of the plurality of segments consists of at least one image frame within which a specific target object is found to be captured;

generating an object image which is a partial image including the specific target of each of the at least one image frame within which the specific target object is found to be captured; and displaying the object image along a timeline and in conjunction with a tracking status indicator that indicates a presence of the specific target object within the plurality of segments in relation to time.

23. The image processing apparatus according to claim 1, wherein the tracking status indicator further comprises information for identifying the specific target object.

24. The image processing apparatus according to claim 23, wherein the circuitry is further configured to arrange the object image having a same specific target along a same timeline.

* * * * *